US007548714B2

(12) United States Patent
Nagahama et al.

(10) Patent No.: US 7,548,714 B2
(45) Date of Patent: Jun. 16, 2009

(54) DEVELOPER CONTAINER AND IMAGE FORMING APPARATUS

(75) Inventors: Hitoshi Nagahama, Uji (JP); Masanobu Deguchi, Kashiba (JP); Kazuya Koyama, Ikoma (JP); Shigeki Hayashi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 71 days.

(21) Appl. No.: 10/562,552

(22) PCT Filed: Jul. 8, 2004

(86) PCT No.: PCT/JP2004/009747

§ 371 (c)(1),
(2), (4) Date: Dec. 28, 2005

(87) PCT Pub. No.: WO2005/006085

PCT Pub. Date: Jan. 20, 2005

(65) Prior Publication Data

US 2006/0147228 A1 Jul. 6, 2006

(30) Foreign Application Priority Data

Jul. 11, 2003 (JP) ..... 2003-195832

(51) Int. Cl.
*G03G 15/08* (2006.01)

(52) U.S. Cl. ..... 399/262; 399/263

(58) Field of Classification Search ..... 399/260, 399/261, 262, 263
See application file for complete search history.

(56) References Cited

U.S. PATENT DOCUMENTS 5,455,662 A 10/1995 Ichikawa et al.

(Continued)

FOREIGN PATENT DOCUMENTS

JP 4-124261 U 11/1992

(Continued)

OTHER PUBLICATIONS

English translation of JPO pub # 2003-345114.*

(Continued)

*Primary Examiner*—David M Gray
*Assistant Examiner*—Geoffrey T Evans
(74) *Attorney, Agent, or Firm*—Birch, Stewart, Kolasch & Birch, LLP

(57) ABSTRACT

An object of the invention is to provide a developer container in which a container main body is protected against damage by an external torsional and bending force and an impact as much as possible, developer in the vicinity of conveying means is prevented from aggregating as much as possible, and developer in the vicinity of a discharge hole is prevented from aggregating as much as possible. The developer container includes a cylindrical container main body (31) for containing developer for use in image formation, and is detachably mounted on an image forming apparatus, the container main body (31) being rotated about an axis thereof by drive means provided in the image forming apparatus to supply developer to the image forming apparatus, wherein conveying means for conveying the developer in an axial direction when the container main body is rotated about the axis is provided in an inner circumferential portion of the container main body (31), and the conveying means has a plurality of first and second protrusions (36, 39) extending in first and second extending directions and arranged at intervals in a circumferential direction and the axial direction.

9 Claims, 31 Drawing Sheets

U.S. PATENT DOCUMENTS 6,963,713 B2 * 11/2005 Isomura et al. ..... 399/262

FOREIGN PATENT DOCUMENTS

| | | | |
|---|---|---|---|
| JP | 07-020705 | A | 1/1995 |
| JP | 08-339115 | A | 12/1996 |
| JP | 10-171227 | A | 6/1998 |
| JP | 10-339993 | A | 12/1998 |
| JP | 2003-316137 | A | 11/2003 |
| JP | 2003-345114 | A | 12/2003 |
| JP | 2004347961 | A * | 12/2004 |

OTHER PUBLICATIONS

English translation of Nagahama, et al. (JP pub 2004-347961), published Dec. 9, 2004.*

* cited by examiner (1)

(2)

DEVELOPER CONTAINER AND IMAGE FORMING APPARATUS

TECHNICAL FIELD

The present invention relates to a developer container for containing a toner for use in formation of electrographic images, and an image forming apparatus having the developer container detachably mounted thereon.

BACKGROUND ART

FIG. 30(1) is a sectional view showing a toner bottle 1 according to a first conventional art. FIG. 30(2) is a perspective view showing the toner bottle 1. The toner bottle 1 is formed into a substantially cylindrical form having a bottom, and is provided with a housing space 2 for containing toner. The toner bottle 1 is provided with a projection piece 5 protruding inward in the radial direction and extending spirally with an axis L1 as a center from one end portion 3 in the axial direction to the other end portion 4 in the axial direction. The other end portion 4 in the axial direction of the toner bottle 1 is provided an opening portion 6 in which a hole having a smaller inner diameter than that of the remaining portions is formed so that the housing space 2 is in communication with the space outside the toner bottle 1.

The toner bottle 1 is coupled to a main body of an image forming apparatus (not shown) such that the axis L1 is parallel with a horizontal direction by coupling the opening portion 6 to the toner supply port that is provided in the main body of the image forming apparatus. In this state, when the toner bottle 1 is rotated about the axis L1 by the drive force of the driving portion that is provided in the main body of the image forming apparatus, the toner contained in the housing space 2 is led to the opening portion 6 by the projection piece 5 and supplied to the toner supply port from the opening portion 6 (refer to, for example, Japanese Unexamined Patent Publication JP-A 07-020705(1995)).

FIG. 31 is a perspective view showing a developer supplying container 10 according to a second conventional art. The developer supplying container 10 is formed into a cylindrical form having closed opposite ends, and is provided with a housing space for containing toner. The developer supplying container 10 is provided with a first projection piece 13 protruding inward in the radial direction and extending spirally with an axis L10 as a center from one end portion 11 in the axial direction to a central portion 12 in the axial direction, and a second projection piece 15 protruding inward in the radial direction and extending spirally with the axis L10 as a center from the other end portion 14 in the axial direction to the central portion 12 in the axial direction. In the central portion 12 in the axial direction of the developer supplying container 10 is formed a through hole 16 that penetrates the container in the radial direction to communicate the housing space and the space outside the developer supplying container 10.

The developer supplying container 10 is coupled to the main body of the image forming apparatus (not show) such that the axis L10 is parallel with the horizontal direction and the central portion 12 in the axial direction is opened upward so as to face the toner supply port provided in the main body of the image forming apparatus. In this state, the developer supplying container 10 is rotated about the axis L10 by the drive force of the driving portion that is provided in the main body of the image forming apparatus. Accordingly, the toner contained in the housing space of the developer supplying container 10 is led to the central portion 12 in the axial direction by the projection pieces 13 and 15, and when the through hole 16 is disposed at the position facing the toner supply port, the toner is supplied to the toner supply port via the through hole 16 (refer to, for example, Japanese Unexamined Patent Publication JP-A 08-339115(1996)).

FIG. 32 is a perspective view showing conventional developer supplying containers 100 and 100A according to a third conventional art. On a circumferential surface of the container many body for containing the developer is spirally recessed a guide groove 101 for guiding the developer contained inside the container main body to the supply port, accompanied with the rotation of the container main body. On every one pitch of the spiral of these guide grooves 101 is provided a plurality of discontinuous portions 102 (refer to, for example, Japanese Unexamined Patent Publication JP-A 10-171227(1998)).

Since the above-described toner bottle 1 of the first conventional art shown in FIG. 30 and the above-described developer supplying container 10 of the second conventional art shown in FIG. 31 have projection pieces 5; 13 and 15 formed so as to extend along a spiral direction about an axis, the developer in the neighborhood of the projection pieces 5; 13 and 15 receive a pushing force in a conveying direction by coming into contact with the projection pieces 5; 13 and 15. This leads the coagulated developer in the neighborhood of the projection pieces 5; 13 and 15, to the supply port in a coagulated state, so that when being supplied in this state to the developing portion, there are risks that a rough particle of the developer is attached to a part of the recording paper, on which an image should be formed and that the developer is attached to a part of the recording paper, on which an image is not formed, that is called as a fog.

In addition, in cases of the first and second conventional arts, when a twisting force from the outside about the axis, a bending force from the outside and an impact are added, there is a danger that the toner bottle 1 and the developer supplying container 10 are easily damaged by the occurrence of cracks which extend substantially along the spiral direction in the projection pieces 5; 13 and 15. Moreover, in a developer supplying container 100 of the third conventional art, it is possible to avoid the above-described problems of the toner bottle of the first conventional art and the developer supplying container 10 of the second conventional art. However, a plurality of the discontinuous portions 102 are, as shown by a reference numeral 103, arranged on the same straight line or the same spiral orbit on the outer circumferential portion of the container main body and therefore, there is a problem that when the container main body receives a pushing force inward in a radial direction, the discontinuous portions 102 arranged on the same straight line or the same spiral orbit are compressed in a circumferential direction so as to be easily deformed.

Moreover, in the toner bottle 1 of the first conventional art and the developer supplying container 10 of the second conventional art, the projection pieces 5; 13 and 15 are formed so as to extend along the spiral direction about the axis and therefore, a conveying quantity of the developer becomes uniform with respect to the axial direction. In the case where the conveying quantity of the developer is thus uniform with respect to the axial direction, when the toner bottle 1 and the developer supplying container 10 are rotated, the developer contained in the toner bottle 1 and the developer supplying container 10 are uniformly conveyed to a discharge hole. Accordingly, there is a possibility that the conveyed developers are coagulated by being collided and pushed each other in the neighborhood of the opening portion 6 and the through hole 61.

In order to solve this problem, the inventors have devised a developer container comprising a container main body for containing the developer, formed into a cylindrical shape, having a discharge hole for discharging developer provided on a middle portion in the axial direction, the container main body conveying the contained developer to the discharge hole by being rotated about an axis thereof; and a supporting member for supporting the container main body from the outside in the radial direction all over the circumference, the container main body including at least the discharge hole from the outside in the radial direction all over the circumference so as to be freely rotated about an axis thereof, the supporting member having a leading through hole provided therein, the leading through hole guiding the developer discharged from the discharge hole of the container main body to the outside. A conventional configuration such that the developer is conveyed from one end portion in the axial direction of the container to the other end portion in the axial direction, involves a risk that a to-be-conveyed developer is coagulated by being pushed onto inside wall which is perpendicular to an axial line provided on the other end portion in the axial direction of the container. In the above-described developer container, it is possible to agitate the developer by mutual collision between the developer from the one end portion in the axial direction and the developer from the other end portion in the axial direction in the neighborhood of the discharge hole inside the container main body, that is on the middle portion in the axial direction where a wall surface perpendicular to the axial line seen in the conventional configuration is not provided. In this way, in comparison with the conventional container in which the discharge hole is provided on the other end portion of the container, the developer container in which the discharge hole is provided on the middle portion in the axial direction of the container main body has an advantage that the developer is hardly coagulated in the neighborhood of the discharge hole. However, in the developer container in which the discharge hole is provided on the middle portion in the axial direction of the container main body, in the case where the developer is coagulated at least either on the one end portion in the axial direction or the other end portion in the axial direction, it is necessary to soften the developer which is coagulated in approximately a half of the conveying distance in comparison with the conventional container in which the discharge hole is provided on the other end portion of the container. In the case of being unable to soften it, the developer is lead to the supply port in a state where the developer is coagulated. When the developer is supplied in this state, there are risks that a rough particle of the developer is attached to a part of the recording paper, on which an image should be formed and that the developer is attached to a part of the recording paper, on which an image is not formed, that is called as a fog.

DISCLOSURE OF INVENTION

Accordingly, an object of the invention is to provide a developer container which is capable of preventing as much as possible a twisting force from the outside about an axial direction of a container main body, a bending force from the outside, a pushing force inward in a radial direction, and damage and deformation by an impact, and moreover preventing as much as possible a developer from being coagulated and further softening the coagulated developer rapidly, and an image forming apparatus on which the developer container is detachably mounted.

The invention is a developer container comprising a cylindrical container main body for containing a developer for use in image formation, the developer container being detachably mounted on an image forming apparatus, the container main body being rotated about an axis thereof by driving means provided in the image forming apparatus to supply the developer to the image forming apparatus, the container main body having a discharge hole on its substantially middle portion in an axial direction, for discharging the developer, and conveying means in an inner circumferential portion of the container main body, for conveying the developer in the axial direction when the container main body is rotated about the axis, the conveying means having a plurality of conveying portions extending in an extending direction from one end portion to the other end portion in the axial direction as it is directed to a downstream side in a rotation direction, the conveying portions being formed at intervals in a circumferential direction thereof and the axial direction, of which adjacent two conveying portions in the axial direction being arranged in such a manner that an end portion on a downstream side in the rotation direction of one conveying portion and an end portion on an upstream side in the rotation direction of the other conveying portion adjoin each other in the axial direction.

According to the invention, when the container main body is rotated about the axis, the developer contained in the container main body can be conveyed in the axial direction while being oscillated, by the conveying means provided in the inner circumferential portion of the container main body so that the developer can be discharged from the discharge port provided on the substantially middle portion in the axial direction of the container main body. In the case where the conveying means is formed into, for example, projection pieces extending inward in the radial direction, or a groove sinking outward in the radial direction, such as the case where the conveying means extends in the spiral direction about the axis, the developer located close to the conveying means is given a pushing force in the axial direction from the conveying means. Accordingly, there is a danger that the developer is coagulated in the neighborhood of the projection pieces and the developer is supplied to an image forming apparatus in such a coagulated state. Further, in this case, when the container main body is given a twisting force from the outside about the axis, a bending force from the outside and an impact, there is a danger that the container main body is easily damaged by the occurrence of cracks which extend substantially along the spiral direction in the conveying means of the container main body. Further, in the case where a plurality of conveying portions are formed at intervals in the circumferential direction and the axial direction, when portions between the conveying portions, which are adjacent to each other in the circumferential direction, are arranged on the same straight line or the same spiral orbit like the conventional art, when the container main body is given a pushing force inward in the radial direction, the conveying portions, which are arranged on the same straight line or the same spiral orbit, are compressed in the circumferential direction and easily deformed.

The conveying means includes a plurality of the conveying portions extending in the extending direction from the one end portion to the other end portion in the axial direction as it is directed to the downstream side in the rotation direction. The conveying portions are formed at intervals in the circumferential direction and the axial direction, and the adjacent conveying portions in the axial direction are arranged in such a manner that the end portion on the downstream side in the rotation direction of one conveying portion and the end portion on the upstream side in the rotation direction of the other conveying portion adjoin each other in the axial direction. Therefore, the portions between the adjacent conveying portions in the circumferential direction, will not be arranged on the same straight line or the same spiral orbit. Accordingly, even when the container main body is given a twisting force from the outside about the axis, a bending force from the outside and an impact and even when the container main body is given a pushing force inward in the radial direction, the occurrence of damage and deformation of the container main body can be prevented as much as possible. Furthermore, since the conveying portions are arranged at intervals in the circumferential direction, the developer conveyed in the axial direction by the conveying portions intermittently comes into contact with the conveying portions. Therefore, the developer can be prevented from coagulation at the conveying portions, and further the developer can be conveyed in the axial direction being oscillated. Moreover, on the substantially middle portion in the axial direction inside the container main body, where the discharge hole is provided, the developer can be positively agitated on the substantially middle portion in the axial direction by the mutual collision between the developer conveyed from the one end portion in the axial direction and the developer conveyed from the other end portion in the axial direction. In the case where the discharge hole is provided on the substantially middle portion in the axial direction of the container main body as in the invention, the developer must be softened quickly since a distance in which the developer is conveyed is shorter in comparison with a case where the discharge hole is provided on the one end portion in the axial direction of the container main body. In the invention, inside the rotating container main body, the developer is agitated on the substantially middle portion in the axial direction of the container main body, and the developer is oscillated when being conveyed in the axial direction toward the discharge hole, so that the coagulated developers on the one end portion in the axial direction and on the other end portion in the axial direction are rapidly softened while being conveyed in a shorter distance to the discharge hole than conventional distance, and it is possible to positively prevent the developer in a coagulated state from being conveyed to the discharge hole.

Further, the invention is characterized in that the conveying portions are formed so as to meander in a substantially S-shape.

According to the invention, since the conveying portions are formed so as to meander in the substantially S-shape, it is possible to regulate conveying amount of the developer in the axial direction by forming the conveying portions with a meandering degree thereof adjusted.

Further, the invention is characterized in that the container main body is provided with a discharge hole for discharging the developer, and the conveying portions are formed so that the conveying amount of the developer by a conveying portion formed in a close portion to the discharge hole becomes larger than the conveying amount of the developer by a conveying portion formed in a distant portion from the discharge hole.

According to the invention, since the conveying portions are formed so that the conveying amount of the developer by the conveying portion formed in a close portion to the discharge hole becomes larger than the conveying amount of the developer by the conveying portion formed in a distant portion from the discharge hole, it is possible to positively prevent the developer located on a close position to the discharge hole from being pushed into the discharge hole by the developer located on a distant position from the discharge hole. Accordingly, the developer located on the close position to the discharge hole is pushed into the discharge hole by the developer located on the distant position from the discharge hole and thereby, the developer can be positively prevented from being coagulated in the neighborhood of the discharge hole.

Further, the invention is characterized in that the conveying portions are formed so that the conveying portions formed in a close portion to the discharge hole proceed in the axial direction in the longer distance as proceeding in the circumferential direction in comparison with the conveying portion formed in the distant portion from the discharge hole.

According to the invention, the conveying portions are formed so that the conveying portion formed in the close portion to the discharge hole proceed in the axial direction in the longer distance as proceeding in the circumferential direction in comparison with the conveying portion formed in the distant portion from the discharge hole. Consequently, it is possible to realize that the conveying amount in the axial direction of the developer close to the discharge hole at the time when the container main body is being rotated is made larger than the conveying amount in the axial direction of the developer far away from the discharge hole as described above.

Further, the invention is characterized in that the conveying portions are formed so that the conveying portion formed in the close portion to the discharge hole have a larger size in an extending direction in comparison with the conveying portion formed in the distant portion from the discharge hole.

According to the invention, the conveying portion formed in the close portion to the discharge hole is formed so as to have a larger size in the extending direction in comparison with the conveying portion formed in the distant portion from the discharge hole. Consequently, it is possible to realize that the conveying amount in the axial direction of the developer close to the discharge hole at the time when the container main body is rotated is made larger than the conveying amount in the axial direction of the developer far away from the discharge hole as described above.

Further, the invention is characterized in that the conveying portions are formed so as to protrude inward in a radial direction, and the conveying portion formed in the close portion to the discharge hole is formed so as to have a larger protruding amount inward in the radial direction in comparison with the conveying portion formed in the distant portion from the discharge hole.

According to the invention, the conveying portions are formed so as to protrude inward in the radial direction, and the conveying portion formed in the close portion to the discharge hole is formed so as to have a larger protruding amount inward in the radial direction in comparison with the conveying portion formed in the distant portion from the discharge hole. Consequently, it is possible to realize that the conveying amount in the axial direction of the developer close to the discharge hole at the time when the container main body is rotated is made larger than the conveying amount in the axial direction of the developer far away from the discharge hole as described above.

Further, the invention is an image forming apparatus in which the developer container mentioned above is detachably mounted.

According to the invention, the image forming apparatus can detachably mount the developer container which achieves the above-described action.

BRIEF DESCRIPTION OF DRAWINGS

Other and further objects, features, and advantages of the invention will be more explicit from the following detailed description taken with reference to the drawing wherein.

BEST MODE FOR CARRYING OUT THE INVENTION

Figure 1:
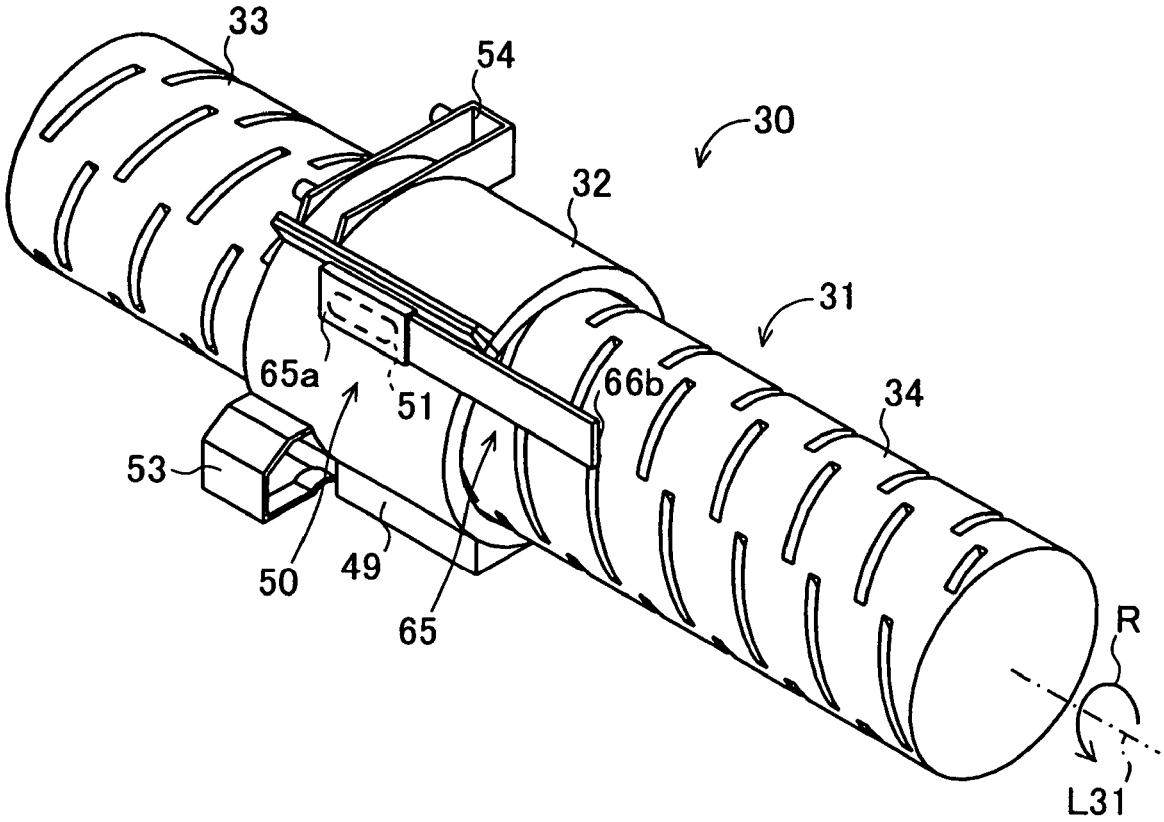
FIG. 1 is a perspective view showing a developer container 30 according to an embodiment of the invention.

Now referring to the drawings, preferred embodiments of the invention are described below.

Figure 2:
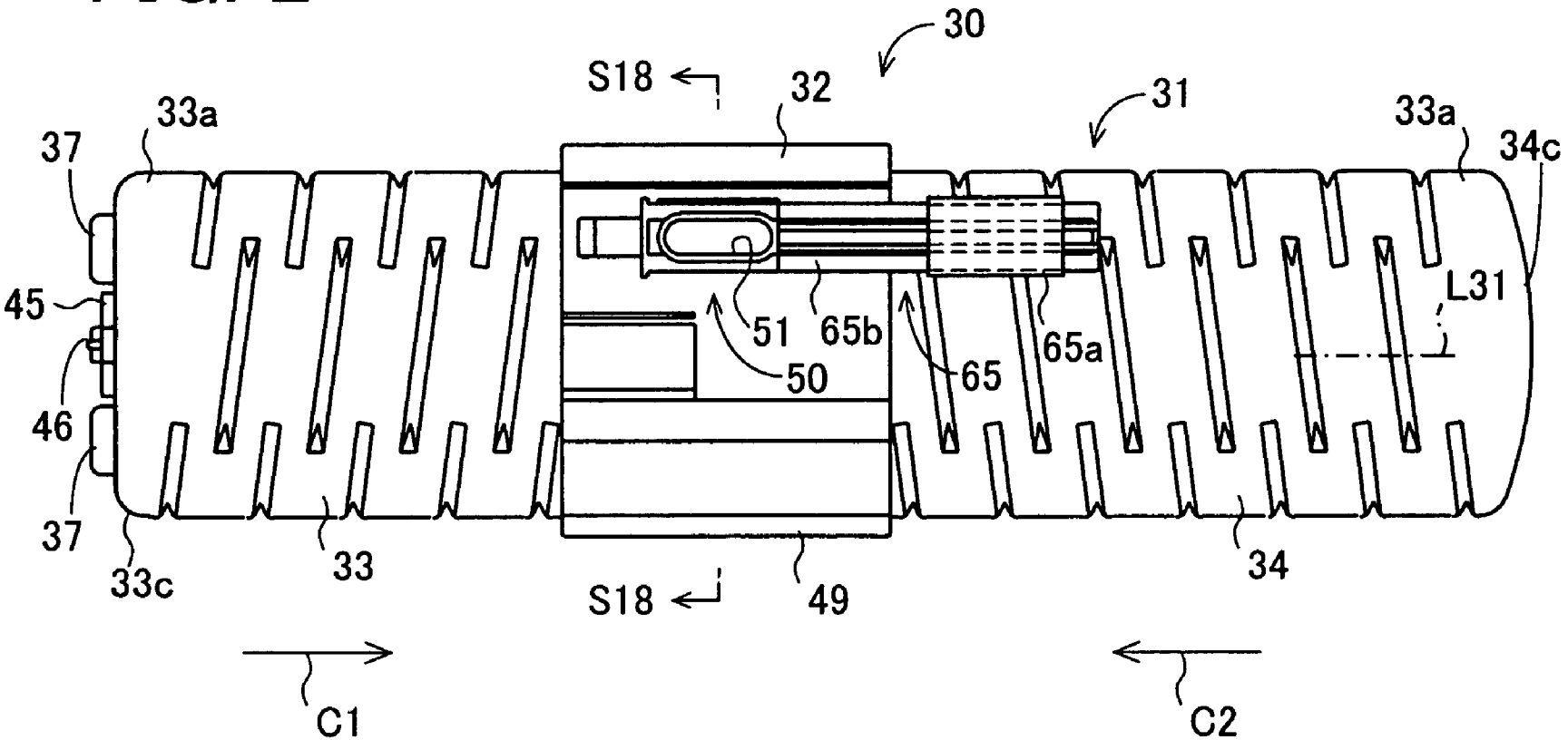
FIG. 2 is a front view showing the developer container 30.
Figure 3:
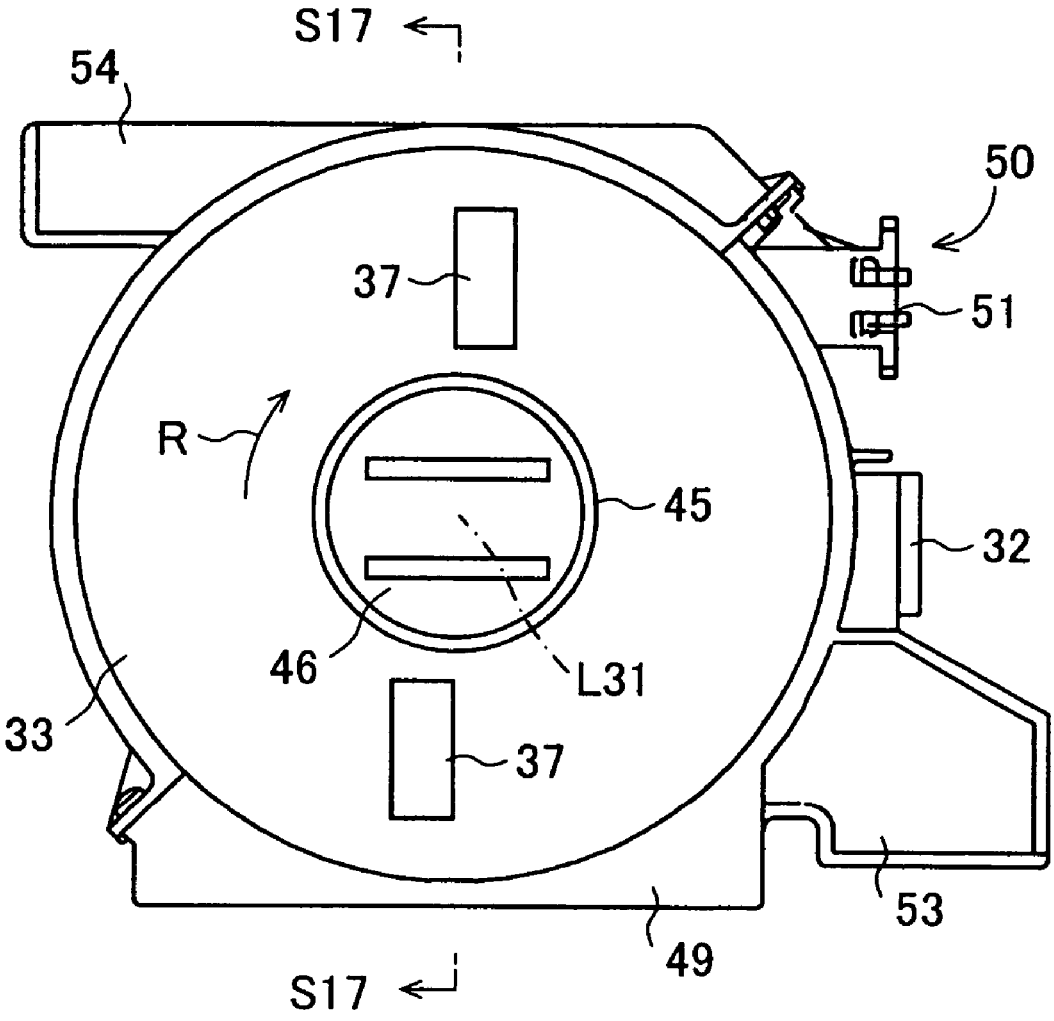
FIG. 3 is a left side view showing the developer container 30.

FIG. 1 is a perspective view showing a developer container 30 according to an embodiment of the invention. FIG. 2 is a front view showing the developer container 30. FIG. 3 is a left side view showing the developer container 30. The developer container 30 includes a container main body 31 and a supporting member 32. The container main body 31 is formed into a substantially cylindrical shape, in which developer such as colored toner for use in formation of electrographic images, is contained. The supporting member 32 pivotally supports the container main body 31 so as to be freely rotated about an axis L31 thereof. For example, the developer container 30 is capable of containing developer of 1400 grams. Hereinafter, the axis L31 of the container main body 31 may be described as a rotation axis L31.

Figure 4:
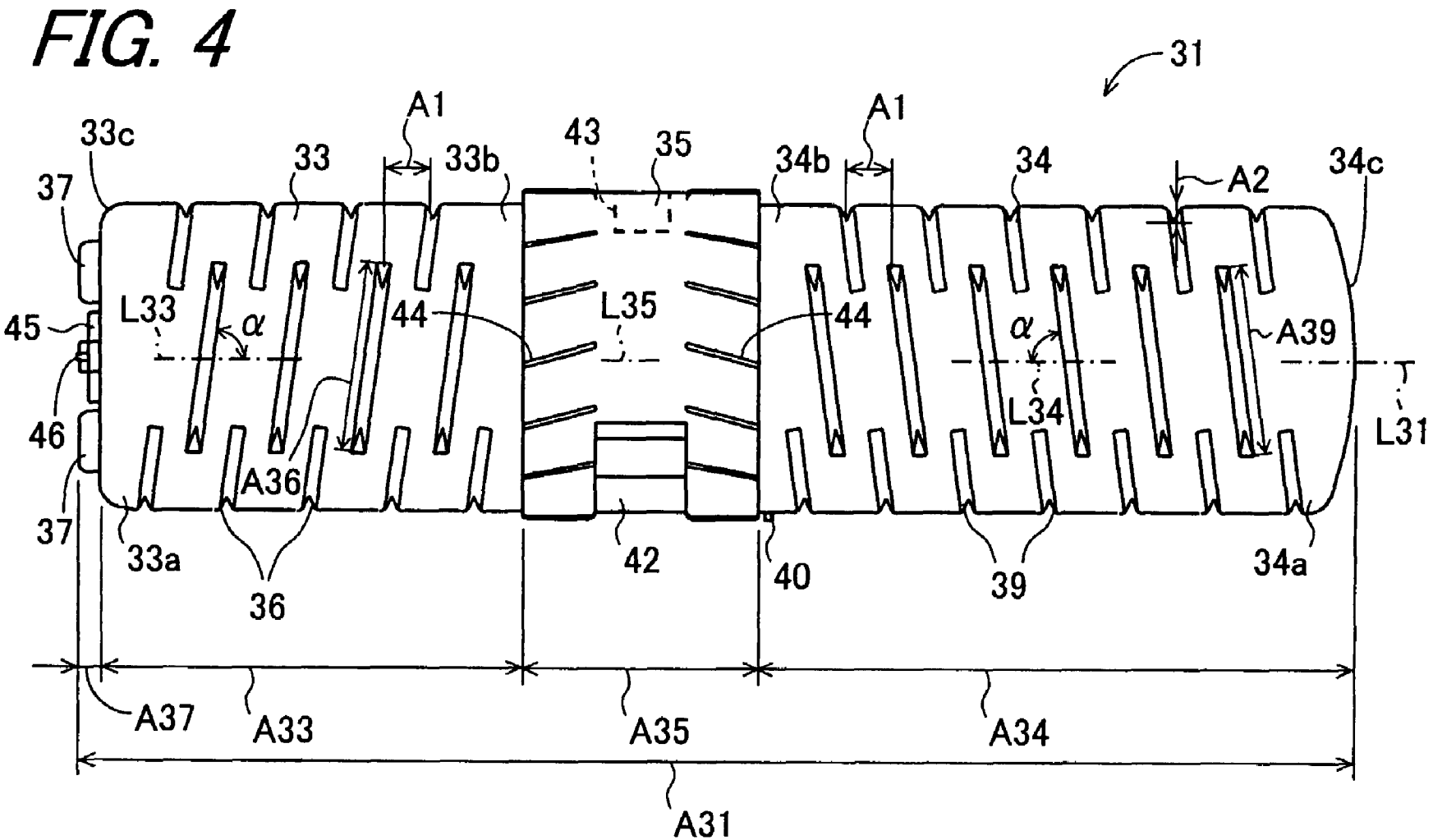
FIG. 4 is a front view showing a container main body 31.
Figure 5:
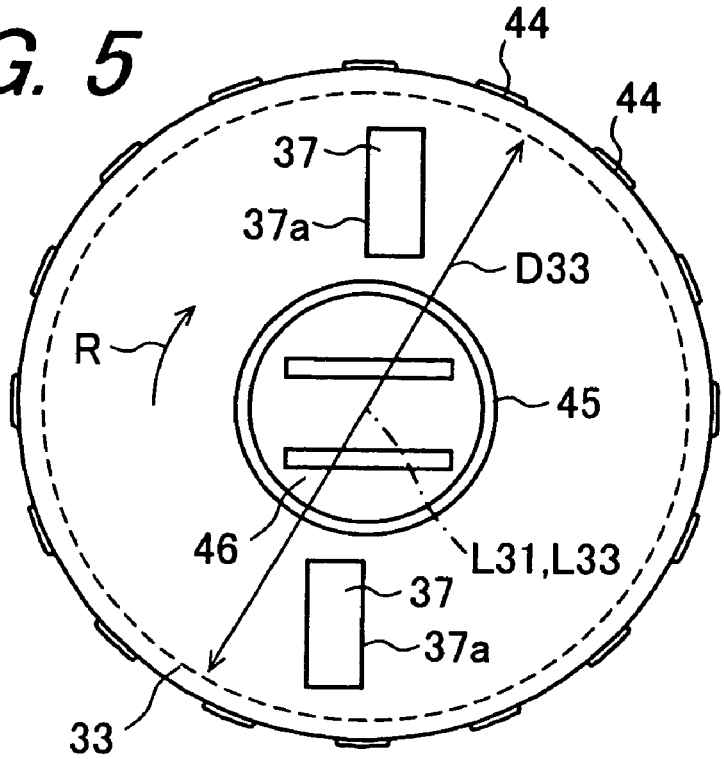
FIG. 5 is a left side view showing the container main body 31.
Figure 6:
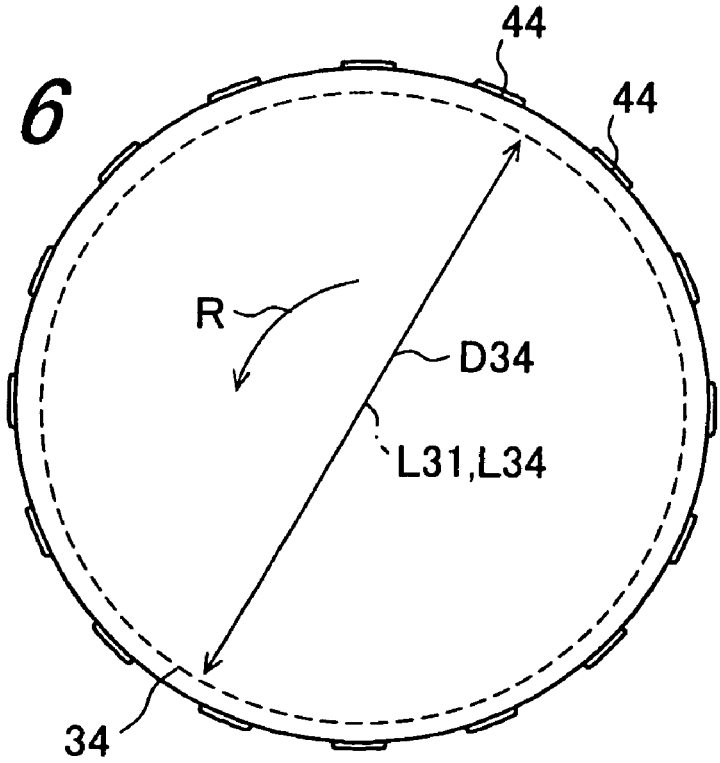
FIG. 6 is a right side view showing the container main body 31.

FIG. 4 is a front view showing the container main body 31. FIG. 5 is a left side view showing the container main body 31. FIG. 6 is a right side view showing the container main body 31. The container main body 31 includes a first container segment 33, a second container segment 34, and a third container segment 35. A length A31 in the axial direction L31 of the container main body 31 can be arbitrarily set, for example, at 458 mm.

The first container segment 33 is formed into a cylindrical shape having a bottom. A length A33 in the axial direction of the first container segment 33 can be arbitrarily set, for example, at 160 mm. In the inner circumferential portion of the first container segment 33 is provided conveying means for conveying developer in the axial direction when being rotated about the axis L31. As shown in FIG. 4, the conveying means includes first projection pieces 36 which are a plurality of conveying portions protruding inward in the radial direction, which first projection pieces 36 extend in the first extending direction from the opening end portion 33*b* which is the other end portion in the axial direction of the first container segment 33, to the bottom portion 33*a* which is one end portion in the axial direction, as it is directed to the downstream side in the rotation direction. The first projection pieces 36 are formed at intervals in the circumferential direction and the axial direction. The first projection pieces 36, which are adjacent to each other in the axial direction are arranged so that a downstream side end portion in the rotation direction of one first projection piece 36 and an upstream side end portion in the rotation direction of the other first projection piece 36 adjoin each other in the axial direction. To describe in detail, the first projection pieces 36 are formed so as to be inclined and extend into an arc shape so that the downstream end portion in the rotation direction can be arranged closer to the bottom portion 33*a* side than the upstream side end portion in the rotation direction.

As shown in FIGS. 4 and 5, on the bottom portion 33*a* of the first container segment 33 are formed a convex fit 37 which is a connecting portion protruding from the opening end portion 33*b* to the bottom portion 33*a*, and a replenishment port 45. A plurality of convex fits 37 are formed, and in this embodiment, two convex fits 37 are formed. The replenishment port 45 is formed at the center of the bottom portion 33*a* of the first container segment 33 in such a manner that the replenishment port 45 penetrates the first container segment 33 in the direction of a rotation axis L31 and is open into a circular shape, the axis of which is the same as the axis L33 of the first container segment 33. To the replenishment port 45 is attached a replenishment lid 46, the shape of which is formed so as to correspond to the shape of the replenishment port 45, which is detachably attached to the replenishment port 45, in a state where sealing is accomplished between the replenishment port 45 and the replenishment lid 46 so that the replenishment lid 46 is not detached by rotation of the container main body 31. When the replenishment lid 46 is detached from the replenishment port 45, the inner space and the outer space of container main body 31 are communicated with each other. In this state, the developer can be supplied to the container main body 31.

To describe in detail, the convex fits 37 are arranged outside the replenishment port 45 in the radial direction at positions substantially symmetrical to each other with respect to the axis L33 of the first container segment 33. In the convex fits 37, to describe more in detail, as shown in FIG. 5, the upstream side portion 37*a* in the rotation direction R, which is a rotation direction of clockwise about the rotation axis L31 as viewed from the bottom portion 33*a* of the first container segment 33, is formed so as to have a plane extending vertically in the circumferential direction. Moreover, the downstream side portion in the rotation direction R of the convex fit 37 is formed so as to be inclined to the other end portion side in the axial direction as it comes to the downstream side in the rotation direction R. A protruding length A37 from the residual portion of the bottom portion 33*a* of the convex fit 37 in the direction of the axis L33 can be arbitrarily set, for example, at 8 mm. Such a convex fit 37 can be attached to and detached from the main body-side coupling section 83 (shown in FIG. 29) provided in the image forming apparatus 70 described later.

In addition, as shown in FIG. 4, the face 33*c* for communicating the outer circumferential face with the end face in the bottom portion 33*a* of the first container segment 33 is formed into a curved face which inclines inward in the radial direction as it comes from the opening end portion 33*b* to the bottom portion 33*a*.

The second container segment 34 is formed into a cylindrical shape having a bottom portion. A length A34 in the axial direction of the second container segment 34 can be arbitrarily set, for example, at 210 mm. In the inner circumferential portion of the second container segment 34 is provided conveying means for conveying the developer in the axial direction when being rotated about the axis L31. As shown in FIG. 4, the conveying means includes second projection pieces 39 which are a plurality of conveying portions protruding inward in the rotation direction, which second projection pieces 39 extend in the second extending direction from the opening end portion 34*b* which is one end portion in the axial direction of the second container segment 34, to the bottom portion 34*a* which is the other end portion in the axial direction, as it is directed to the downstream side in the rotation direction. The second projection pieces 39 are formed at intervals in the circumferential direction and the axial direction. Two first projection pieces 39, which are adjacent to each other in the axial direction, are arranged so that a downstream side end portion in the rotation direction of one second projection piece 39 and an upstream side end portion in the rotation direction of the other second projection piece 39 adjoin each other in the axial direction. To describe in detail, the second projection pieces 39 are formed so as to be inclined and extend into an arc shape so that the downstream end portion in the rotation direction can be arranged closer to the bottom portion 34*a* side than the upstream side end portion in the rotation direction.

The length A34 in the axial direction of the second container segment 34 is set longer than the length A33 in the axial direction of the first container segment 33, for example, by a length not less than 30 mm. As described before, the length A33 in the axial direction of the first container segment 33 can be set at an arbitrary value, for example, 150 mm. The length A34 in the axial direction of the second container segment 34 can be set at an arbitrary value, for example, 215 mm. Further, the inner diameter D33 of the inner circumferential portion except for the first projection piece 36 of the first container segment 33 and the inner diameter D34 of the inner circumferential portion except for the second projection piece 39 of the second container segment 34 can be set at an arbitrary value, for example, 105 mm. The interval A1 of a pair of the first projection pieces 36 and a pair of the second projection pieces 39, which are adjacent to each other in the axial direction, can be set at an arbitrary value, for example, 15 mm.

It is preferable that the length A36 in the first extending direction of the first projection piece 36 and the length A39 in the second extending direction of the second projection piece 39 are not less than 1/16 and not more than 3/8 of the inner circumferential length of the first container segment 33 and the inner circumferential length of the second container segment 34. When the length A36 in the first extending direction of the first projection piece 36 and the length A39 in the second extending direction of the second projection piece 39 are shorter than 1/16 of the inner circumferential length of the first container segment 33 and the inner circumferential length of the second container segment 34, the developer conveying capacity is decreased. Moreover, when the length A36 in the first extending direction of the first projection piece 36 and the length A39 in the second extending direction of the second projection piece 39 are longer than 3/8 of the inner circumferential length of the first container segment 33 and the inner circumferential length of the second container segment 34, the strength of the container main body 31 is decreased, which is not preferable. Further, when the conveying capacities of the first projection piece 36 and the second projection piece 39 are too large, coagulation of the developer may be caused in the neighborhood of the discharge hole, which is not preferable. In this embodiment, the length A36 in the first extending direction of the first projection piece 36 and the length A39 in the second extending direction of the second projection piece 39 can be at an arbitrary value, for example, 60 mm. In addition, an interval of the two first projection pieces 36, which are adjacent to each other in the circumferential direction, and an interval of the two second projection pieces 39, which are adjacent to each other in the circumferential direction, can be set at an arbitrary value, for example, 50 mm.

Further, the protruding length A2 of the first projection piece 36 and the second projection piece 39 from the residual portions of the inner circumferential portions of the first container segment 33 and the second container segment 34 inward in the radial direction is preferably not less than 1 mm and not more than 10 mm. When the protruding length A2 is longer than 10 mm, the developer conveying capacities of the first projection piece 36 and the second projection piece 39 can be increased, however, when the developer conveying capacities are too large, there is a possibility that the developer is coagulated in the neighborhood of the discharge hole, which is not preferable. Further, when the protruding length A2 is longer than 10 mm, it becomes difficult for the first projection piece 36 and the second projection piece 39 to be formed by means of blow molding. On the contrary, when the protruding length A2 is shorter than 1 mm, the developer conveying capacity is decreased, and it becomes impossible to convey a sufficient quantity of developer to the discharge hole. In the embodiment, the protruding length A2 of the first projection piece 36 and the second projection piece 39 from the residual portions of the inner circumferential portions inward in the radial direction may be, for example, 6 mm. Moreover, when the numbers of the first projection pieces 36 and the second projection pieces 39 are large, the developer conveying capacity can be enhanced. In the embodiment, the number of the first projection pieces 36 may be 26, and the number of the second projection pieces 39 may be 38.

Moreover, it is preferable that the angle α, which is formed between the tangents of the first projection piece 36 and the second projection piece 39 and the tangents of the circumferential directions of the first container segment 33 and the second container segment 34, is not less than 2° and not more than 45°, more preferably, not less than 5° and not more than 30°. In the embodiment, the angle α may be, for example, approximately 9°. The developer conveying capacity of the container main body 31 is determined by the geometrical conditions of the first projection piece 36 and the second projection piece 39 described before. Therefore, the developer conveying capacity of the container main body 31 is determined so that an appropriate quantity of developer can be always discharged from the discharge hole 43 in all states from the state in which the container main body 31 is filled with the developer to the state which is just before the state in which the developer has been completely discharged.

At least a face for communicating the outer circumferential face with the end face in the bottom portion 34*a* of the second container segment 34 is formed into a curved face which inclines inward in the radial direction as it comes from the opening end portion 34*b* to the bottom portion 34*a*. To describe in detail, the end face 34*c* of the bottom portion 34*a* of the second container segment 34 is formed into a partially spherical shape, the central portion of which is protruded from the opening end portion 34*b* to the bottom portion 34*a*. In the outer circumferential portion located between the end face of the opening end portion 34*b* of the second container segment 34 and the bottom portion 34*a*, a plurality of guiding projection pieces 40, which protrude outward in the radial direction, are arranged in the circumferential direction at intervals. In the embodiment, two guiding projection pieces 40 are arranged. The size of the guiding projection piece 40 in the axial direction can be set at an arbitrary value, for example, 2.5 mm.

Figure 7:
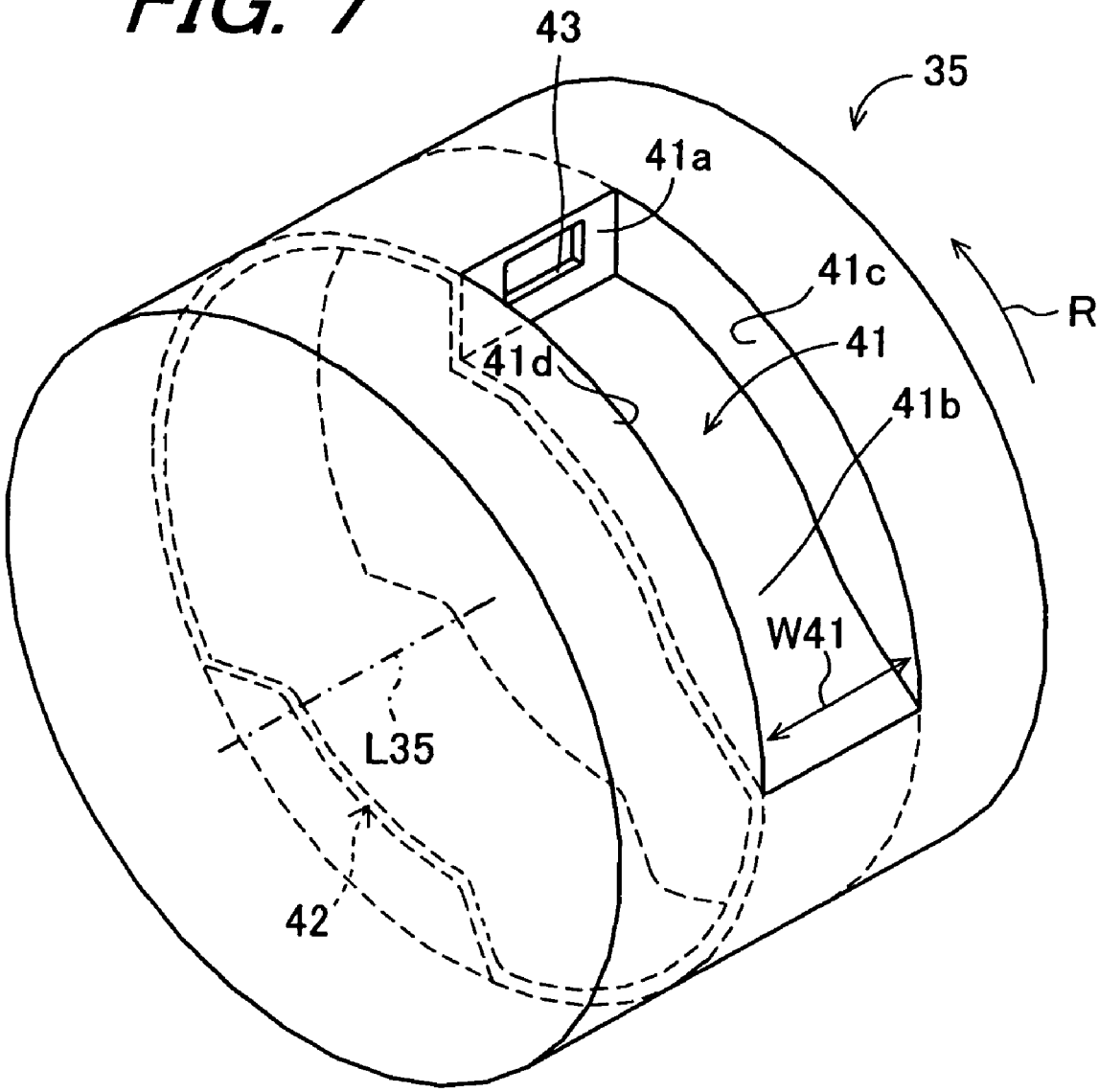
FIG. 7 is a perspective view showing a third container segment 35.
Figure 8:
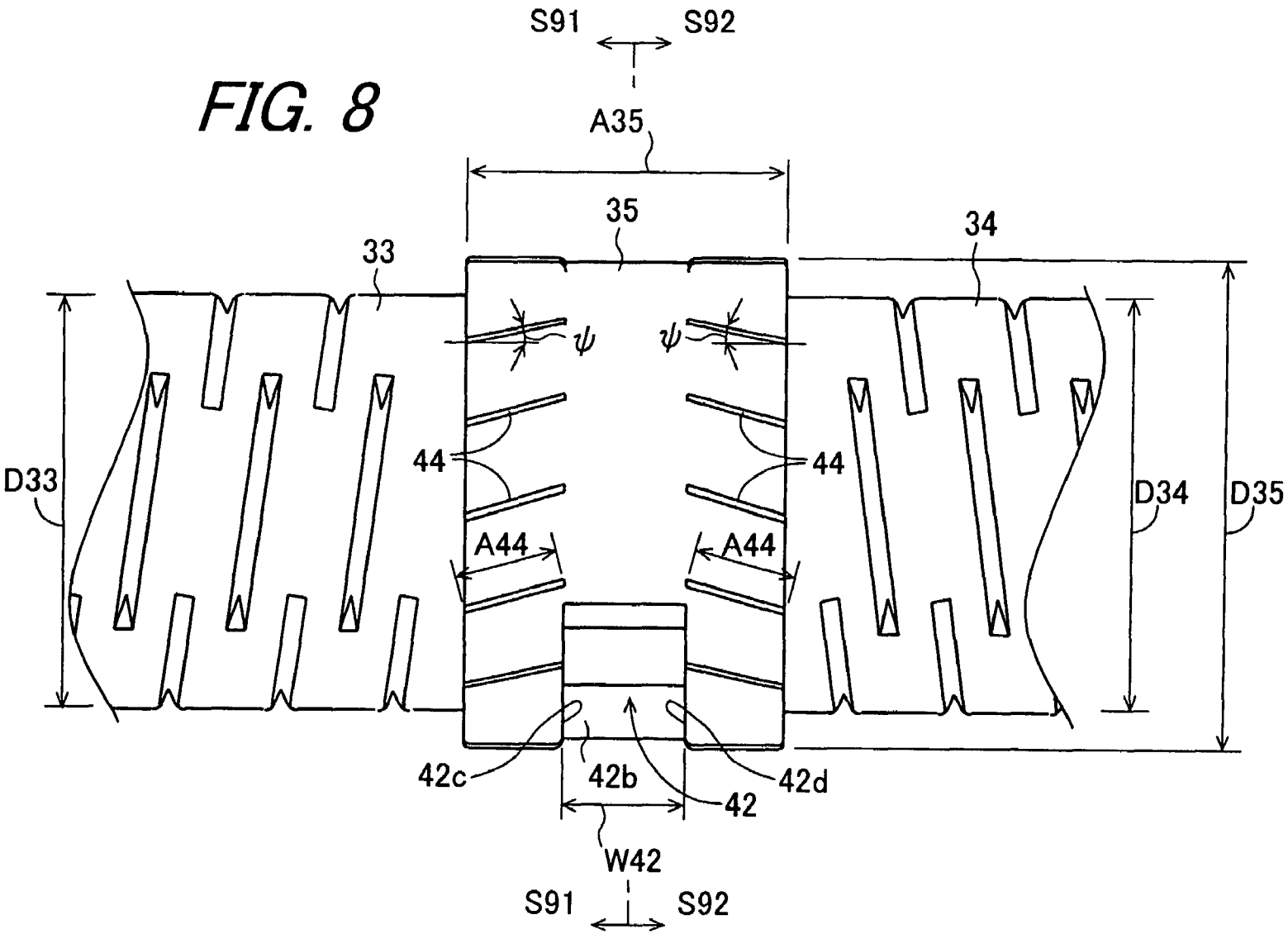
FIG. 8 is an enlarged front view showing a neighborhood of the third container segment 35.
Figure 9:
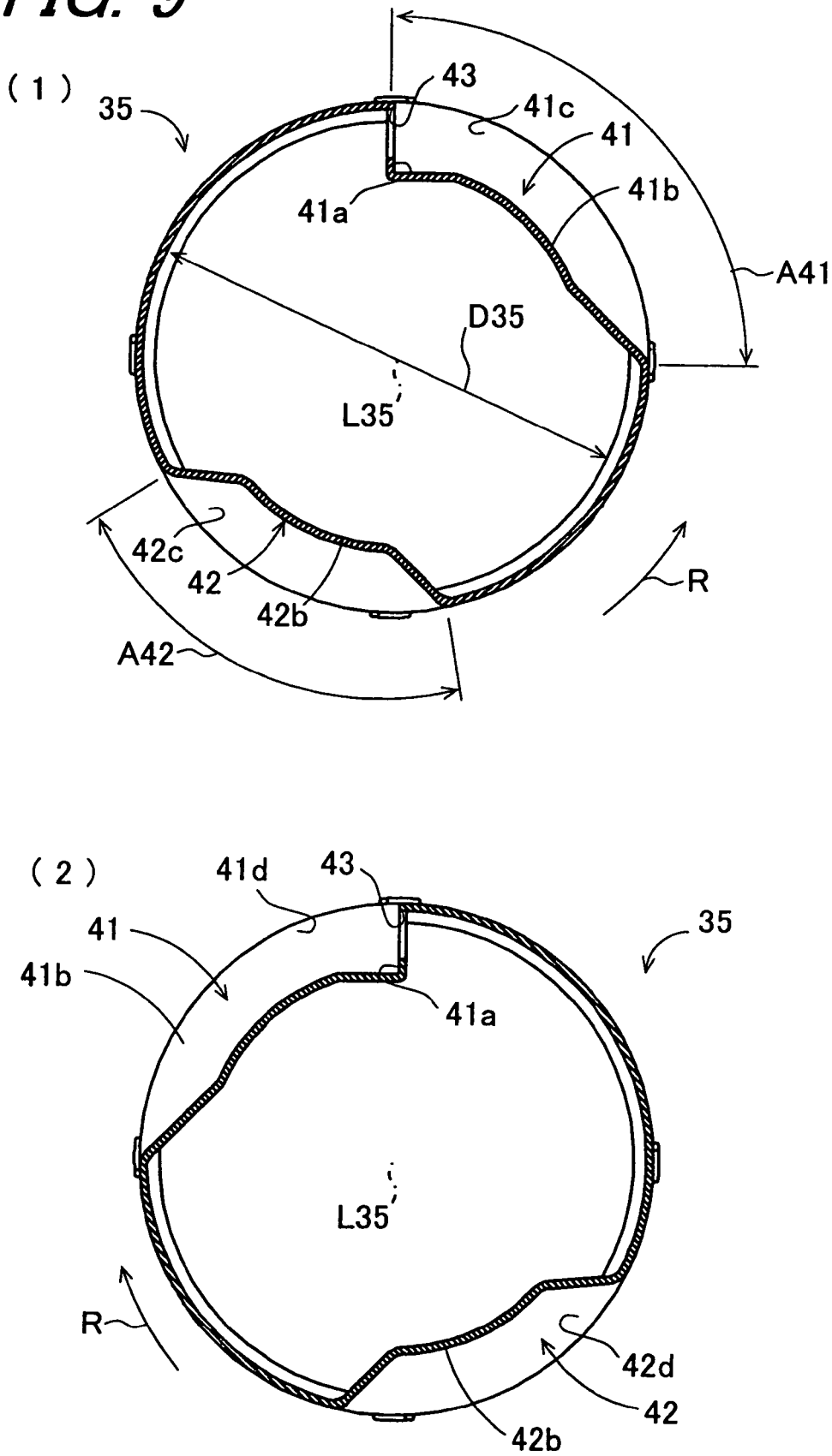
FIG. 9(1) is a sectional view taken on a cross-sectional line S91-S91 in FIG. 8, and FIG. 9(2) is a sectional view taken on a cross-sectional line S92-S92 in FIG. 8.

FIG. 7 is a perspective view showing the third container segment 35. FIG. 8 is an enlarged front view showing a neighborhood of the third container segment 35. FIG. 9(1) is a sectional view taken on a cross-sectional line S91-S91 in FIG. 8, and FIG. 9(2) is a sectional view taken on a cross sectional line S92-S92 in FIG. 8. Reference is also made to FIG. 4. The third container segment 35 is substantially formed into a cylindrical shape. To describe in detail, the third container segment 35 has a first concavity 41 and a second concavity 42 provided therein, which are concavities sinking inward in the radial direction, in the middle portion in the axial direction of the outer circumferential portion thereof. In the first concavity 41, the discharge hole 43 for discharging the developer is provided. The length A35 in the axial direction of the third container segment 35 may be, for example, 80 mm. The inner diameter D35 of the third container segment 35 except for the first concavity 41 and the second concavity 42 is formed so as to be larger than the inner diameters D33 and D34 of the first container segment 33 and the second container segment 34 which are residual portions. The inner diameter D35 of the third container segment 35 except for the first concavity 41 and the second concavity 42 can be set at an arbitrary value, for example, 110 mm.

The first concavity 41 is formed so as to extend in the rotation direction R. The size W41 in the axial direction of the first concavity 41 is smaller than the size A41 in the rotation direction R. The first concavity 41 is provided with an end wall portion 41*a*, which crosses the rotation direction R, at the end portion on the downstream side in the rotation direction R. The discharge hole 43 is formed in a portion of the end wall portion 41*a* arranged on the downstream side in the rotation direction of the first concavity 41. The second concavity 42 is formed so as to extend in the rotation direction R. The size W42 in the axial direction of the second concavity 42 is smaller than the size A42 in the rotation direction R. The second concavity 42 is provided at intervals in the circumferential direction of the third container segment 35 from the first concavity 41. It is preferable that the size A41 in the rotation direction R of the first concavity 41 is not less than ¼ and smaller than ½ of the outer circumferential length of the third container segment 35 except for the first concavity 41 and the second concavity 42. The size A41 in the rotation direction R of the first concavity 41 may be, for example, 120 mm. The size W41 in the axial direction may be, for example, 30 mm. In addition, the size A42 in the rotation direction R of the second concavity 43 may be set at an arbitrary value, for example, 120 mm. The size W42 in the axial direction may be set at an arbitrary value, for example, 30 mm.

To describe in detail, the first concavity 41 further includes a bottom wall portion 41*b*, a first side wall portion 41*c*, and a second side wall portion 41*d*. The bottom wall portion 41*d* of the first concavity 41 extends in the rotation direction R. The downstream side end portion in the rotation direction R is communicated with the inward portion in the radial direction of the end wall portion 41*a*. The upstream side end portion in the rotation direction R is smoothly communicated with the outer circumferential portion of the third container segment 35 except for the first concavity 41 and the second concavity 42 between the first concavity 41 and the second concavity 42. The central portion in the rotation direction R between the downstream side end portion in the rotation direction R of the bottom wall portion 41*b* of the first concavity 41 and the upstream side end portion in the rotation direction R is arranged inward in the radial direction compared with the third container segment 35 except for the first concavity 41 and the second concavity 42. Briefly speaking, the central portion in the rotation direction R is formed into a partially cylindrical shape, the axis of which is the axis L35 of the third container segment 35. The curvature radius of the outer circumferential portion of the central portion in the rotation direction R of the bottom wall portion 41*b* of the first concavity 41 can be set at an arbitrary value, for example, 49 mm.

The first side wall portion 41*c* of the first concavity 41 is arranged on one end side in the axial direction of the first concavity 41, and extends in the rotation direction R. The downstream side end portion in the rotation direction R is communicated with one end portion in the axial direction of the end wall portion 41*a*, and the inward portion thereof in the radial direction is communicated with one end portion in the axial direction of the bottom wall portion 41*b*, and the outward portion thereof in the radial direction is communicated with the outer circumferential portion of one end portion in the axial direction of the third container segment 35 except for the first concavity 41 and the second concavity 42. The second side wall portion 41*d* of the first concavity 41 is arranged on the other end side in the axial direction of the first concavity 41, and extends in the rotation direction R. The downstream side end portion in the rotation direction R is communicated with the other end portion in the axial direction of the end wall portion 41*a*. The inward portion in the radial direction is communicated with the other end portion in the axial direction of the bottom wall portion 41*b*. The outward portion in the radial direction is communicated with the outer circumferential portion of the other end portion in the axial direction of the third container segment 35 except for the first concavity 41 and the second concavity 42. The first side wall portion 41*c* and second side wall portion 41*d* of the first concavity are provided so as to be perpendicularly arranged at the bottom wall portion 41*b* outward in the radial direction. The bottom wall portion 41*b* and the first side wall portion 41*c* are substantially perpendicular to each other. Further, the bottom wall portion 41*b* and the second side wall portion 41*d* are substantially perpendicular to each other.

The discharge hole 43 is formed at a middle portion in the axial direction of the end wall portion 41*a* of the first concavity 41 and outward in the radial direction, so as to be formed into an opening having a rectangle shape, the long side of which is set in the axial direction. Accordingly, in the end wall portion 41*a* of the first concavity 41, the discharge hole 43 is open at a position which is located outward in the radial direction with respect to the downstream side end portion in the rotation direction R of the bottom wall portion 41*b* of the first concavity 41 and which is located closer to the other end in the axial direction with respect to the downstream side end portion in the rotation direction R of the first side wall portion 41*c* and which is located closer to the one end in the axial direction with respect to the downstream side end portion in the rotation direction R of the second side wall portion 41*d*. To describe in more detail, the face on the outside in the radial direction of the discharge hole 43 is smoothly communicated with the inner circumferential face of the third container segment 35 except for the first concavity 41 and the second concavity 42 on the downstream side in the rotation direction R of the first concavity 41.

To describe in detail, the second concavity 42 further includes a bottom wall portion 42*b*, a first side wall portion 42*c*, and a second side wall portion 42*d*. The bottom wall portion 42*b* of the second concavity 42 extends in the rotation direction R. The upstream side end portion in the rotation direction R and the downstream side end portion in the rotation direction R are smoothly communicated with the outer circumferential portion of the third container segment 35 except for the first concavity 41 and the second concavity 42 between the first concavity 41 and the second concavity 42. The central portion in the rotation direction R between the downstream side end portion in the rotation direction R of the bottom wall portion 42*b* of the second concavity 42 and the upstream side end portion in the rotation direction R is arranged inward in the radial direction compared with the third container segment 35 except for the first concavity 41 and the second concavity 42. The central portion in the rotation direction R is formed substantially into a partially cylindrical shape, the axis of which is the axis L35 of the third container segment 35. The curvature radius of the outer circumferential portion of the central portion in the rotation direction R of the bottom wall portion 42*b* of the second concavity 42 can be set at an arbitrary value, for example, 49 mm.

The first side wall portion 42*c* of the second concavity 42 is arranged on one end portion side in the axial direction of the second concavity 42, and extends in the axial direction R, and the inward portion thereof in the radial direction is communicated with one end portion in the axial direction of the bottom wall portion 42*b*, and the outward portion thereof in the radial direction is communicated with the outer circumferential portion of one end portion in the axial direction of the third container segment 35 except for the first concavity 41 and the second concavity 42. The second side wall portion 42*d* of the second concavity 42 is arranged on the other end side in the axial direction of the second concavity 42, and the inward portion thereof in the radial direction is communicated with the other end portion in the axial direction of the bottom wall portion 42*b*, and the outward portion thereof in the radial direction is communicated with the outer circumferential portion of the other end portion in the axial direction of the third container segment 35 except for the first concavity 41 and the second concavity 42. The first side wall portion 42*c* and the second side wall portion 42*d* of the second concavity are provided so as to be perpendicularly arranged at the bottom wall portion 42*b* outward in the radial direction. The bottom wall portion 42*b* and the first side wall portion 42*c* are substantially perpendicular to each other and moreover, the bottom wall portion 42*b* and the second side wall portion 42*d* are substantially perpendicular to each other.

In the outer circumferential portions of one end portion in the axial direction and the other end portion in the axial direction of the third container segment 35 except for the first concavity 41 and the second concavity 42 are, as shown in FIG. 8, provided a plurality of the discharge guide pieces 44 protruding outward in the radial direction so as to be arranged at intervals each other, that is at a regular interval in the circumferential direction. To describe in detail, the discharge guide piece 44 provided in one end portion in the axial direction of the third container segment 35 is inclined in the rotation direction R as it comes to one end portion in the axial direction from the other end portion in the axial direction. Further, to describe in detail, the discharge guide piece 44 provided in the other end portion in the axial direction of the third container segment 35 is inclined in the rotation direction R as it comes to the other end portion in the axial direction from one end portion in the axial direction. The protruding length of the discharge guide piece 44 outward in the radial direction from the outer circumferential portion of the third container segment 35 except for the first concavity 41 and the second concavity 42 can be, for example, 1 mm. Further, the size of the discharge guide piece 44 in the longitudinal direction can be 24 m, and the angle ψ defined by the longitudinal direction of the discharge guide piece 44 and the width direction of the third container segment 35 can be, for example, 30°.

The container main body 31 is composed so as to be integrated into one body in such a manner that one end portion in the axial direction of the third container segment 35 and the opening end portion 33*b* of the first container segment 33 are connected to each other and that the other end portion in the axial direction of the third container segment 35 and the opening end portion 34*b* of the second container segment 34 are connected to each other. The container main body 31 may be manufactured by means of blow molding of synthetic resin such as polyethylene. In this way, the container main body 31 can be easily manufactured and the number of parts of the developer container 30 can be decreased.

The bottom portion 33*a* of the first container segment 33 becomes one end portion 33*a* in the axial direction of the container main body 31, and the bottom portion 34*a* of the second container segment 34 becomes the other end portion 34*a* in the axial direction of the container main body 31. As described above, when the first container segment 33, the second container segment 34 and the third container segment 35 are connected with each other so that the axes L33, L34 and L35 of the containers can be aligned on the same axis, the container main body 31 can be formed. Further, in the above state, the third container segment 35 is arranged in the central portion in the axial direction except for both end portions 33*a* and 34*a* in the axial direction of the container main body 31. Accordingly, the first concavity 41, the second concavity 42 and the discharge hole 43 of the third container segment 35 are arranged in the middle portion in the axial direction except for both end portions 33*a* and 34*a* in the axial direction of the container main body 31. The axis L31 of the container main body 31 is comprised of the axis L33 of the first container segment 33, the axis L34 of the second container segment 34 and the axis L35 of the third container segment 35.

Figure 10:
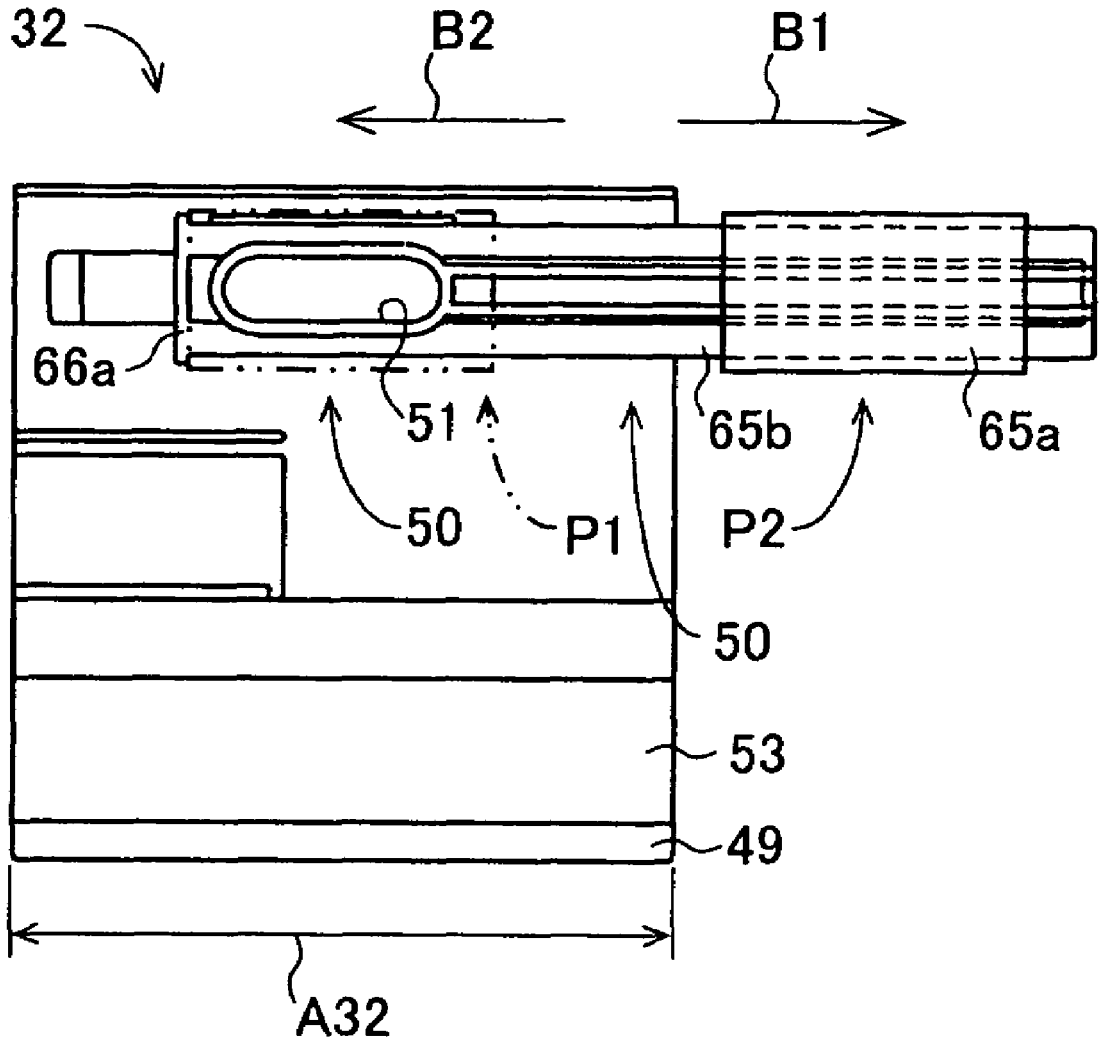
FIG. 10 is a front view showing a supporting member 32.
Figure 11:
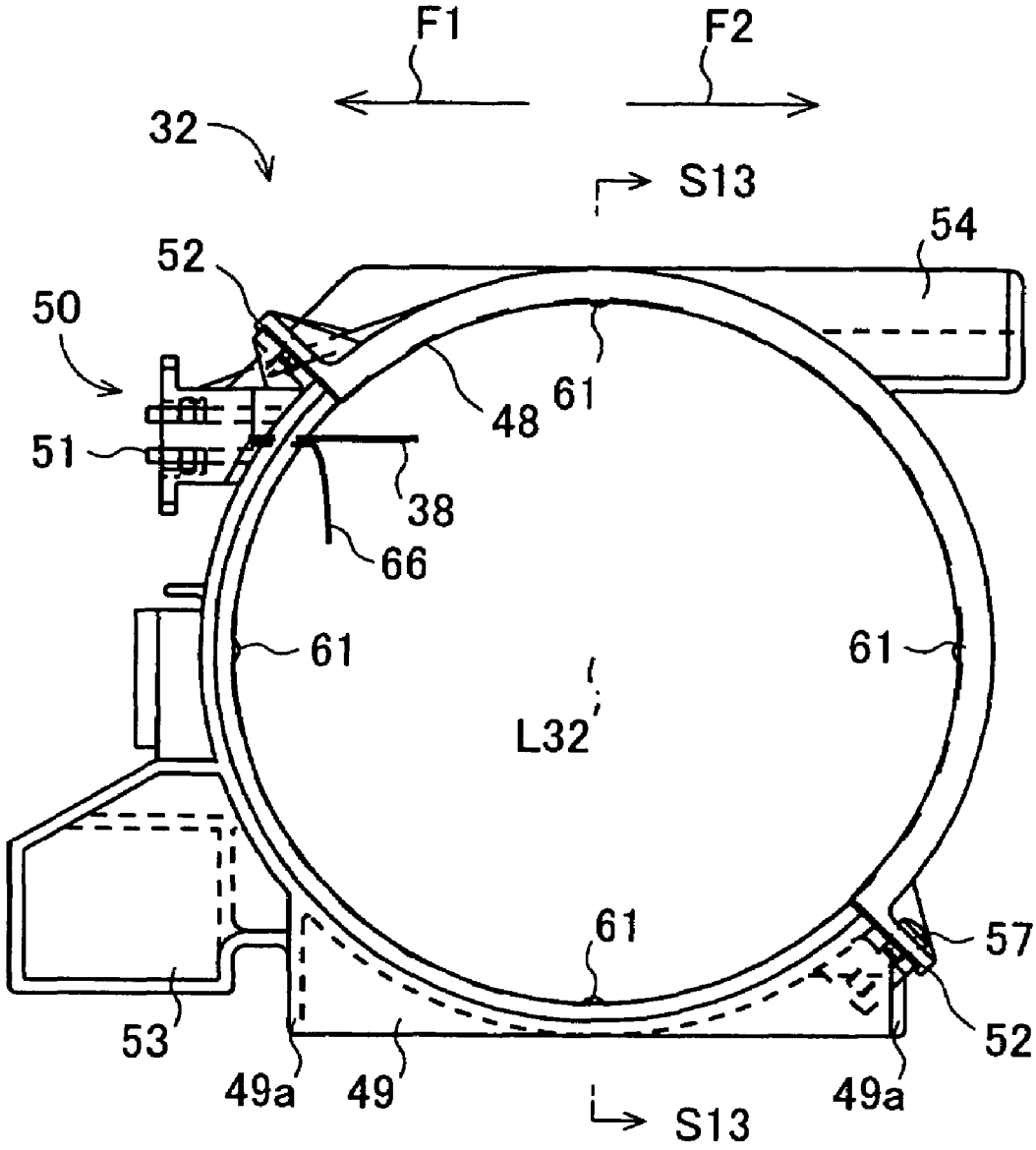
FIG. 11 is a right side view showing the supporting member 32.

FIG. 10 is a front view showing the supporting member 32. FIG. 11 is a right side view showing the supporting member 32. The supporting member 32 is formed substantially into a cylindrical shape and includes the inner circumferential portion 48 for supporting at least the third container segment 35 of the container main body 31, which is composed as described above, all over the circumference from the outside in the radial direction. The inner circumferential portion 48 includes a cylindrical inner circumferential face formed about the axis L32. The supporting member 32 includes a supporting base 49 having at least three or more abutment portions 49*a* on a virtual face parallel with the axis L32. The abutment portions 49*a* of the supporting base 49 may be, for example, formed into two rectangular planes, the longitudinal directions of which are parallel with the axis L32. When the abutment portions 49*a* of the supporting base 49 are made to come into contact with the horizontal face, the axis L48 of the inner circumferential portion 48 of the supporting member 32 can be arranged in parallel with the horizontal face. The length A32 in the axial direction of the supporting member 32 is set to be longer than the length A35 in the axial direction of the third container segment 35. The size A32 in the axial direction of the supporting member 32 can be set at an arbitrary value, for example, 100 mm.

Under the condition that the supporting base 49 is horizontally set, the discharge section 50, which protrudes in one first horizontal direction F1, is formed in an upper portion of the supporting member 32. In the middle portion in the axial direction of the supporting member 32 in the discharge section 50 is provided the leading through hole 51 which penetrates in the first horizontal direction and is formed into an opening having an elliptical shape extending in the direction parallel with the axis L32 of the supporting member. The inner diameter in the longitudinal direction of the leading through hole 51 is set at a value not less than the size W41 in the axial direction of the first concavity 41 of the container main body 31 and the size W42 in the axial direction of the second concavity 42.

In the discharge section 50 of the supporting member 32 is provided the shutter portion 65 which changes over the opening on the downstream side in the one first horizontal direction F1 of the leading through hole 51 between the open state and the closed state. The shutter portion 65 includes a shutter 65*a* and a shutter guide 65*b*. The shutter guide 65*b* extends in the second horizontal direction which is perpendicular to the first horizontal direction. The leading through hole 51 is open in the upstream side end portion in one second horizontal direction B1. The shutter 65*a* is slidably supported by the shutter guide 65*b* so as to be freely displaced in the one second horizontal direction B1 and in the other second horizontal direction B2 which is opposite to the one second horizontal direction B1.

The shutter 65*a* is slidingly displaced along the shutter guide 65*b*, and is thereby arranged either in a closing position P1 as indicated by a chain double dashed line in FIG. 10, the closing position P1 at which the downstream side opening in the one first horizontal direction F1 of the leading through hole 51 is closed, or in an opening position P2, at which the downstream side opening in the one first horizontal direction F1 of the leading through hole 51 is opened. Moreover, the shutter 65*a* is restrained from further sliding displacement in the downstream side in the other second horizontal direction B2 beyond the closing position P1, and is also restrained from further sliding displacement in the one second horizontal direction B1 from the downstream side end in the one second horizontal direction B1 of the shutter guide 65*b*. That is, the opening position P2 is located closer to the downstream side in the one second horizontal direction B1 than the closing position P1, and is simultaneously located closer to the upstream side in the one second horizontal direction B1 than the downstream side end in the one second horizontal direction B1 of the shutter guide 65*b*. In this way, the shutter 65*a* is disposed at the opening position P2 by being slidingly displaced in the one second horizontal direction B1 in a state of being disposed at the closing position P1, and is disposed at the closing position P1 by being slidingly displaced in the other second horizontal direction B2 in a state of being disposed at the opening position P2.

Further, on the supporting member 32 are provided a leading-out member 38 which is leading-out means, and a sealing sheet 66 which is sealing means. The leading-out member 38 is made of high polymer resin such as polyethylene terephthalate (abbreviation: PET) and formed into a sheet shape having flexibility and elasticity. A proximal end portion of the leading-out member 38 is attached to the inner circumferential portion of the supporting member 32. To be in more detail, the leading-out member 38 is provided in a portion facing the upstream side end portion in the one first horizontal direction F1 of the leading through hole 51 of the supporting member 32. The sealing sheet 66 is, for example, made of polyethylene and formed into a soft sheet shape. The proximal end portion of the sealing sheet 66 is attached to a portion facing the upstream side end portion in the one first horizontal direction F1 of the leading through hole 51 of the supporting member 32. The proximal end portion of the leading-out member 38 is laminated on an upper face portion of the proximal end portion of the sealing sheet 66. The leading-out member 38 and the sealing sheet 66 will be explained in more detail later.

Further, in the supporting member 32 are formed two coupling projections 52, which protrude outward in the radial direction. One coupling projection 52 is arranged above the discharge portion 50 under the condition that the supporting base 49 is horizontally installed. The other coupling projection 52 is arranged at a position symmetrical to the one coupling projection 52 described above with respect to the axis L32. Moreover, in the supporting member 32 is provided a first guide piece 53 which is arranged below the discharge portion 50 under the condition that the supporting base 49 is horizontally set and which protrudes in the one first horizontal direction F1 and extends in parallel with the axis L32. Further, in the supporting member 32 is provided a second guide piece 54 which is arranged above the discharge portion 50 under the condition that the supporting base 49 is horizontally set and which protrudes in the other first horizontal direction F2, which is an opposite direction to the one first horizontal direction F1, and which extends in parallel with the axis L32.

Figure 12:
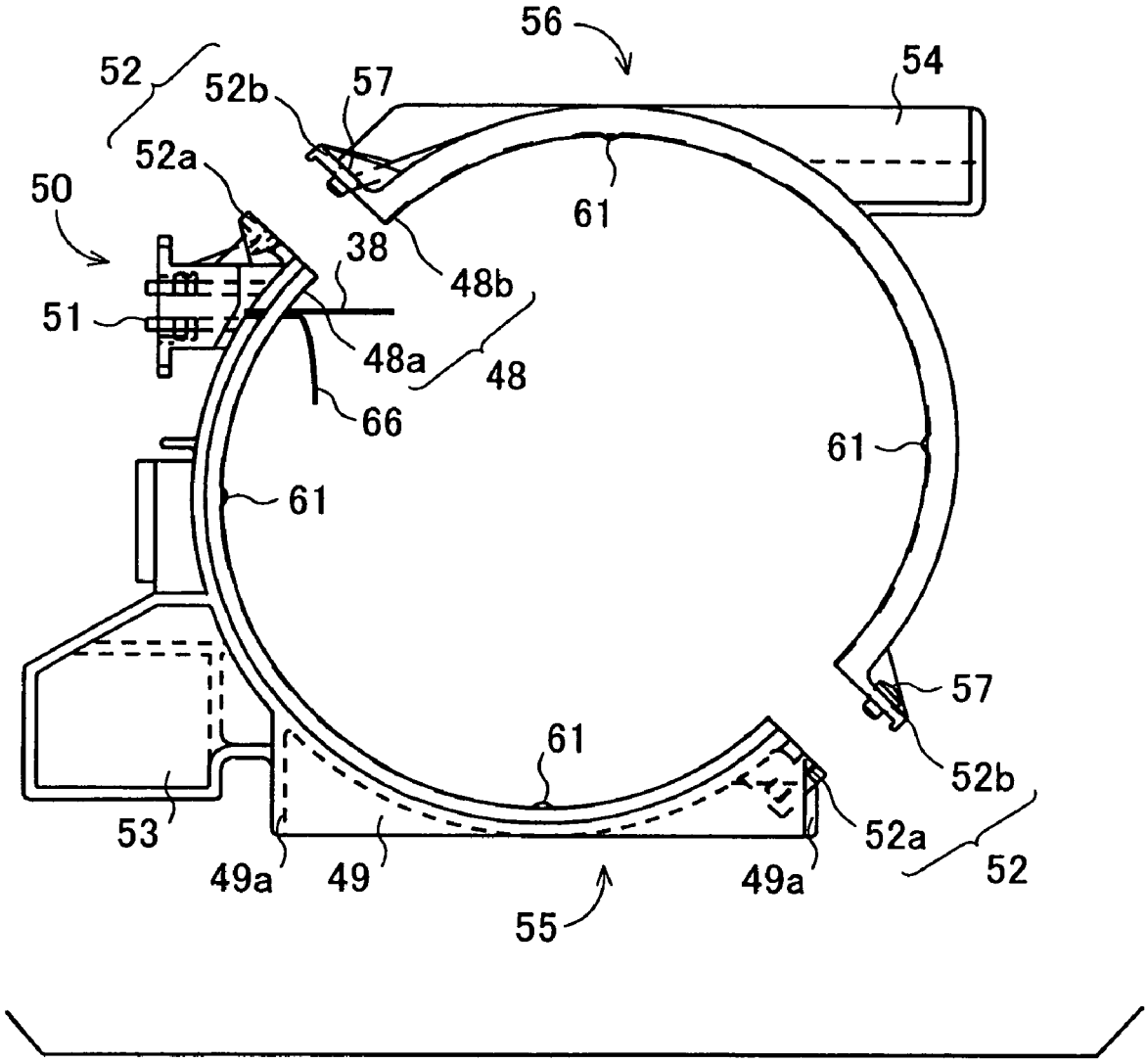
FIG. 12 is an exploded right side view showing the supporting member 32.

FIG. 12 is an exploded right side view showing the supporting member 32. The supporting member 32 can be divided into two pieces on a virtual plane which passes through the axis L32 and inclines upward as it is directed to the one first horizontal direction F1 in a state of being arranged on a horizontal plane. To be in more detail, the supporting member 32 can be divided into the first supporting portion 55, which is below the virtual plane, and the second supporting portion 56 which is above the virtual plane. The first supporting portion 55 includes the first guide piece 53, the discharge portion 50, one portion 52*a* of the coupling projection 52, the supporting base 49, and the portion 48*a* on the first guide piece 53 side of the inner circumferential portion 48, in the supporting member 32. The second supporting portion 56 includes the second guide piece 54, the other portion 52*b* of the coupling projection 52, and the portion 48*a* on the supporting base 49 side of the inner circumferential portion 48, in the supporting member 32.

The first supporting member 55 and the second supporting member 56 are detachably connected to each other by the screw members 57. To be in detail, one portion 52*a* of the connecting coupling projection 52 of the first supporting portion 55 and the other portion 52*b* of the connecting coupling projection 52 of the second supporting portion 56 are connected to each other by the screw members 57. Accordingly, when the container main body 31 is supported, the supporting member 32 has been previously divided into the two pieces, and the divided supporting members 32 can support the container main body 31 all over the circumference by supporting portions including the first and second concavities 41 and 42 and discharge port 43 of the container main body 31 from the outside in the radial direction. Therefore, the assembling work can be easily performed.

Figure 13:
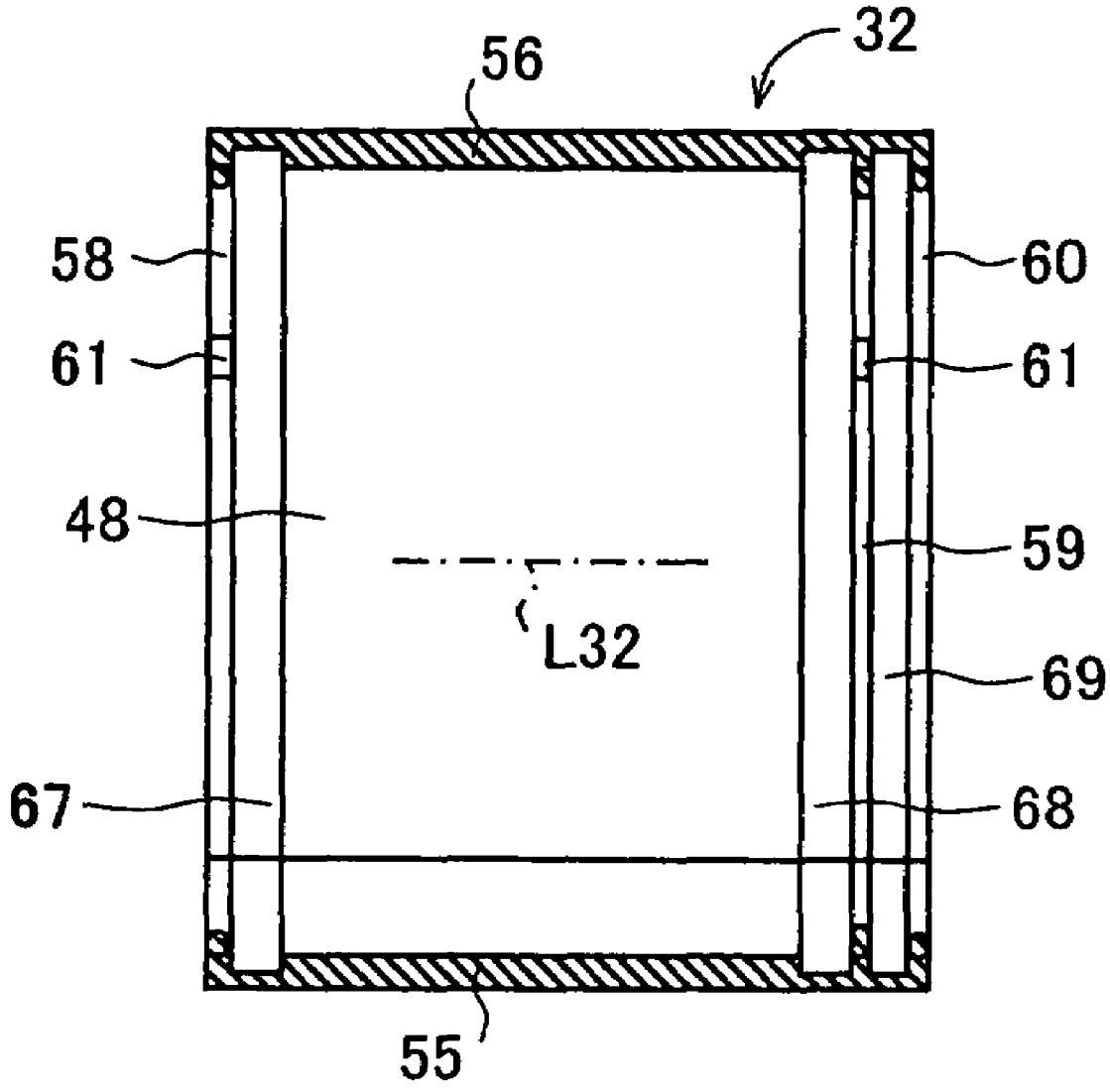
FIG. 13 is a sectional view taken on a cross-sectional line S13-S13 in FIG. 11.

FIG. 13 is a sectional view taken on a cross-sectional line S13-S13 in FIG. 11. Reference is also made to FIG. 11. In one end portion in the axial direction of the inner circumferential portion 48 of the supporting member 32 is provided the first supporting convexity 58 which extends all over the circumference in the circumferential direction and protrudes inward in the radial direction. In the other end portion in the axial direction of the inner circumferential portion 48 of the supporting member 32 is provided the second supporting convexity 59 which extends all over the circumference in the circumferential direction and protrudes inward in the radial direction. Further, in the other end portion in the axial direction of the inner circumferential portion 48 of the supporting member 32 is provided the third supporting convexity 60 which extends all over the circumference in the circumferential direction and protrudes inward in the radial direction and which is provided on the other end portion side in the axial direction with respect to the second supporting convexity 59 at an interval between the second supporting convexity 59 and the third supporting convexity 60. The interval between the second supporting convexity 59 and the third supporting convexity 60 is set a little larger than the size in the axial direction of the guide projection piece 40 of the second container segment 34 of the container main body 31, for example, at 3 mm.

In the first supporting convexity 58 and the second supporting convexity 59 are respectively formed a plurality of supporting projection pieces 61 which are arranged in the circumferential direction at regular intervals and protrude inward in the radial direction. In the embodiment, four supporting projection pieces 61 are formed. A forward end portion inward in the radial direction of the supporting projection piece 61 has a supporting face curved like a cylindrical outer circumferential face. Concerning the supporting projection pieces 61 of the first supporting convexity 58 and the second supporting convexity 59, the diameter of a virtual circle passing through the forward end portion of each guide projection piece 40 about the axis L32 is set a little larger than the outer diameter of the outer circumferential portion of the first container segment 33 and the outer diameter of the outer circumferential portion of the second container segment 34 except for the guide projection pieces 40, for example, at 107 mm. The inner diameter of the third supporting convexity 60 is set at a size a little larger than the outer diameter of the outer circumferential portion of the second container segment 34 except for the guide projection piece 40 and for example, the inner diameter may be 107 mm.

There is provided a first supporting concavity 67 which is adjacent to the other end portion side in the axial direction of the first supporting convexity 58 in one end portion in the axial direction of the inner circumferential portion 48 of the supporting member 32 and sinks outward in the radial direction and extends all over the circumference in the circumferential direction. There is provided a second supporting concavity 68 which is adjacent to one end portion side in the axial direction of the second supporting convexity 59 in the other end portion in the axial direction of the inner circumferential portion 48 of the supporting member 32 and sinks in the radial direction and extends all over the circumference in the circumferential direction. Further, there is provided a third supporting concavity 69 which is located between the second supporting convexity 59 of the other end portion in the axial direction of the inner circumferential portion 48 of the supporting member 32 and the third supporting convexity 60 and sinks in the radial direction and extends all over the circumference in the circumferential direction. The sizes in the axial direction of the first supporting concavity 67 and the second supporting concavity 68 may be, for example, 7 mm. The size of the third supporting concavity 69 in the axial direction is set a little larger than the size in the axial direction of the guide projection piece 40 of the second container segment 34 of the container main body 31, for example, at 3 mm.

Figure 14:
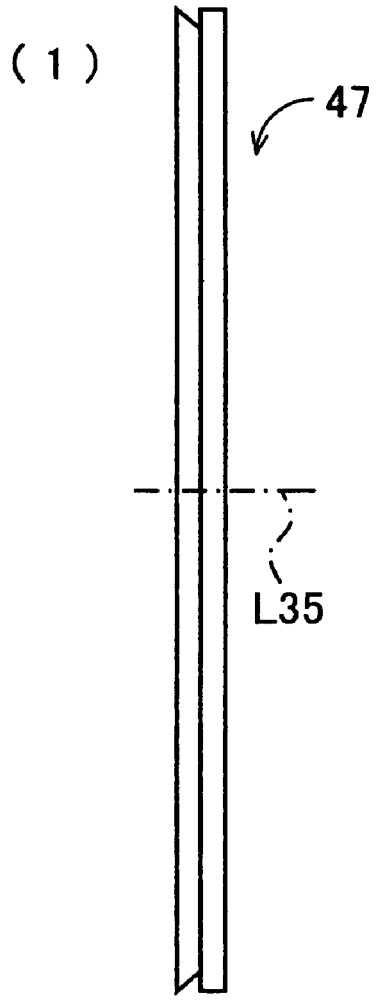
FIG. 14(1) is a front view showing a sealing material 47, and FIG. 14(2) is a view showing a section perpendicular to the circumferential direction of the sealing material 47.
Figure 14:
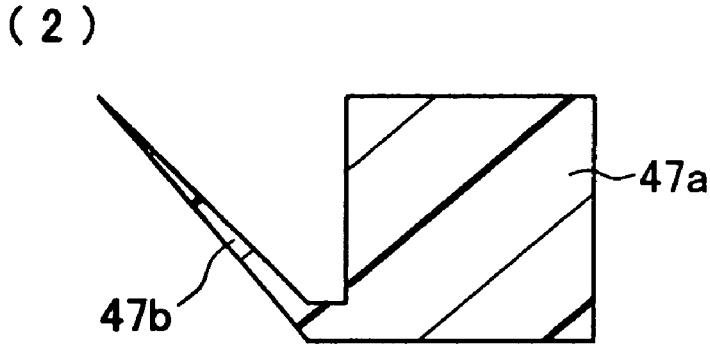

FIG. 14(1) is a front view showing a sealing material 47, and FIG. 14(2) is a sectional view showing a section perpendicular to the circumferential direction of the sealing material 47. The sealing material 47, which is sealing means, is made of synthetic resin such as silicon rubber having flexibility and elasticity. As shown in FIG. 14(1), the sealing material 47 is formed into a substantially annular shape. As shown in FIG. 14(2), the sealing material 47 includes a base portion 47*a* and a contact portion 47*b*. The base portion 47*a* of the sealing material 47 has a cross section which is perpendicular to the circumferential direction about the axis L35, formed into a rectangular shape. The contact portion 47*b* of the sealing material 47 is one end portion in the axial direction of the base portion 47*a*, and protrudes so as to be inclined outward in the radial direction from the inward portion in the radial direction as it is directed from the other end portion in the axial direction to one end portion in the axial direction.

The diameter of the inner circumferential portion of the base portion 47*a* of the sealing material 47 is set smaller than the outer diameter of the outer circumferential portion of the first container segment 33 of the container main body 31 and the outer diameter of the outer circumferential portion of the second container segment 34 except for the guide projection pieces 40, for example, at 99 mm. Further, the diameters of the outer circumferential portions of the base portion 47*a* and the contact portion 47*b* of the sealing material 47 are set to be the same as or larger than the diameter of a virtual circle passing through the outer circumferential portion of the discharge guide piece 44 of the third container segment 35 of the container main body 31 about the rotation axis L31, for example, at 115 mm. Moreover, the size in the axial direction of the sealing material 47 is set to be not more than the sizes in the axial direction of the first and second supporting concavities 67 and 68 of the supporting member 32, for example, at 6 mm.

Figure 15:
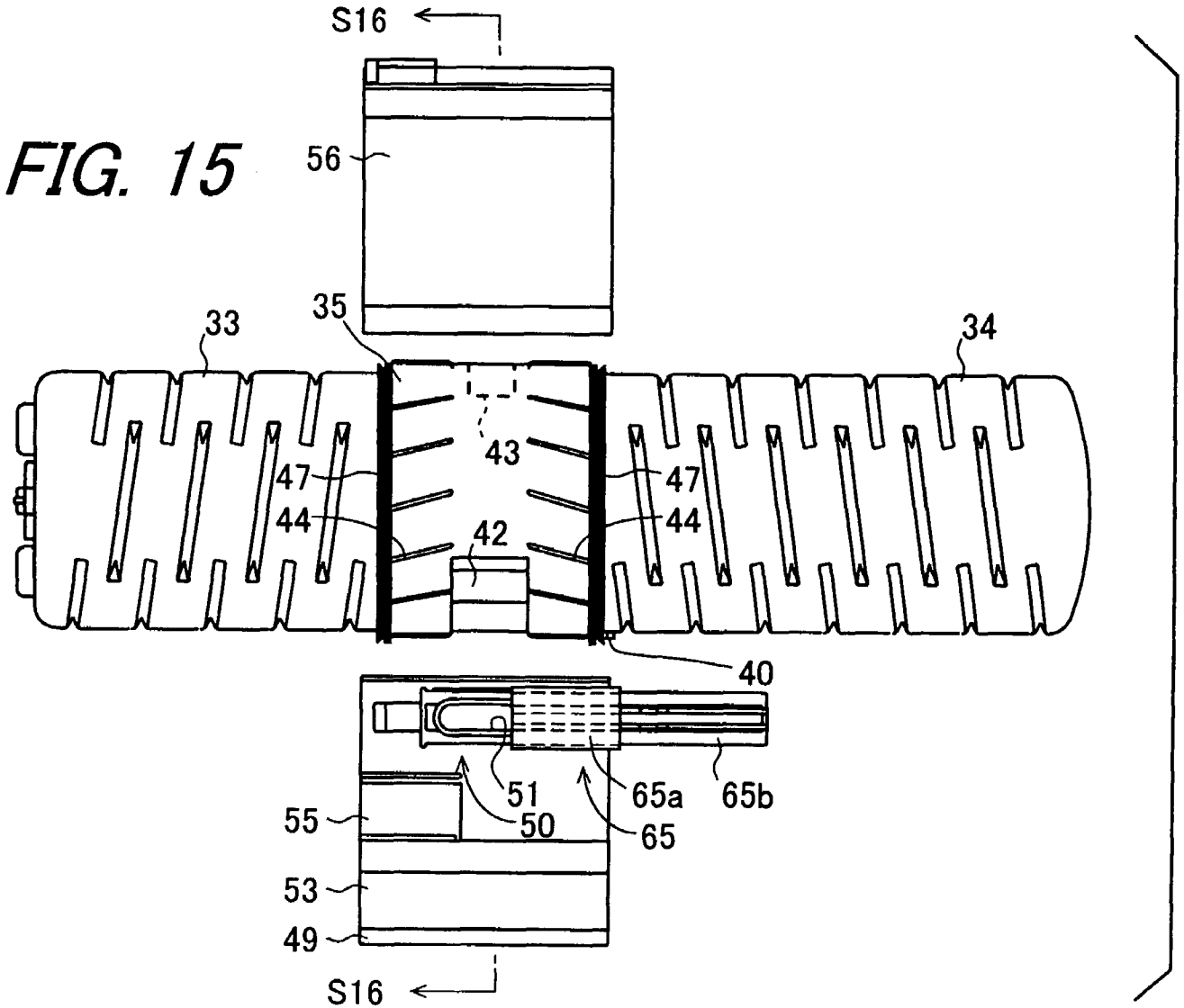
FIG. 15 is a front view showing a state in which the developer container 30 is assembled.
Figure 16:
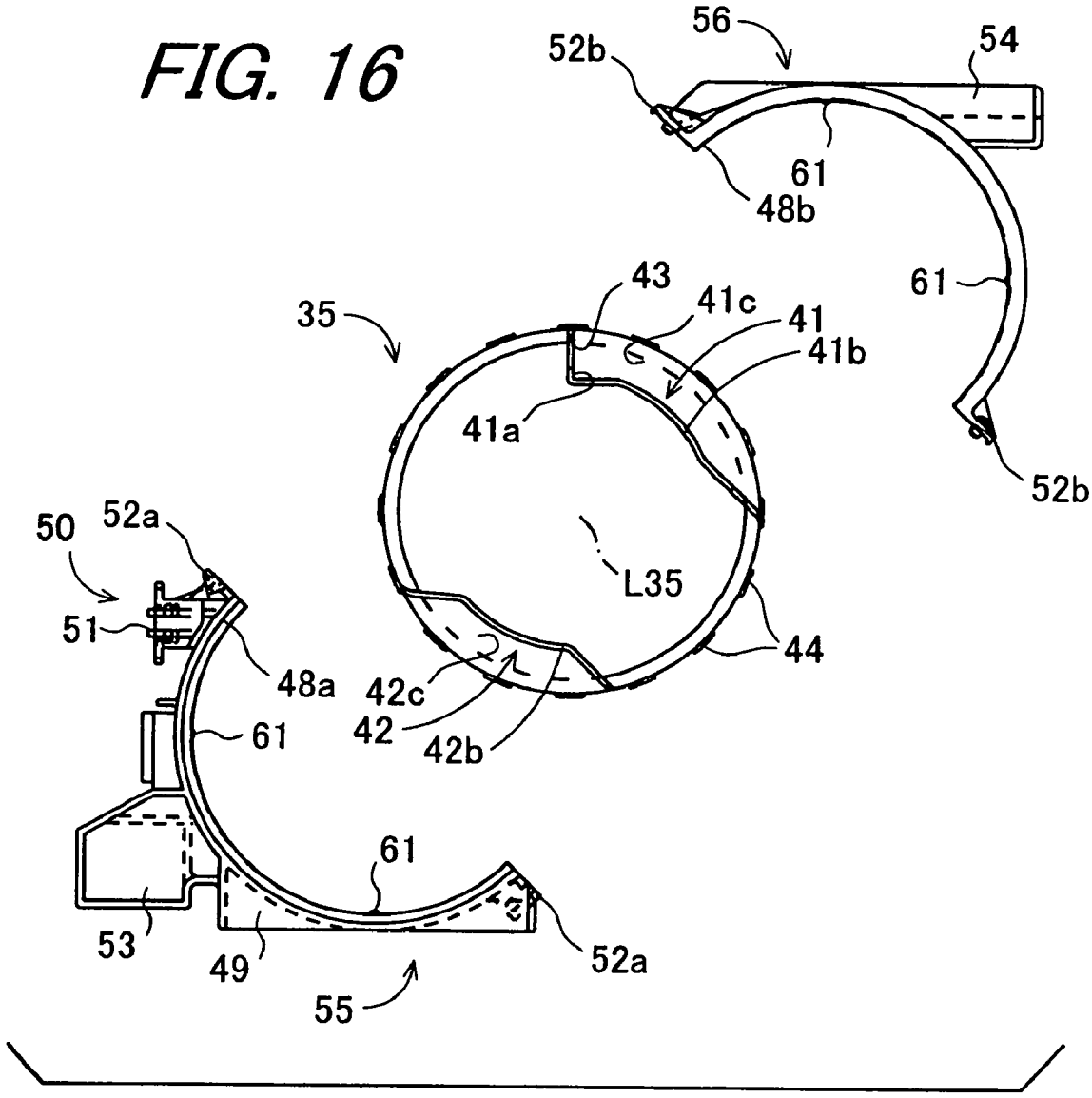
FIG. 16 is a sectional view taken on a cross-sectional line S16-S16 in FIG. 15.

FIG. 15 is a front view showing a state in which the developer container 30 is assembled. FIG. 16 is a sectional view taken on a cross-sectional line S16-S16 in FIG. 15. Before the developer container 30 is assembled, the supporting member 32 has been divided into the first supporting portion 55 and the second supporting portion 56. Further, at this time, one of the two sealing materials 47 is attached to the first container segment 33 of the container main body 31 in such a manner that the one of the two sealing materials 47 is wound so as to closely contact the opening end portion 33*b* of the first container segment 33, and the base portion 47*a* of the sealing material 47 closely contacts an end face of one end portion in the axial direction of the third container segment 35. Moreover, the other of the two sealing materials 47 is attached to the second container segment 34 of the container main body 31 in such a manner that the one of the two sealing materials 47 is wound so as to closely contact the opening end portion 34*b* of the second container segment 34 on the one end portion side in the axial direction with respect to the guide projection piece 40 and the base portion 47*a* of the sealing material 47 closely contacts an end face of the other end portion in the axial direction of the third container segment 35.

A portion of the container main body 31 including the third container segment 35 is held by the first supporting portion 55 and the second supporting portion 56 from the outside in the radial direction. In this condition, the first supporting portion 55 and the second supporting portion 56 are connected to each other by the screw member 57.

Figure 17:
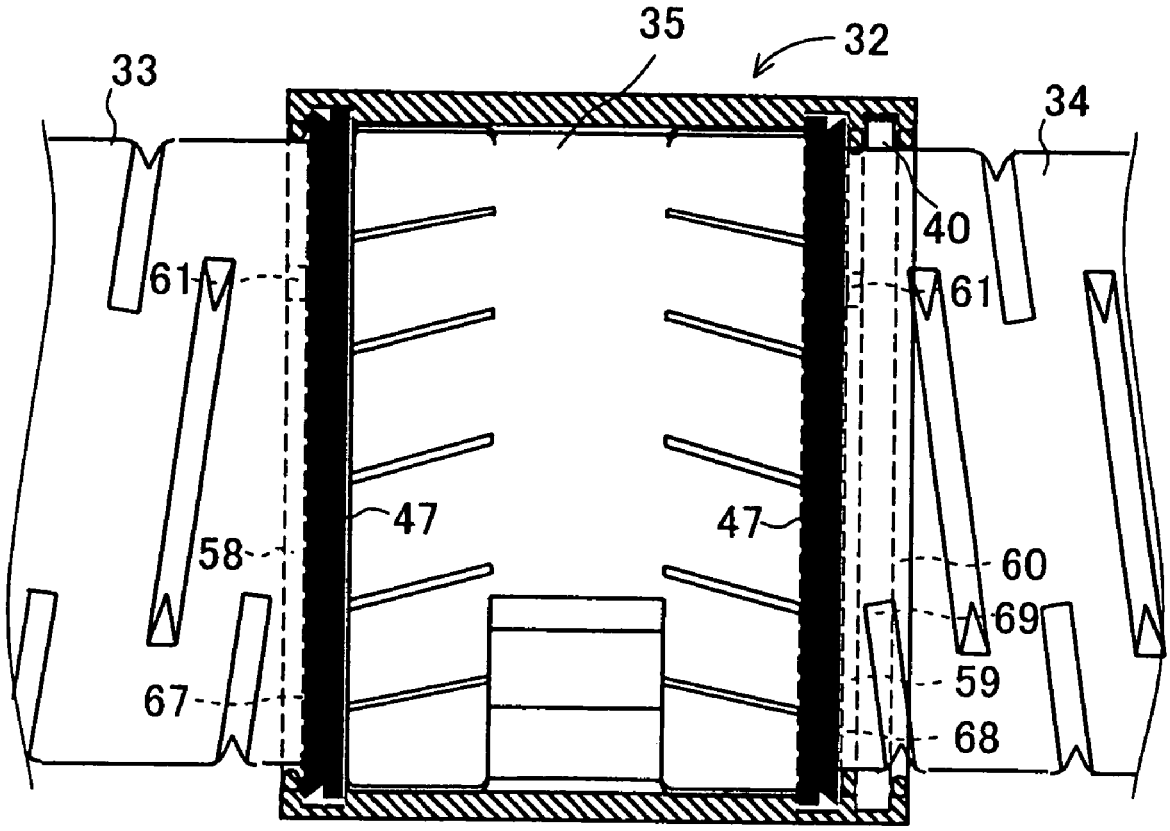
FIG. 17 is a sectional view taken on a cross-sectional line S17-S17 in FIG. 3.

FIG. 17 is a sectional view taken on a cross-sectional line S17-S17 in FIG. 3. Under the condition that the container main body 31 is supported by the supporting member 32, the axial line L31 of the container main body 31 and the axial line L32 of the inner circumferential portion 48 of the supporting member 32 are completely or substantially agree with each other, and the container main body 31 can be freely rotated about the axis L31 with respect to the supporting member 32. In the case where the supporting base 49 of the supporting member 32 is installed on a horizontal face in the above condition, the first and second container segments 33 and 34 of the container main body 31 are separate from the horizontal face, and the rotation axis L31 and the horizontal face become parallel with each other.

In the supporting member 32, to describe in detail, supporting projection pieces 61 of the first supporting convexity 58 come into contact with the outer circumferential portion of the first container segment 33, and supporting projection pieces 61 of the second supporting convexity 59 come into contact with the outer circumferential portion of the second container segment 34 except for the guide projection piece 40. The outer circumferential portion of the first container segment 33 is thus substantially supported at four points by the supporting projection pieces 61 of the first supporting convexity 58 at regular intervals in the circumferential direction and substantially supported at four points by the supporting projection pieces 61 of the second supporting convexity 59 at regular intervals in the circumferential direction. Accordingly, a frictional force resisting the rotation of the container main body 31 can be greatly reduced between the outer circumferential portion of the first container segment 33 and the first supporting convexity 58 and between the outer circumferential portion of the second container segment 34 and the second supporting convexity 59.

The sealing material 47 of the first container segment 33 is engaged in the first supporting concavity 67 of the supporting member 32, and the contacting portion 47*b* of the sealing material 47 elastically comes into contact with the other end face in the axial direction of the first supporting convexity 58 all over the circumference. The sealing material 47 of the second container segment 34 is engaged in the second supporting concavity 68 of the supporting member 32, and the contacting portion 47*b* of the sealing material 47 elastically comes into contact with one end face in the axial direction of the second supporting convexity 59 all over the circumference. By the two sealing materials 47 described above, sealing can be accomplished in the first and second concavities 41 and 42 and discharge hole 43 of the container main body 31 and all over the circumference in the circumferential direction between the container main body 31 and the supporting member 32 on one end side in the axial direction of the container main body 31 and on the other end side in the axial direction with respect to the leading through hole 51 of the supporting member 32.

The guide projection piece 40 of the second container segment 34 of the container main body 31 is engaged in the third supporting concavity 69 of the supporting member 32 with regulation on a sliding displacement in the axial direction with respect to the supporting member 32. Accordingly, the container main body 31 is regulated so as not to make the sliding displacement in the axial direction with respect to the supporting member 32. The outer circumferential portions of each of the discharge guide pieces 44 of the third container segment 35 of the container main body 31 come into contact with the inner circumferential portion 48 of the supporting member 32. In this way, the supporting member 32 pivotally supports a portion of the container main body 31 including at least the first concavity 41 from the outside in the radial direction all over the circumference so as to be freely rotated about the rotation axis L31.

Figure 18:
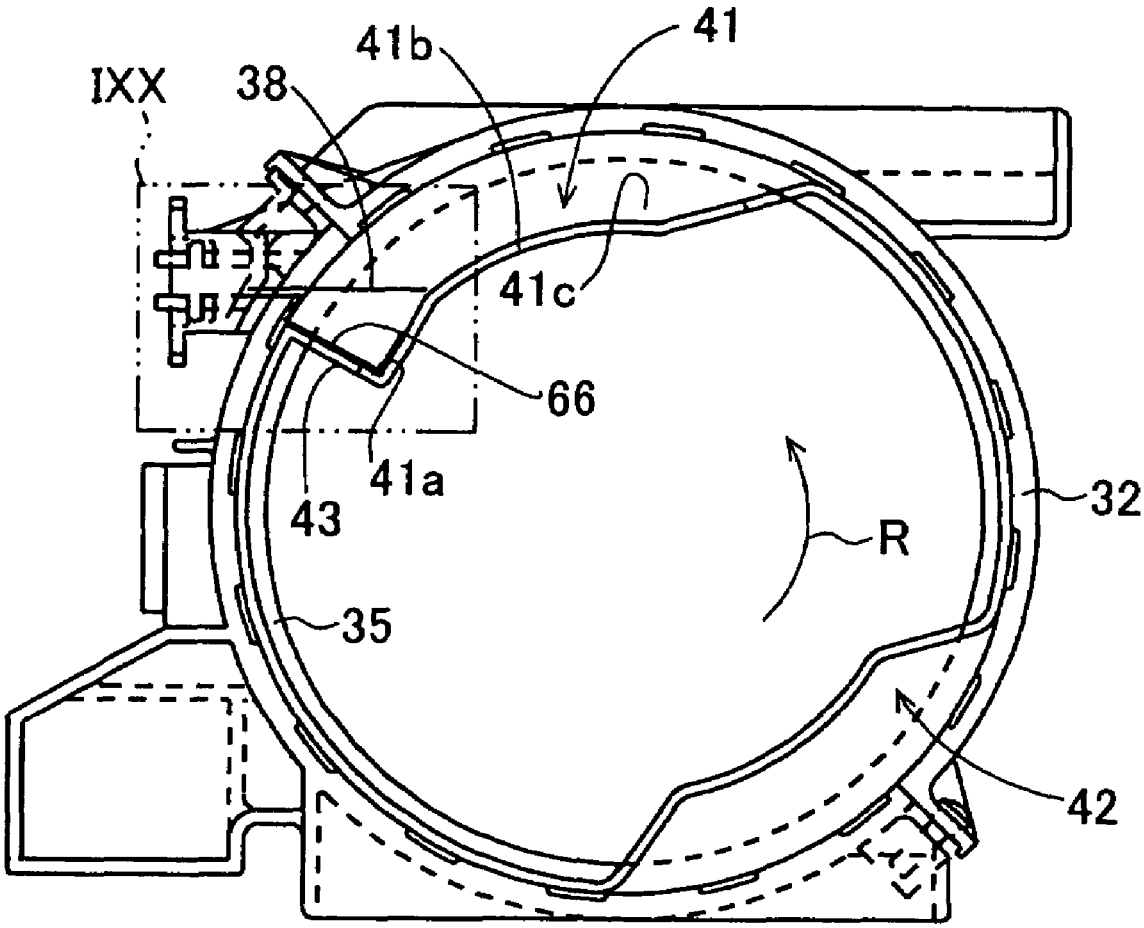
FIG. 18 is a sectional view taken on a cross-sectional line S18-S18 in FIG. 2.
Figure 19:
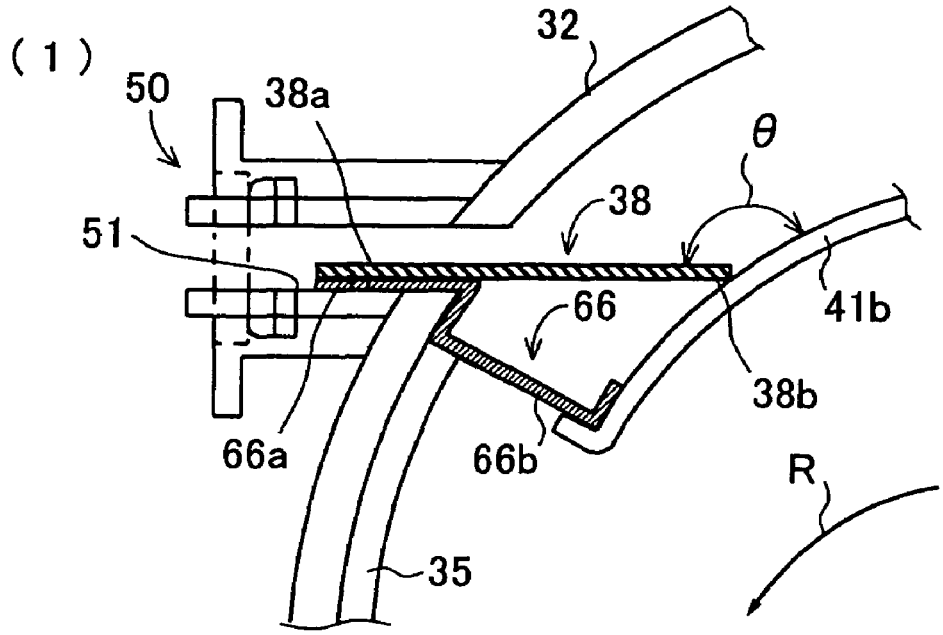
FIG. 19 is an enlarged view showing a section IXX in FIG. 18.
Figure 19:
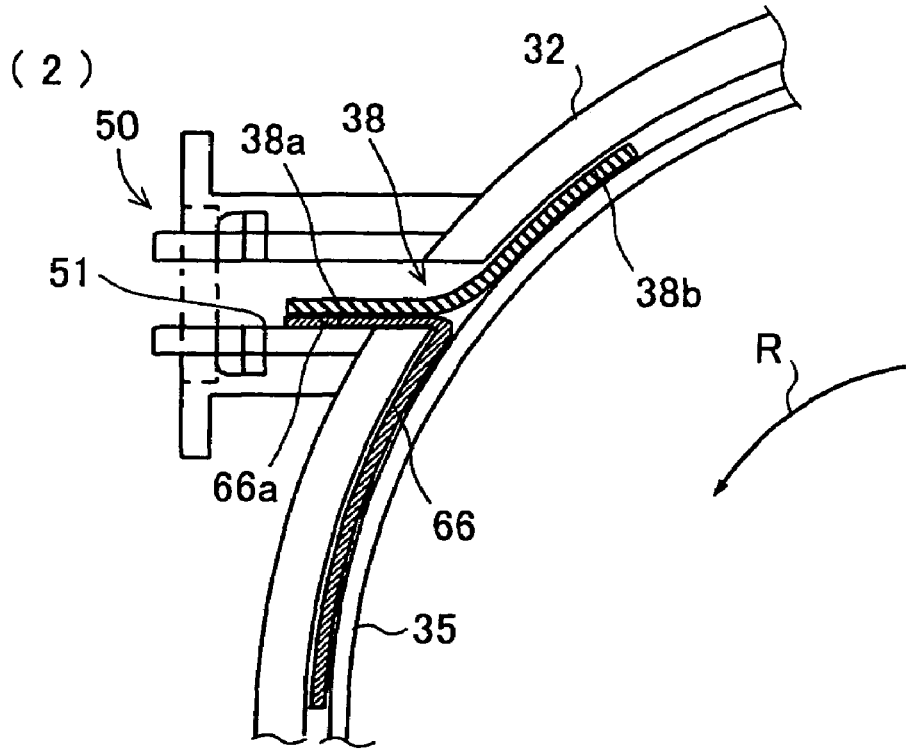

FIG. 18 is a sectional view taken on a cross-sectional line S18-S18 in FIG. 2. FIG. 19 is an enlarged view showing a section IXX in FIG. 18. FIG. 18 and FIG. 19(1) are views showing the container main body 31 which is in the initial stage with respect to the supporting member 32. The leading-out member 38 is arranged in such a manner that the proximal end portion 38*a* is set in a portion facing the upstream side end portion in the one first horizontal direction F1 of the leading through hole 51 of the supporting member 32, and extends onto the upstream side in the rotation direction R. In this case, the free end portion 38*b* can be elastically contacted with at least the bottom wall portion 41*b* of the first concavity 41 of the third container segment 35 of the container main body 31 and the outer circumferential face of the bottom wall portion 42*b* of the second concavity 42. Further, the free end portion 38*b* of the leading portion 38 comes into contact with the outer circumferential faces of at least the bottom wall portion 41*b* of the first concavity 41 of the third container segment 35 of the container main body 31 and the bottom wall portion 42*b* of the second concavity 42 with an angle θ exceeding 90°. To be in detail, the angle θ is defined as an angle formed between the upper face of the free end portion 38*b* of the leading-out member 38 and the outer circumferential faces of the bottom wall portions 41*b* and 42*b* of the concavities 41 and 42.

The sealing sheet 66 is provided in a portion of the proximal end portion 66*a* facing the upstream side end portion in the one first horizontal direction F1 of the leading through hole 51 of the supporting member 32. A portion 66*b* of the sealing sheet 66 except for the proximal end portion 66*a* is detachably provided by means of, for example, thermal welding so that at least the end wall portion 41*a* of the first concavity 41 is covered when the container main body 31 is in the initial stage with respect to the supporting member 32. In the initial stage, the discharge hole 43 is thus closed by the portion 66*b* except for the proximal end portion 66*a* of the sealing sheet 66. Accordingly, even when a user mistakenly arranges the shutter 65 of the shutter portion 65 at the opening position P2 in the initial stage, the developer contained in the container main body 31 can be prevented from undesirably discharged from the leading through hole 51.

When the container main body 31 in the initial stage is rotated about the rotation axis L31 in the rotation direction R, the portion 66*b* except for the proximal end portion 66*a* of the sealing sheet 66 is separated from the end wall portion 41*a* of the first concavity 41, and the discharge hole 43 can be opened. Further, the portion 66*b* of the sealing sheet 66 except for the proximal end portion 66*a*, which has been separated from the end wall portion 41*a* of the first concavity 41, is arranged between the third container segment 35 of the container main body 31 and the inner circumferential portion 48 of the supporting member 32 on the downstream side in the rotation direction R with respect to the leading through hole 51 of the supporting member 32 as shown in FIG. 19(2). Accordingly, the discharge hole 43 can be easily opened by rotating the container main body 31 even when the user does not directly remove the sealing sheet 66.

In a state where the supporting base 49 of the supporting member 32 is installed on a horizontal plane and the developer is contained in the container, two layers, which include the developer layer containing the developer and the gas layer containing gas located above the developer layer, are formed in the inner space of the container main body 31. The container main body 31 is rotated counterclockwise about the rotation axis L31 when the second container segment 34 is viewed from the first container segment 33. At this time, the developer on the developer layer in the first container segment 33 is conveyed in the first conveying direction C1 (shown in FIG. 2), which is directed from the first container segment 33 to the third container segment 35, along the rotation axis L31 by each first projection piece 36. Further, at this time, the developer on the developer layer in the second container segment 34 is conveyed in the second conveying direction C2 (shown in FIG. 2), which is directed from the second container segment 34 to the third container segment 35, along the rotation axis L31 by each second projection piece 39. When the container main body 31 is thus rotated about the rotation axis L31, the contained developer can be conveyed toward the discharge hole 43. Further, in the third container segment 35, the developer conveyed in the first conveying direction C1 and the developer conveyed in the second conveying direction C2 collide with each other. Accordingly, the developer can be agitated.

When the developer is being conveyed, the developer is given a force which is directed from the inner circumferential portions of the first and second container segments 33 and 34 including the first and second projection pieces 36 and 39 to the third container segment 35. In the case where a large quantity of developer is contained in the container main body 31, the developer arranged in a range from the inner circumferential portions of the first and second container segments 33 and 34 to the protruding height A2 of the first and second projection pieces 36 and 39 inward in the radial direction is mainly agitated when the container main body 21 is rotated. Therefore, the developer is well balanced in the container main body 21.

Figure 20:
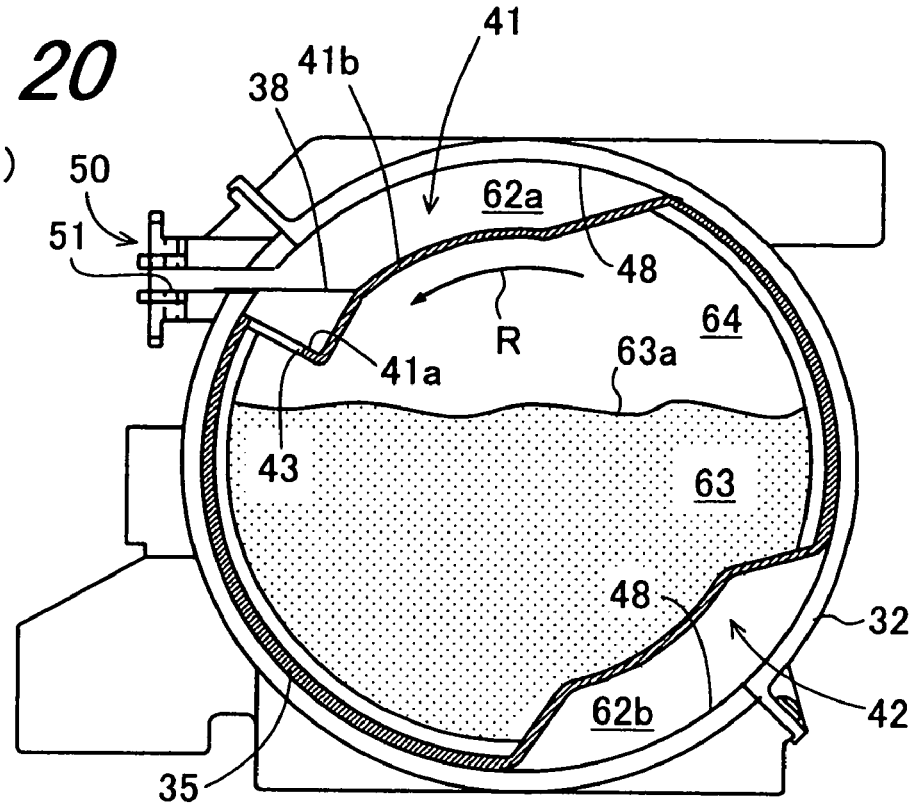
FIG. 20 is a view for explaining the operation in which the developer in the third container segment 35 of the container main body 31 is guided to a leading through hole 51 of the supporting member 32 when the container main body 31 is rotated in a rotation direction R about a rotation axis L31.
Figure 20:
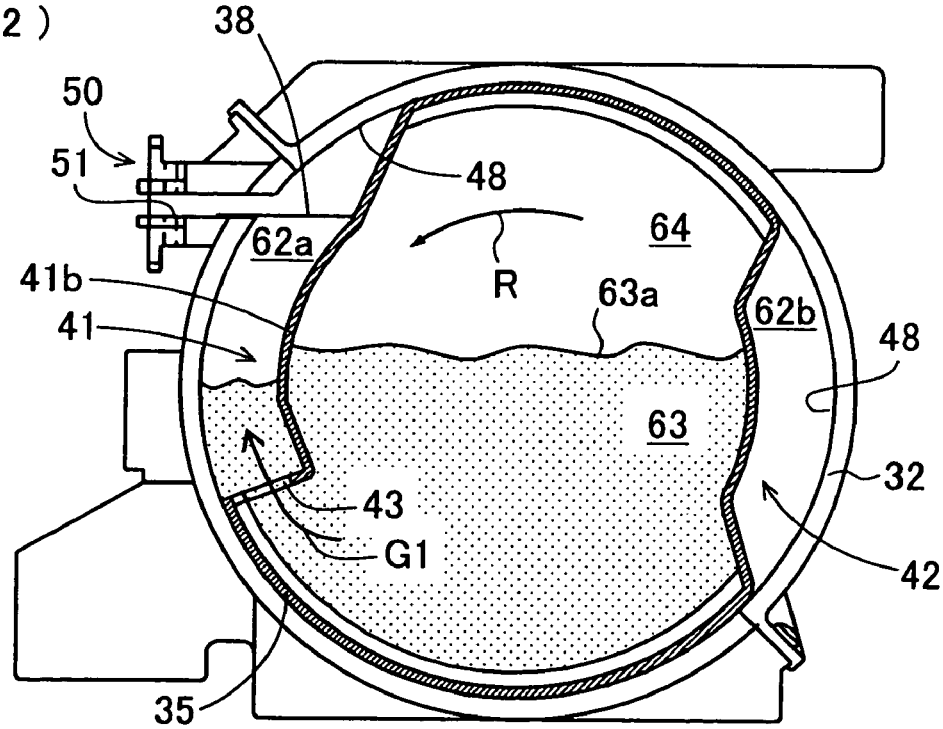
Figure 21:
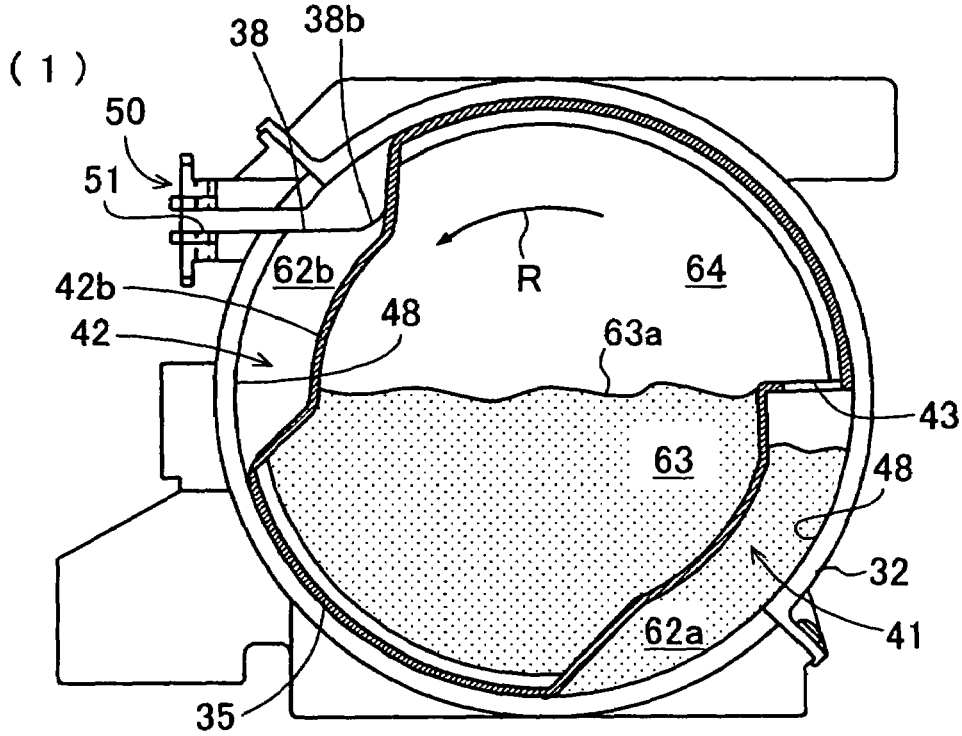
FIG. 21 is a view for explaining the operation in which the developer in the third container segment 35 of the container main body 31 is guided to the leading through hole 51 of the supporting member 32 when the container main body 31 is rotated in the rotation direction R about the rotation axis L31.
Figure 21:
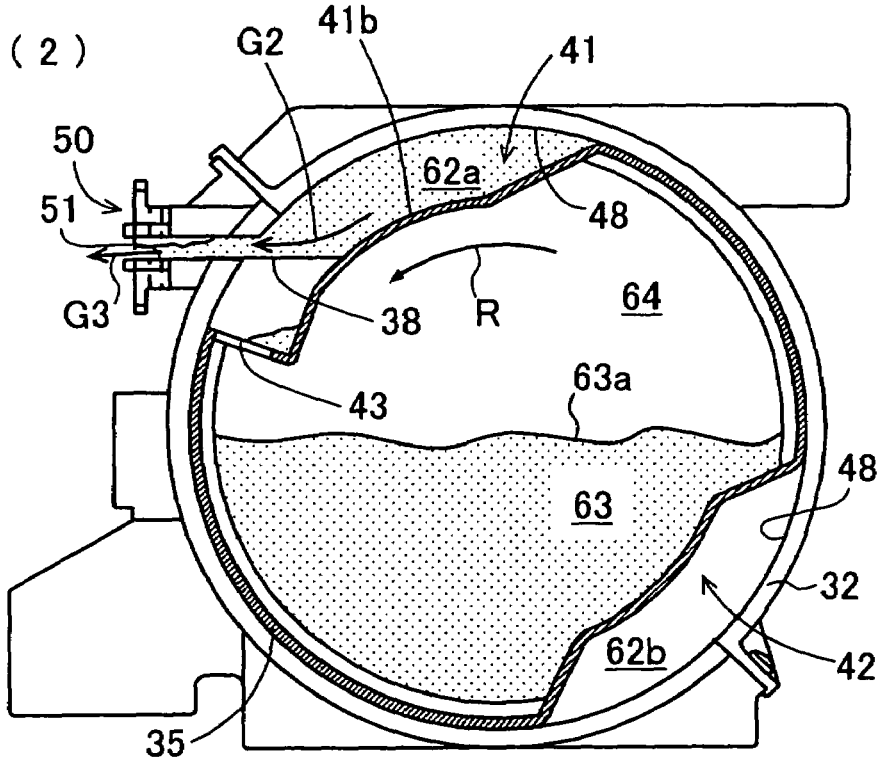

FIG. 20 and FIG. 21 are views for explaining the operation in which the developer in the third container segment 35 of the container main body 31 is guided to the leading through hole 51 of the supporting member 32 when the container main body 31 is rotated in the rotation direction R about the rotation axis L31. References are also made to FIGS. 7, 9 and 17. Under the condition that the container main body 31 is supported by the supporting member 32 so as to be freely rotated about the rotation axis L31, the first retaining space 62*a* is formed which faces the first concavity 41 of the third container segment 35 and the inner circumferential portion 48 of the supporting member 32. The first retaining space 62*a* is substantially a closed space except for the discharge hole 43 and arranged on the upstream side in the rotation direction R of the discharge hole 43, and communicated with a space in the container main body 31 via the discharge hole 43. Further, the second retaining space 62*b* is formed which faces the second concavity 41 of the third container segment 35 and the inner circumferential portion 48 of the supporting member 32. The second retaining space 62*b* is substantially a closed space.

In the state shown in FIG. 20(1) in which the discharge hole 43 and the first retaining space 62*a* are arranged above the upper face 63*a* of the developer layer 63 in the container main body 31, the container main body 31 is rotated in the rotation direction R, and the discharge hole 43 and the downstream portion in the rotation direction R of the first retaining space 62*a* comes below the upper face 63*a* of the developer layer 63 in the container main body 31 as shown in FIG. 20(2). Then, the developer on the developing layer 63 in the container 31 flows into the downstream portion in the rotation direction R of the first retaining space 62*a* via the discharge hole 43 as shown by an arrow G1.

As described before, the discharge hole 43 is formed into an opening having a rectangular shape, the longitudinal direction of which is the axial direction, in the middle portion in the axial direction of the end wall portion 41*a* of the first concavity 41 outward in the radial direction. Accordingly, in the end wall portion 41*a* of the first concavity 41, the discharge hole 43 is open outward in the radial direction with respect to the downstream end portion in the rotation direction R of the bottom wall portion 41*b* of the first concavity 41 and closer to the other end portion in the axial direction with respect to the downstream side end portion in the rotation direction R of the first side wall portion 41*c* and closer to one end side in the axial direction with respect to the downstream side end portion in the rotation direction R of the second side wall portion 41*d*.

For example, in the case where the discharge hole 43 is open in the entire end wall portion 41*a*, the developer is discharged from the discharge hole 43 into the first retaining space 62*a* in such a manner that the developer is densely pushed out along the first concavity 41 of the container main body 31 and the inner circumferential portion 48 of the supporting member 32 when the container main body 31 is rotated in the rotation direction R. When the container main body 31 is further rotated in the rotation direction R in the above condition, there is a possibility that the developer held in the first retaining space 62*a* is coagulated by being pushed by the first concavity 41 of the container main body 31 and the inner circumferential portion 48 of the supporting member 32. In the embodiment, as described before, the discharge hole 43 is formed in a portion of the side wall portion 41*a* of the first concavity 41. In other words, an opening area of the discharge hole 43 is formed to be smaller than the area of the end wall portion 41*a* and therefore, the developer is discharged into the first retaining space 62*a* so as to be diffused in the neighborhood of the discharge hole 43 in the first retaining space 62*a*. Accordingly, the developer discharged into the first retaining space 62*a* can be made into powder, and the occurrence of coagulation of the developer, which is caused by the rotation of the container main body 31 as described before, can be prevented as much as possible.

Further, a face on the outside in the radial direction of the discharge hole 43 is smoothly communicated with the inner circumferential face of the third container segment 35 at the downstream side of the rotation direction R of the first concavity 41 except for the first concavity 41 and the second concavity 42. Accordingly, even when a quantity of the developer contained in the container main body 31 is very small, the developer can easily flow into the downstream portion in the rotation direction R of the first retaining space 62*a* via the discharge hole 43.

When the container main body 31 is further rotated in the rotation direction R in the state shown in FIG. 20(2), the developer on the developer layer 63 in the container main body 31 flows into the downstream portion in the rotation direction R of the first retaining space 62*a* via the discharge hole 43, and the discharge hole 43 shown in FIG. 21(1) is arranged above the upper face 63*a* of the developer layer 63 in the container main body 31, and the first retaining space 62*a* is arranged below the upper face 63*a* of the developer layer 63 in the container main body 31. In the state shown in FIG. 21(1), a predetermined quantity of the developer is held in the first retaining space 62*a*. In this way, the quantity of the developer held in the first retaining space 62*a* may be, for example, 6 g.

When the container main body 31 is further rotated in the rotation direction R in the state shown in FIG. 21(1), there comes the state where the free end portion 38*b* of the leading-out member 38 of the supporting member 32 proceeds into the first retaining space 62*a* and extends onto the upstream side of the rotation direction R as shown in FIG. 21(2), and while being elastically coming into contact with the outer circumferential face of the bottom wall portion 41*b* of the first concavity 41 by an angle θ exceeding 90°, the free end portion 38*b* of the leading-out member 38 slides on the outer circumferential face concerned. At this time, the developer held in the first retaining space 62*a* on the upstream side in the rotation direction R with respect to the leading-out member 38 flows toward the supporting member 32 when the container main body 31 is rotated in the rotation direction R.

The leading-out member 38 guides the developer, which has been flowing in this way, in other words, the developer, which has been discharged from the discharge hole 43 of the container main body 31, to the leading through hole 51 along the upper face of the leading-out member 38 as shown by an arrow G2. Since the leading-out member 38 slides on the outer circumferential face concerned while scraping off the developer from the outer circumferential face of the bottom wall portion 41*b* of the first concavity 41, all the developer held in the first retaining space 62*a* can be guided into the leading through hole 51. The developer guided into the leading through hole 51 in this way is sent outside the developer container 30 and discharged. Each time the container main body 31 is rotated in the rotation direction R about the rotation axis L31 by one revolution as described above, the predetermined quantity of the developer described before can be discharged outside.

The portion of the third container segment 35 except for the first and second concavities 41 and 42 is not entirely contacted with the inner circumferential portion 48 of the supporting member 32 all over the circumference in the circumferential direction as described above so that a frictional force to block the rotation of the container main body 31 about the rotation axis L31 can be reduced. Accordingly, there is a possibility that the developer held in the first retaining space 62*a* leaks out from the first retaining space 62*a* as described above. As described above, the discharge guide pieces 44 are provided in the outer circumferential portions of one end portion and the other end portion in the axial direction except for the first concavity 41 and second concavity 42 of the third container segment 35. The discharge guide piece 44 provided in one end portion in the axial direction of the third container segment 35 is inclined in the rotation direction R as it comes to one end portion in the axial direction from the other end portion in the axial direction. The discharge guide piece 44 provided in the other end portion in the axial direction of the third container segment 35 is inclined in the rotation direction R as it comes to the other end portion in the axial direction from one end portion in the axial direction. Accordingly, even when the developer held in the first retaining space 62*a* leaks out to one side and the other side in the direction of the rotation axis L32, the developer can be collected to a middle portion in the axial direction of the third container segment 35 and the supporting member 32 by each of the discharge guide pieces 44 when the container main body 31 is rotated in the rotation direction R.

Further, since the second retaining space 62*b* is formed as described before, even when the developer held in the first retaining space 62*a* leaks out from the upstream portion in the rotation direction R of the first retaining space 62*a*, the developer, which has leaked out in this way, and the developer, which has been collected to the middle portion in the axial direction by the discharge guide piece 44, are held by the second retaining space 62*b*. When the container main body 31 is rotated in the rotation direction R, there comes the sate where the free end portion 38*b* of the leading-out member 38 of the supporting member 32 proceeds into the second retaining space 62*b* and extends onto the upstream side of the rotation direction R as shown in FIG. 21(1), and while being elastically coming into contact with the outer circumferential face of the bottom wall portion 42*b* of the second concavity 42 by an angle θ exceeding 90°, the free end portion 38*b* of the leading-out member 38 slides on the outer circumferential face concerned. At this time, the developer held in the second retaining space 62*b* on the upstream side in the rotation direction R with respect to the leading-out member 38 flows toward the supporting member 32 when the container main body 31 is rotated in the rotation direction R, and the developer is guided into the leading through hole 51 and then, guided and discharged outside the developer container 30. In this way, even when the developer leaks out from the first retaining space 62*a* each time the container main body 31 is rotated about the rotation axis L31 in the rotation direction R by one revolution, the leaked-out developer is held by the second retaining space 62*b* and therefore, the predetermined quantity of the developer described before can be positively discharged outside as much as possible.

Moreover, under the condition that the supporting base 49 is horizontally set, the discharge section 50, which protrudes in the one first horizontal direction F1 which is one direction in one horizontal direction, is formed in an upper portion of the supporting member 32. In the middle portion in the axial direction of the supporting member 32 in the discharge section 50 is provided the leading through hole 51 which penetrates in the one first horizontal direction F1 and opens in an elliptical shape extending in a direction parallel with the axis L32 of the supporting member. Accordingly, even when the container main body 31 is fully filled with the developer, the upper face 63*a* of the developer layer 63 is arranged at the same height as that of the leading through hole 51 or alternatively, at a lower position of the leading through hole 51 and therefore, it is possible to positively prevent the developer from undesirably leaking out from the container main body 31 into the leading through hole 51.

Figure 22:
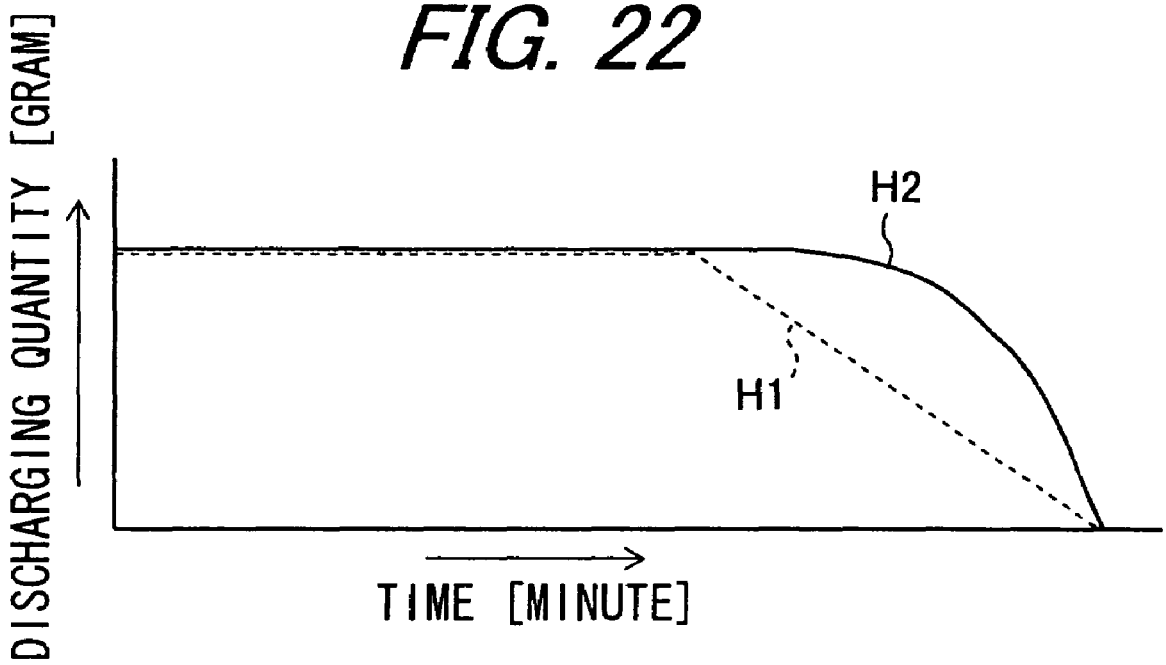
FIG. 22 is a graph showing a relation between the quantity of the developer discharged from the developer container 30 and the time.

FIG. 22 is a graph showing a relation between the quantity of the developer discharged from the developer container 30 and the time. In FIG. 22, the curve H1 shows a relation between the quantity of the developer discharged from the developer container 30 and the time in the case where the inner diameter D35 of the third container segment 35 of the container main body 31 is formed so as to be not more than the inner diameters D33 and D34 of the first and second container segments 33 and 34. The curve H2 shows a relation between the quantity of the developer discharged from the developer container 30 and the time in the case where the inner diameter D35 of the third container segment 35 of the container main body 31 is larger than the inner diameters D33 and D34 of the first and second container segments 33 and 34. The powder-like developer has a property that, for example, even when the developer is extremely irregularly put on a horizontal plane, the surface of the developer immediately becomes flat. For example, in the case where the inner diameter D35 of the third container segment 35 of the container main body 31 is formed to be not more than the inner diameters D33 and D34 of the first and second container segments 33 and 34, the developer conveyed to the discharge port 43 by the rotation of the container main body 31 is separated from the discharge hole 43 when the container main body 31 stops rotating. In this case, when a quantity of the developer contained in the container main body 31 has become very small, it is difficult to convey a sufficiently large quantity of the developer toward the discharge hole 43 immediately after the container main body 31 has started rotating again.

As shown in FIG. 8 explained before, in the embodiment, the inner diameter of the third container segment 35 of the container main body 31 is formed so as to be larger than the inner diameters D33 and D34 of the first and second container segments 33 and 34 which are residual portions and therefore, in the case where a quantity of the developer contained in the container main body 31 becomes very small, it is possible to prevent as much as possible the developer, which has once conveyed into the third container segment 35, from being separated from the third container segment 35. Accordingly, even when a quantity of the developer contained in the container main body 31 has become very small, it is possible to convey a sufficiently large quantity of the developer toward the discharge hole 43 immediately after the container main body 31 has started rotating again. Further, all the developer contained in the container main body 31 can be discharged outside as much as possible.

As shown by the curve H1, in the case where the inner diameter D35 of the third container segment 35 of the container main body 31 is formed so as to be not more than the inner diameters D33 and D34 of the first and second container segments 33 and 34, when a quantity of the developer contained in the container main body 31 is decreased, a quantity of the developer to be discharged is reduced corresponding to the reduction of the quantity of the developer contained in the container main body 31. On the other hand, as shown by the curve H2, in the case where the inner diameter D35 of the third container segment 35 of the container main body 31 is larger than the inner diameters D33 and D34 of the first and second container segment 33 and 34, even when a quantity of the developer contained in the container main body 31 is decreased as compared with the curve H1, a discharging quantity of the developer can be maintained substantially constant until the quantity of the developer has become close to zero. Accordingly, the developer container 30 of the embodiment enables the stable discharge of the developer over a long period of time.

As described above, according to the developer container 30 of the embodiment, when the container main body 31 is rotated about the axis L31, the developer contained in the container main body 31 can be conveyed in the axial direction by the conveying means provided in the inner circumferential portion of the container main body 31. In the case where the conveying means is formed into, for example, projection pieces extending inward in the radial direction, or a groove sinking outward in the radial direction, just like the first and the second conventional art in which the conveying means extends in the spiral direction about the axis, the developer located close to the conveying means is given a pushing force in the axial direction from the conveying means and therefore, there is a danger that the developer is coagulated in the neighborhood of the projection pieces and the developer is supplied to an image forming apparatus in such a coagulated state. Further, in this case, when the container main body is given a twisting force from the outside about the axis, a bending force from the outside and an impact, there is a danger that the container main body is damaged in the conveying means by the occurrence of cracks which extend substantially along the spiral direction of the container main body. Further, in the case of the third conventional art in which a plurality of conveying portions are formed at regular intervals in the circumferential direction and the axial direction, when portions between the conveying portions, which are adjacent to each other in the circumferential direction, are arranged on the same straight line or the same spiral orbit like the conventional art, when the container main body is given a pushing force inward in the radial direction, the portions, which are arranged on the same straight line or the same spiral orbit, are compressed in the circumferential direction and easily deformed.

In the developer container 30 of the embodiment, the conveying means includes a plurality of the first projection pieces 36 extending in the first extending direction and the second projection pieces 39 extending in the second extending direction, and the respective projection pieces 36 and 39 are formed at intervals in the circumferential direction and the axial direction, and two projection pieces 36 and 39, which are adjacent to each other in the axial direction, are arranged in such a manner that the end portion on the downstream side in the rotation direction of one projection piece 36, 39 and the end portion on the upstream side in the rotation direction of the other projection piece 36, 39 adjoin each other in the axial direction. Therefore, the portions between the projection pieces 36 and 39, which are adjacent to each other in the circumferential direction, are not arranged on the same straight line or the same spiral orbit. Accordingly, even when the container main body 31 is given a twisting force from the outside about the axis, a bending force from the outside and an impact and even when the container main body 31 is given a pushing force inward in the radial direction, the occurrence of damage and deformation can be prevented as much as possible. Further, the respective projection pieces 36 and 39 are arranged at intervals in the circumferential direction and therefore, the developer conveyed in the axial direction by the projection pieces 36 and 39 intermittently comes into contact with the respective projection pieces 36 and 39. Accordingly, the developer can be prevented from being coagulated at the projection pieces 36 and 39, and the developer can be conveyed in the axial direction as being oscillated. Accordingly, the developer can be positively agitated in the rotating container main body 31 and made to come loose by the oscillation, and the developer can be positively prevented from being coagulated.

Further, according to the developer container 30 of the embodiment, the container main body 31 can be rotated about the rotation axis L31 while being stably supported by the supporting member 32. When a cylindrical container of the conventional art, in which the developer is contained, is left in the condition that an axis thereof is set so as to be perpendicular to a horizontal plane, there is a danger that the developer contained in a lower portion of the container coagulates. Moreover, in order to prevent such a coagulation of the developer, when the container is set on a horizontal plane so that an axis thereof can be parallel with the horizontal plane, the container rolls over. In the case of the developer container 30 of the embodiment, when the supporting base 49 of the supporting member 32 is arranged in a horizontal plane, the axis L31 of the container main body 31 can be stably arranged in parallel with the horizontal plane. Further, by any possibility, even when the developer contained in the developer container 30 is partially coagulated, the developer can be easily agitated and made into powder-like, for example, when a user set the shutter 65*a* of the shutter portion 65 at the closing position P1 and rotates the container main body 31.

Further, the faces 33*c*, 34*c*, on which the outer circumferential faces and the end faces in both end portions 33*a* and 34*a* in the axial direction of the container main body 31 are communicated with each other, are formed into a curved face which inclines inward in the radial direction as described before and therefore, even when either of both end portions 33*a* and 34*a* in the axial direction of the container main body 31 is set on the horizontal face so that the axis L31 can be perpendicular to the horizontal plane, and the developer container 30 is arranged on the horizontal plane, the developer container 30 will easily fall down. This makes it possible to prevent the user from setting the developer container 30 in such a manner that the axis L31 is perpendicular to the horizontal face, and leaving it, so that the cause of coagulation of the contained developer can be reduced.

Further, according to the developer container 30 of the embodiment, the supporting member 32 supports a portion of the container main body 31 including at least the third container segment 35 from the outside in the radial direction all over the circumference. Further, two sealing materials 47 are provided between the container main body 31 and the supporting member 32, and sealing can be accomplished as described above and therefore, even when the container main body 31 is rotated, the developer can be prevented from leaking out from between the container main body 31 and the supporting member 32.

Further, according to the developer container 30 of the embodiment, a discharging quantity of the developer depends on the volume of the first retaining space 62*a* and the rotation speed of the container main body 31. In the developer container 30 of the embodiment, concerning the concavity, the configuration is made in such a manner that two concavities of the first and second concavities 41 and 42 are provided, and the discharge hole 43 is provided only in the first concavity 41, however, the invention is not limited to the configuration. For example, in the case where it is wanted that a discharging quantity of the developer per one revolution of the container main body 31 is increased, the second concavity 42 may be formed into the same shape as that of the first concavity 41, and the discharge hole 43 may be provided. In addition, the number of the concavities and the number of the discharge holes may be further increased.

In the embodiment, the conveying means includes a first projection piece 36 extending in the first extending direction about the axis L31 and protruding inward in the radial direction, and a second projection piece 39 extending in the second extending direction about the axis L31 and protruding inward in the radial direction. However, the invention is not limited to the above embodiment. For example, the conveying means may be grooves which sink outward in the radial direction and extend in the first extending direction and the second extending direction and are provided at intervals in the circumferential direction and the axial direction.

Figure 23:
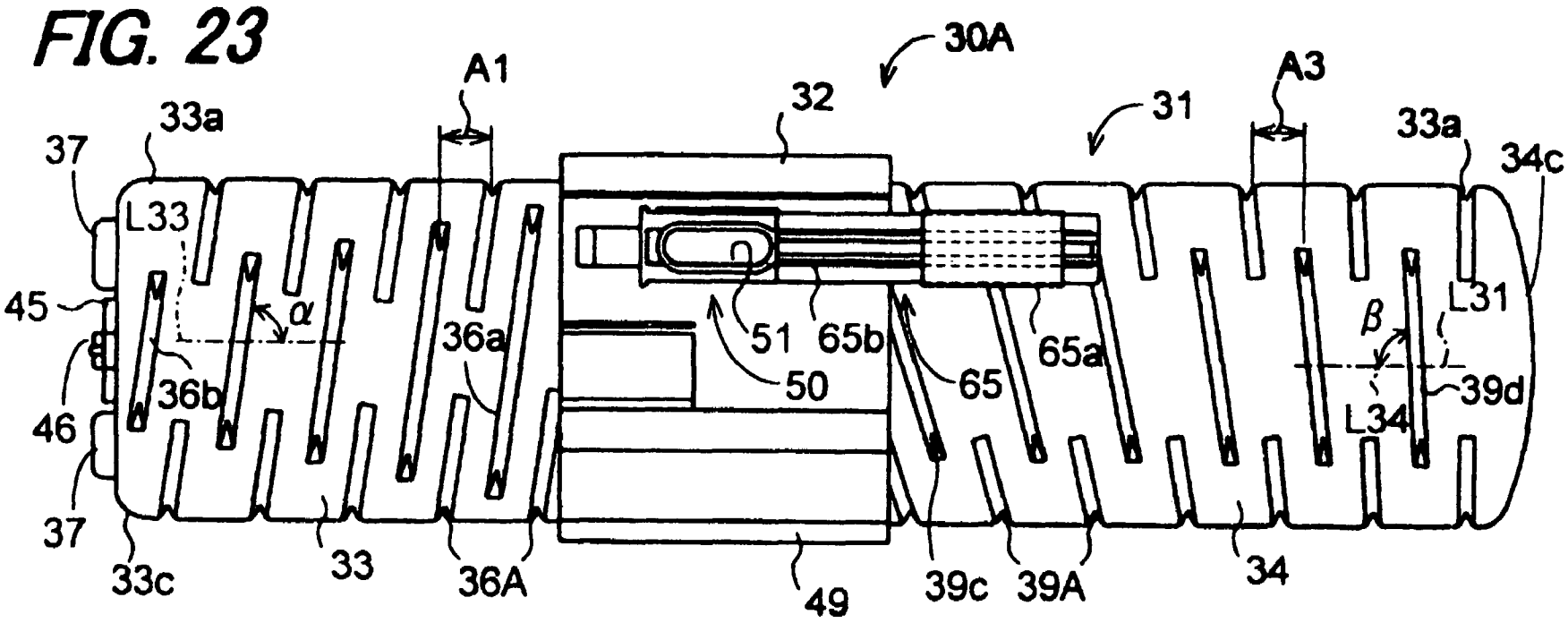
FIG. 23 is a front view showing a developer container 30A according to a second embodiment of the invention.

FIG. 23 is a front view showing a developer container 30A according to a second embodiment of the invention. Since the developer container 30A of the embodiment has the same configuration except for a first projection piece 36A and a second projection piece 39A provided in the container main body 31, as that of the developer container 30 of the first embodiment described above, the same reference numerals will be given concerning the same configurations, and the detail descriptions will be omitted.

In the inner circumferential portion of the first container segment 33 is provided conveying means for conveying developer in the axial direction when being rotated about the axis L31. The conveying means includes first projection pieces 36 which are a plurality of conveying portions protruding inward in the radial direction, which first projection pieces 36 extend in the first extending direction from the opening end portion 33*b* which is the other end portion in the axial direction of the first container segment 33, to the bottom portion 33*a* which is one end portion in the axial direction, as it is directed to the downstream side in the rotation direction. Each of the first projection pieces 36A is formed at intervals in the circumferential direction and the axial direction. The first projection pieces 36A, which are adjacent to each other in the axial direction are arranged, so that a downstream side end portion in the rotation direction of one first projection piece 36A and an upstream side end portion in the rotation direction of the other first projection piece 36A adjoin each other in the axial direction. To describe in detail, each of the first projection pieces 36 is formed so as to be inclined and extend into an arc shape so that the downstream end portion in the rotation direction can be arranged closer to the bottom portion 33*a* side than the upstream side end portion in the rotation direction. To describe in detail, the first projection piece 36A is provided so that the first projection piece 36*a* formed in a close portion to the discharge hole 43 has a larger size in the first extending direction than the first projection piece 36*b* formed in a distant portion from the discharge hole 43. To describe further in detail, the first projection piece 36A is formed so as to have a gradually larger size in the first extending direction as it comes closer to the discharge hole 43.

It is preferable that the length in the first extending direction of the first projection piece 36A is not less than 1/16 and not more than 3/8 of the inner circumferential length of the first container segment 33. Accordingly, the shortest length of the first projection piece 36A may be 1/16 of the inner circumferential length of the first container segment 33 and it may be, for example, approximately 20 mm. Further, the longest length of the first projection piece 36A may be 3/8 of the inner circumferential length of the first container segment 33 and it may be, for example, approximately 130 mm. In addition, it is preferable that the angle $\alpha$, which is formed between the tangent of the first projection piece 36A and the tangent in the circumferential direction of the first container segment 33 is 2° or more and 45° or less, more preferably 5° or more and 30° or less. In the embodiment, the angle α may be, for example, approximately 9°. The interval A1 of a pair of the first projection pieces 36 of the first container segment 33, which adjoin each other in the axial direction may be, for example, 15 mm. Moreover, the interval of the two first projection pieces 36A which are adjacent to each other in the circumferential direction may be, for example, approximately 30 mm.

In the inner circumferential portion of the second container segment 34 is provided conveying means for conveying the developer in the axial direction when being rotated about the axis L31. The conveying means includes second projection pieces 39A which are a plurality of conveying portions protruding inward in the rotation direction, which second projection pieces 39 extend in the second extending direction from the opening end portion 34*b* which is one end portion in the axial direction of the second container segment 34, to the bottom portion 34*a* which is the other end portion in the axial direction, as it is directed to the downstream side in the rotation direction. Each of the second projections piece 39 is formed at intervals in the circumferential direction and the axial direction. Two first projection pieces 39, which are adjacent to each other in the axial direction, are arranged so that a downstream side end portion in the rotation direction of one second projection piece 39 and an upstream side end portion in the rotation direction of the other second projection piece 39 adjoin each other. To describe in detail, each of the second projection piece 39 is formed so as to be inclined and extend into an arc shape so that the downstream end portion in the rotation direction can be arranged closer to the bottom portion 34*a* side than the upstream side end portion in the rotation direction. Each of the second projection pieces 39A is provided so that the second projection piece 39*c* formed in a close portion to the discharge hole 43 proceeds in the axial direction in the longer distance as proceeding in the circumferential direction in comparison with the distant second projection piece 39*d* formed in a distant portion from the discharge hole 43.

To describe in detail, it is preferable that the angle β, which is formed between the tangent of the second projection piece 39A and the tangent in the circumferential direction of the second container segment 34 is 2° or more and 45° or less, more preferably 5° or more and 30° or less. Accordingly, the angle β, which is formed between the tangent of the second projection piece 39*d* formed on the most distant portion from the discharge hole 43 and the tangent in the circumferential direction of the second container segment 34 may be, for example, 5°. The angle β, which is formed between the tangent of the second projection piece 39*d* formed on the closest portion to the discharge hole 43 and the tangent in the circumferential direction of the second container segment 34 may be, for example, 30°.

It is preferable that the length in the second extending direction of the second projection piece 39A is not less than 1/16 and not more than 3/8 of the inner circumferential length of the second container segment 34. In the embodiment, the length in the second extending direction of the second projection piece 39A may be, for example, approximately 60 mm. The interval A3 of a pair of the second projection pieces 39A of the second container segment 34, which are adjacent to each other in the axial direction may be, for example, 15 mm. Moreover, the interval of the two second projection pieces 39A which are adjacent to each other in the circumferential direction may be, for example, approximately 30 mm.

Further, the protruding length A2 of the first projection piece 36 and the second projection piece 39 from the residual portions of the inner circumferential portions of the first container segment 33 and the second container segment 34 inward in the radial direction is preferably not less than 1 mm and not more than 10 mm. In the embodiment, the protruding length A2 of the first projection piece 36 and the second projection piece 39 from the residual portions of the inner circumferential portions inward in the radial direction may be, for example, 6 mm. Moreover, the number of the first projection pieces 36A may be 26, and the number of the second projection pieces 39A may be 38. The developer conveying capacity of the container main body 31 is determined by the geometrical conditions of the first projection piece 36A and the second projection piece 39A described before. Therefore, the developer conveying capacity of the container main body 31 is determined so that an appropriate quantity of developer can be always discharged from the discharge hole 43 in all states from the state in which the container main body 31 is filled with the developer to the state which is just before the state in which the developer has been completely discharged.

As described above, according to the developer container 30A in the embodiment, the same effect as the above-described developer container 30 of the first embodiment can be achieved.

Moreover, according to the developer container 30A of the embodiment, the first projection portion 36*a* formed in a close portion to the discharge hole 43 is formed so as to have a larger size in the first extending direction in comparison with the first projection portion 36*b* formed in a distant portion from the discharge hole 43. Accordingly, the conveying amount in the axial direction of the developer close to the discharge hole 43 at the time when the container main body 31 is rotated is made larger than the conveying amount in the axial direction of the developer far away from the discharge hole 43 and therefore, the conveying amount of the developer can be made uneven with respect to the axial direction. In the case where the conveying amount of the developer is uniform with respect to the axial direction, when the container main body 31 is rotated, the developer contained in the container main body is uniformly conveyed to the discharge hole 43 and therefore, there is a slight possibility that the developer which has been conveyed is coagulated in the neighborhood of the discharge hole 43. In the embodiment, the conveying amount of the developer close to the discharge hole 43 at the time when the container main body 31 is rotated is made larger than the conveying amount in the axial direction of the developer far away from the discharge hole 43 and therefore, the developer which is directly conveyed to the discharge hole 43 is only the developer close to the discharge hole 43. Consequently, it is possible to lose almost completely the possibility that the developer which has been conveyed is coagulated in the neighborhood of the discharge hole 43.

Further, according to the developer container 30A of the embodiment, each second projection piece 39A is provided so that the second projection piece 39*c* formed in a close portion to the discharge hole 43 proceeds in the axial direction in the longer distance as proceeding in the circumferential direction in comparison with the distant second projection piece 39*d* formed in a distant portion from the discharge hole. Accordingly, the conveying amount in the axial direction of the developer close to the discharge hole 43 at the time when the container main body 31 is rotated is made larger than the conveying amount in the axial direction of the developer far away from the discharge hole 43 and therefore, the conveying amount of the developer can be made uneven with respect to the axial direction. In the case where the conveying amount of the developer is uniform with respect to the axial direction, when the container main body 31 is rotated, the developer contained in the container main body is uniformly conveyed to the discharge hole 43 and therefore, there is a slight possibility that the developer which has been conveyed is coagulated in the neighborhood of the discharge hole 43. In the embodiment, the conveying amount of the developer close to the discharge hole 43 at the time when the container main body 31 is rotated is made larger than the conveying amount in the axial direction of the developer far away from the discharge hole 43 and therefore, the developer which is directly conveyed to the discharge hole 43 is only the developer close to the discharge hole 43. Consequently, it is possible to lose almost completely the possibility that the developer which has been conveyed is coagulated in the neighborhood of the discharge hole.

In the developer container 30A of the embodiment, in order to make the conveying amount in the axial direction of the developer close to the discharge hole 43 at the time when the container main body 31 is rotated larger than the conveying amount in the axial direction of the developer far away from the discharge hole 43, each first projection piece 36A and each second projection piece 39A may be formed so that the first projection piece 36*a* and the second projection piece 39*c* formed in close portions to the discharge hole 43 have larger protruding amounts A2 inward in the radial direction from the residual portion of the inner circumferential portion of the first container segment 33 and the second container segment 34 in comparison with the first projection piece 39*b* and the second projection piece 39*d* formed in distant portions from the discharge hole.

Figure 24:
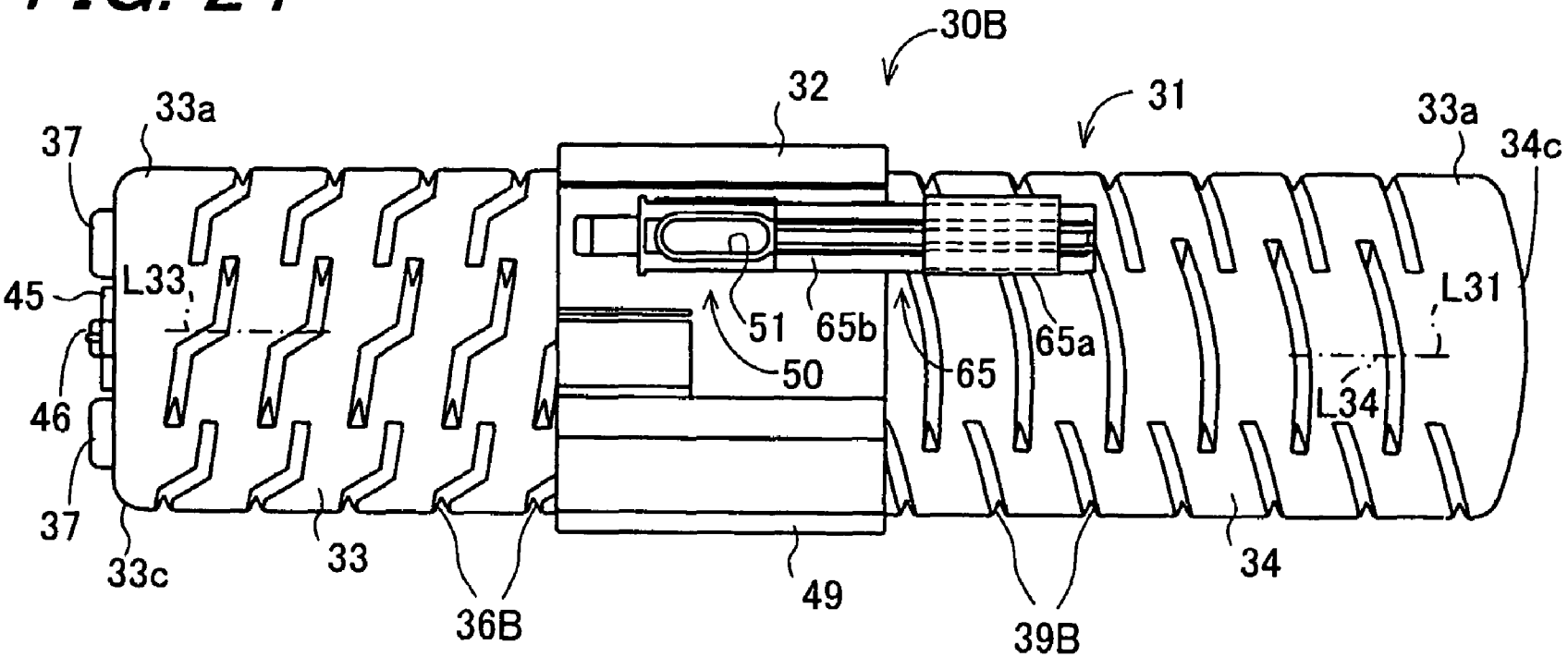
FIG. 24 is a front view showing a developer container 30B according to a third embodiment of the invention.

FIG. 24 is a front view showing a developer container 30B according to a third embodiment of the invention. The developer container 30A of the embodiment has the same configuration except for a first projection piece 36B and a second projection piece 39B provided in the container main body 31, as that of the developer container 30 of the first embodiment described above, the same reference numerals will be given concerning the same configurations, and the detail descriptions will be omitted.

In the inner circumferential portion of the first container segment 33 is provided conveying means for conveying the developer in the axial direction when the first container segment 33 is rotated about the axis L31. The conveying means has first projection pieces 36B which are a plurality of conveying portions extending in a first extending direction from the opening end portion 33*b* which is the other end portion in the axial direction of the first container segment 33, to the bottom portion 33*a* which is one end portion in the axial direction of the first container segment 33, and protruding inward in the radial direction. Each of the first projection pieces 36B is formed at intervals in the circumferential direction and the axial direction. Two first projection pieces 36B which are adjacent to each other in the axial direction, are arranged in such a manner that an end portion on a downstream side in the rotation direction of one first projection piece 36B and an end portion on an upstream side in the rotation direction of the other first projection piece 36B adjoin each other in the axial direction. To describe in detail, each of the first projection piece 36B is formed so as to be inclined and extend into an arc shape so that the downstream end portion in the rotation direction can be arranged closer to the bottom portion 33*a* side than the upstream side end portion in the rotation direction. To describe in detail, each of the first projection piece 36B is formed so as to meander in a substantially S-shape.

In the inner circumferential portion of the second container segment 34 is provided conveying means for conveying the developer in the axial direction when the second container segment 34 is rotated about the axis L31. The conveying means has second projection pieces 39B which are a plurality of conveying portions extending in a second extending direction from the opening end portion 34*b* which is one end portion in the axial direction of the second container segment 34, to the bottom portion 34*a* which is the other end portion in the axial direction of the second container segment 34, and protruding inward in the radial direction. Each of the second projection pieces 39B is formed at intervals in the circumferential direction and the axial direction. Two second projection pieces 39B which are adjacent to each other in the axial direction, are arranged in such a manner that an end portion on a downstream side in the rotation direction of one second projection piece 39B and an end portion on an upstream side in the rotation direction of the other second projection piece 39B adjoin each other in the axial direction. To describe in detail, each of the second projection piece 39B is formed so as to be inclined and extend into an arc shape so that the downstream end portion in the rotation direction can be arranged closer to the bottom portion 34*a* side than the upstream side end portion in the rotation direction. To describe in detail, each of the second projection pieces 39B is formed so as to curve in parallel with the axial direction.

According to the developer container 30B of the embodiment, the same effect as the above-described developer container 30 of the first embodiment can be achieved.

Figure 25:
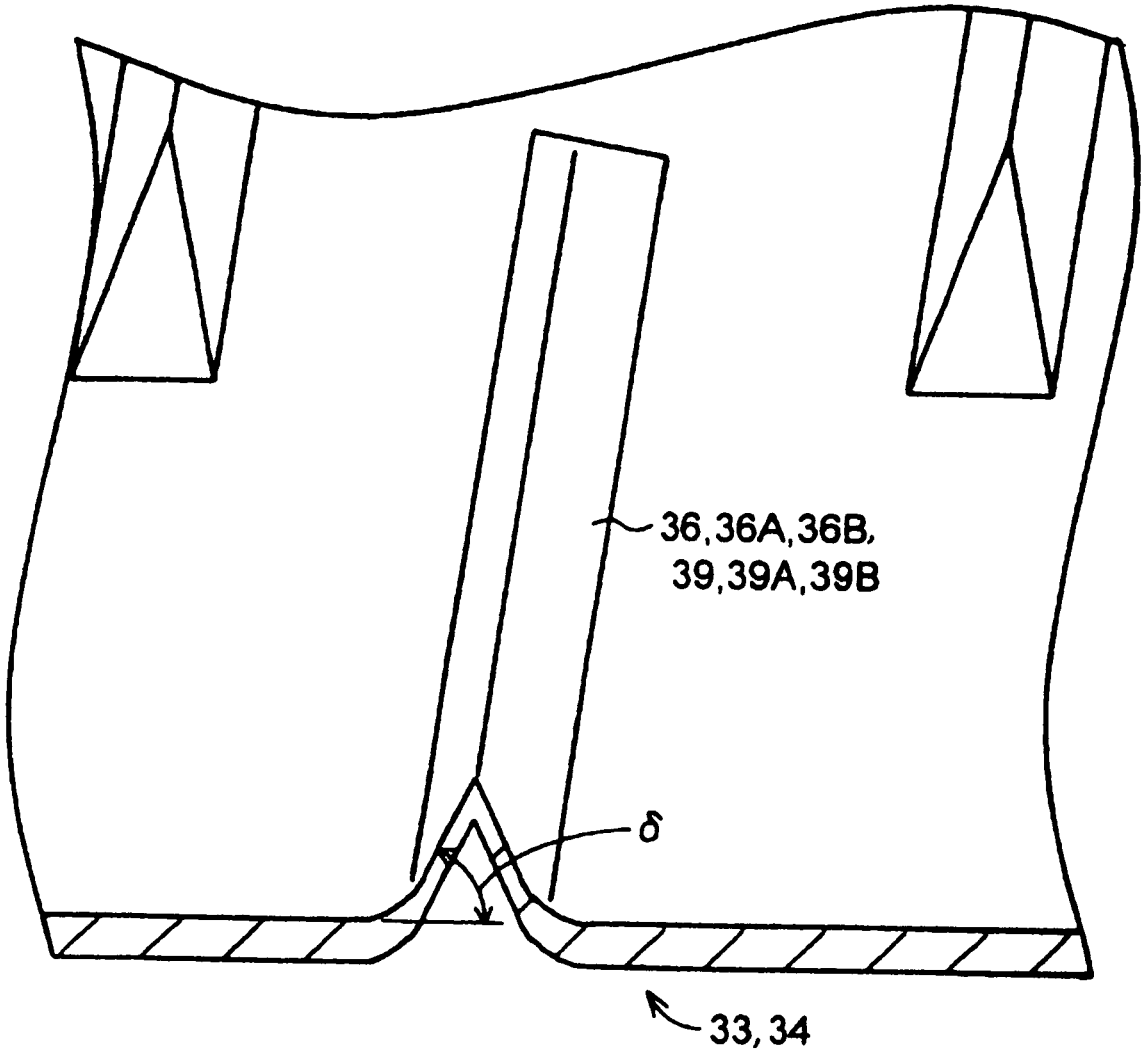
FIG. 25 is an enlarged sectional view showing a first projection piece 36 of the developer container 30 according to a first embodiment.

FIG. 25 is an enlarged sectional view showing the first projection piece 36 of the developer container 30 according to the first embodiment. A cross section perpendicular to the circumferential direction of the first projection piece 36 of the developer container 30 has a V-shape. The angle δ which is an acute angle of the angle formed between the inner circumferential face portion except for the first projection piece 36 of the first container segment 33 and the inclined plane of the first projection piece 36 is set not less than 20° and not more than 70°. In the embodiment, the angle δ may be, for example, 45°. When the angle δ is less than 20°, the conveying amount of the developer by the first projection piece 36 does not reach the desired conveying amount. Further, when the angle δ exceeds 70°, there is a danger that the developer in contact with the inclined plane of the first projection piece 36 is accumulated and coagulated in the neighborhood of the inclined plane.

Note that the detail description will be omitted since the second projection piece 39 of the developer container 30 of the first embodiment has the same cross section as that of the first projection piece 36. Moreover, the first and second projection pieces 36A and 39A; 36B and 39B of the developer containers 30A and 30B of the second and third embodiments have the same cross sections as the first and second projection pieces 36 and 39 of the developer container 30 of the first embodiment and therefore, the detail description will be omitted.

Figure 26:
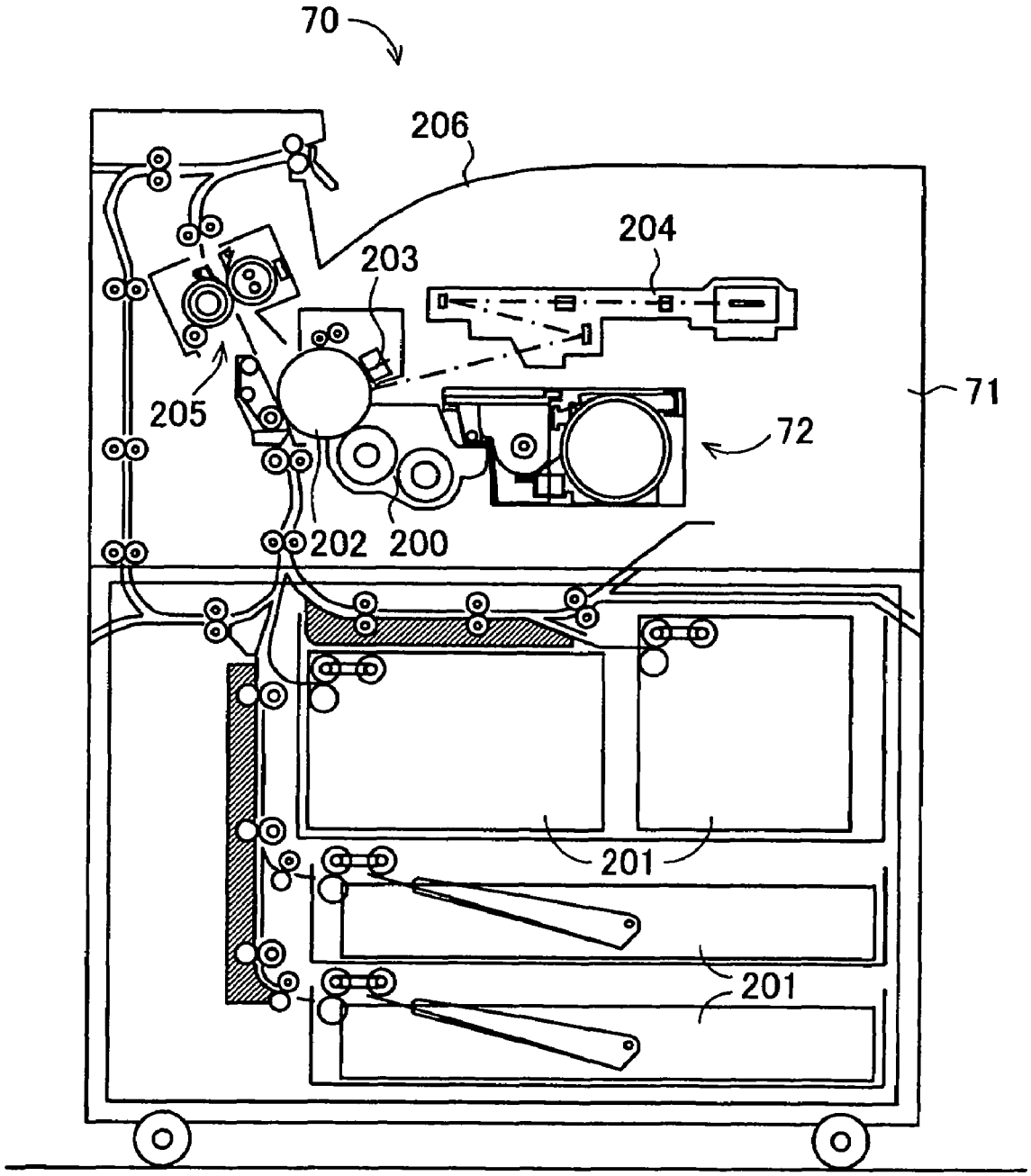
FIG. 26 is a sectional view showing an image forming apparatus 70 according to a fourth embodiment of the invention.
Figure 27:
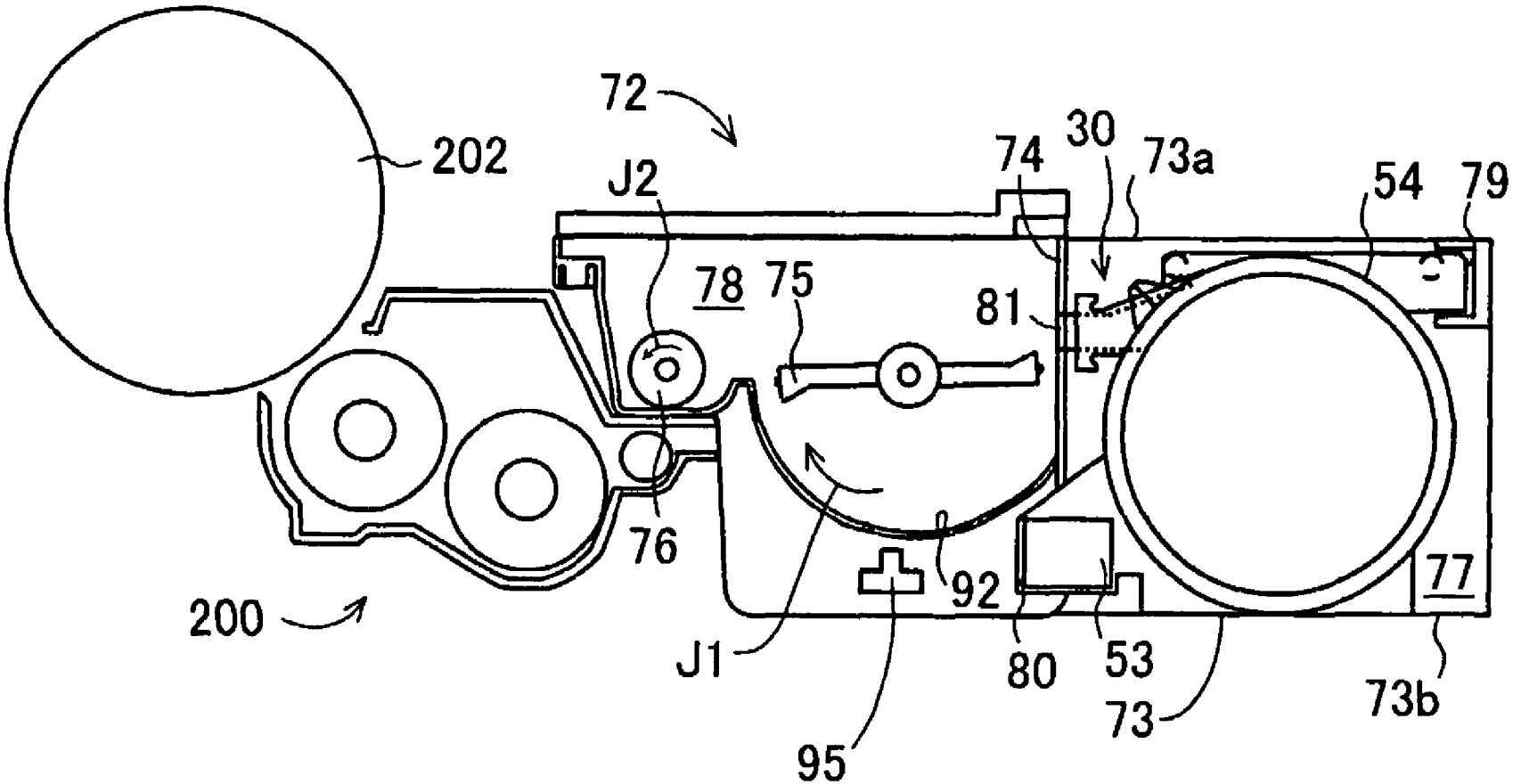
FIG. 27 is an enlarged sectional view showing a neighborhood of a toner hopper 72.
Figure 28:
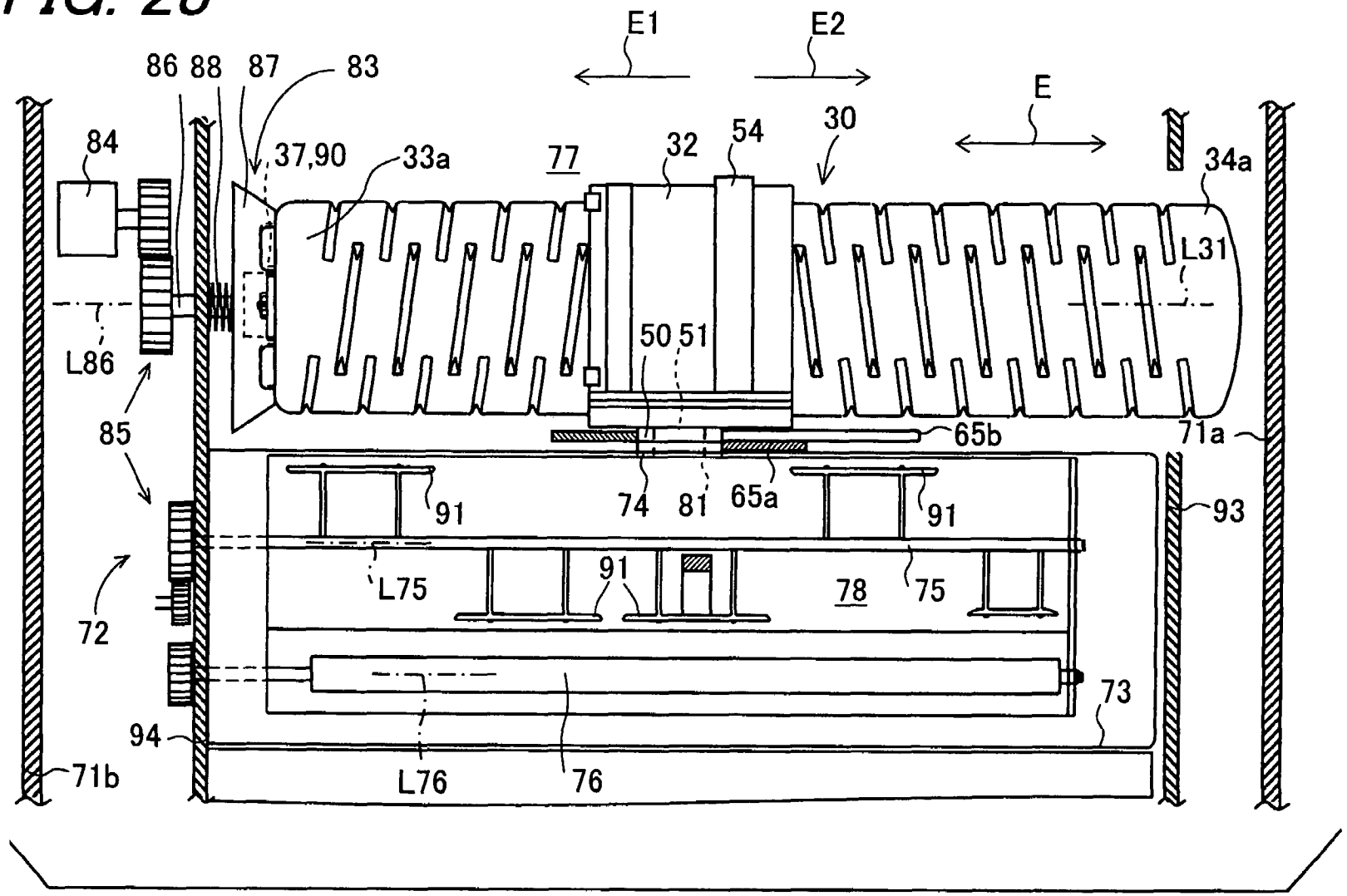
FIG. 28 is an enlarged plan view showing the neighborhood of the toner hopper 72.

FIG. 26 is a sectional view showing an image forming apparatus 70 of a fourth embodiment of the invention. FIG. 27 is an enlarged sectional view showing a neighborhood of the toner hopper 72. FIG. 28 is an enlarged plan view showing the neighborhood of the toner hopper 72. FIG. 26 is a sectional view of the image forming apparatus 70, taken from the front-side exterior portion 71*a* side. In order to make the comprehension easy, the thickness is omitted in the view. The front-side exterior portion 71*a* is generally defined as a portion that is faced by a user when the user uses the image forming apparatus 70. A back-side exterior portion 71*b* is defined as a portion in the image forming apparatus 70 that is located on the rear side to the front-side exterior portion 71*a* when seen by the user on the front-side exterior portion 71*a* side. Further, the image forming apparatus 70 is installed on a horizontal plane. The front to rear direction E, which is directed from the front-side exterior portion 71*a* to the back-side exterior portion 71*b*, is parallel with the horizontal plane.

The image forming apparatus 70 of the electrophotographic recording type such as a printer or copier includes a developer container 30 of the first embodiment, and an image forming apparatus main body 71 (which may be simply referred to as "an apparatus main body" hereinafter). The developer container 30 is detachably attached to the toner hopper 72 which is provided in the apparatus main body 71, via a container attaching/detaching opening (not shown) which can be freely opened and closed and is provided in the front-side exterior portion 71*a* of the apparatus main body 71. Further, in the image forming apparatus main body 71, a cabinet front portion 93 is provided on the back-side exterior portion 71*b* side with respect to the front-side exterior portion 71*a*, and formed is an opening portion which penetrates the apparatus in the thickness direction and into which the developer container 30 can be inserted. Further, in the image forming apparatus main body 71 is provided a cabinet back portion 94 on the front-side exterior portion 71*a* side with respect to the back-side exterior portion 71*b*. Each component of the image forming apparatus main body 71 is held by the housing (not all are shown), including the cabinet front portion 93 and the cabinet back portion 94.

The toner hopper 72 includes a housing 73, a developer supply section 74, an agitation member 75, and a supply roller 76. The inner space of the housing 73 is divided into at least a container housing space 77 and an agitation space 78 by the developer supply section 74. The container housing space 77 is open facing the front-side exterior portion 71*a* of the apparatus main body 71. The agitation space 78 is a substantially closed space. The developer container 30 is arranged in the container housing space 77.

In the upper wall portion 73*a* of the housing 73 facing the container housing space 77 formed is the first guide concavity 79, into which the first guide piece 53 of the supporting member 32 of the developer container 30 can be engaged and which extends in the front to rear direction E of the apparatus main body 71. The first guide concavity 79 can be engaged with the first guide piece 53 of the supporting member 32 of the developer container 30 so that the first guide piece 53 can be slid in the longitudinal direction, in other words, in the direction parallel with the front to rear direction E of the apparatus main body 71 and in the attaching direction E1 directed from the front-side exterior portion 71*a* to the back-side exterior portion 71*b* and in the detaching direction E2 which is opposite to the attaching direction E1. Moreover, in the lower wall portion 73*b* opposed to the upper wall portion 73*a* of the housing 73 facing the container housing space 77 formed is the second guide concavity 80, into which the second guide piece 54 of the supporting member 32 of the developer container 30 can be engaged and which extends in the front to rear direction E of the apparatus main body 71. The second guide concavity 80 can be engaged with the second guide piece 54 of the supporting member 32 of the developer container 30 so that the second guide piece 54 can be slid in the longitudinal direction, in other words, in the attaching direction E1 of the apparatus main body 71 and in the detaching direction E2 which is opposite to the attaching direction E1.

The developer supply section 74 is a platy member for dividing the inner space of the housing 73 into the container housing space 77 and the agitation space 78. The developer supply section 74 includes a communication hole 81 which penetrates the developer supply section 74 in the thickness direction and communicates the container housing space 77 with the agitation space 78. Further, in a lower portion of the communication hole 81 of the developer supply section 74, a guide member 82 protruding into the container housing space 77 is provided.

Figure 29:
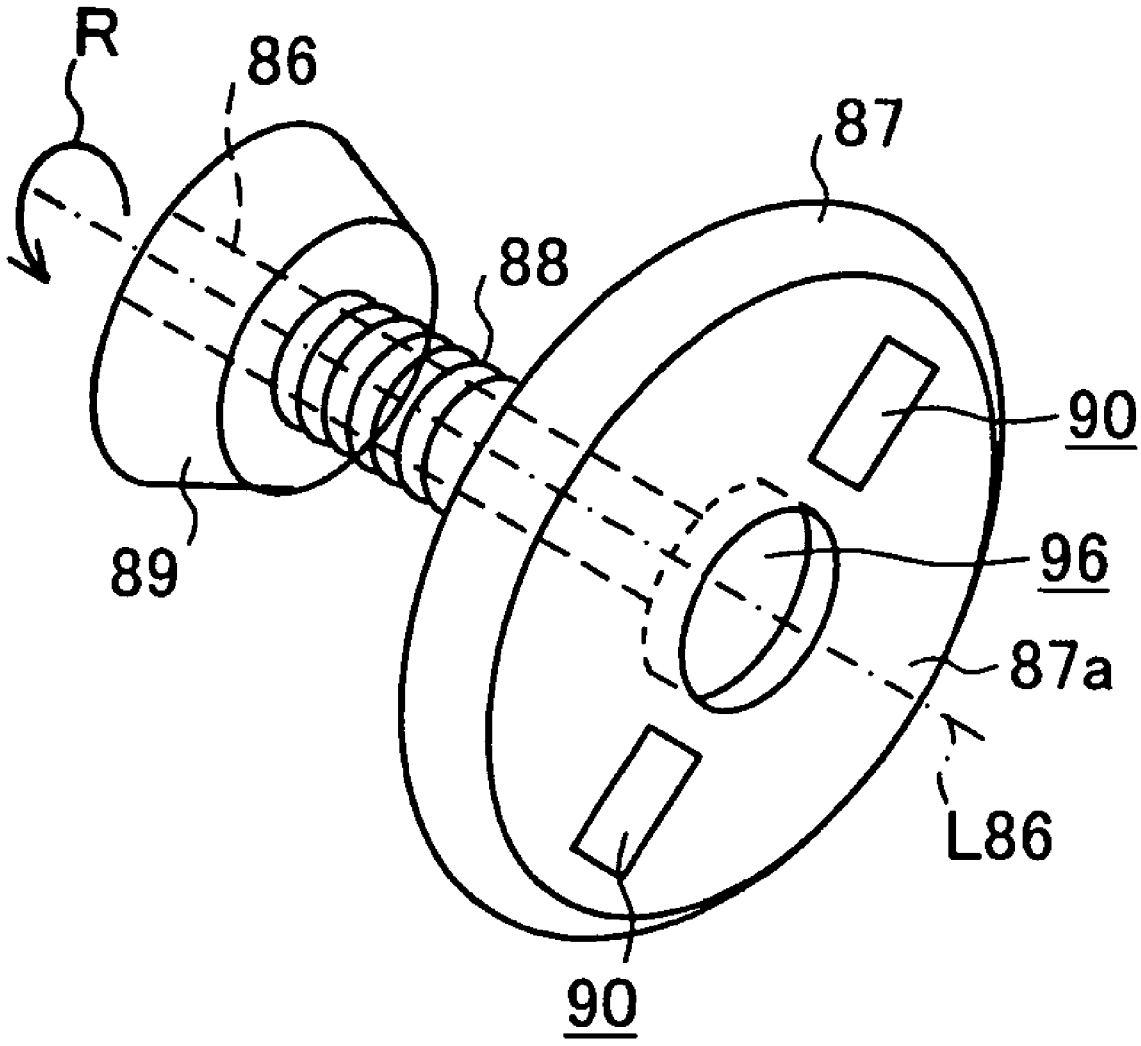
FIG. 29 is an enlarged perspective view showing a main body-side coupling section 83.
Figure 30:
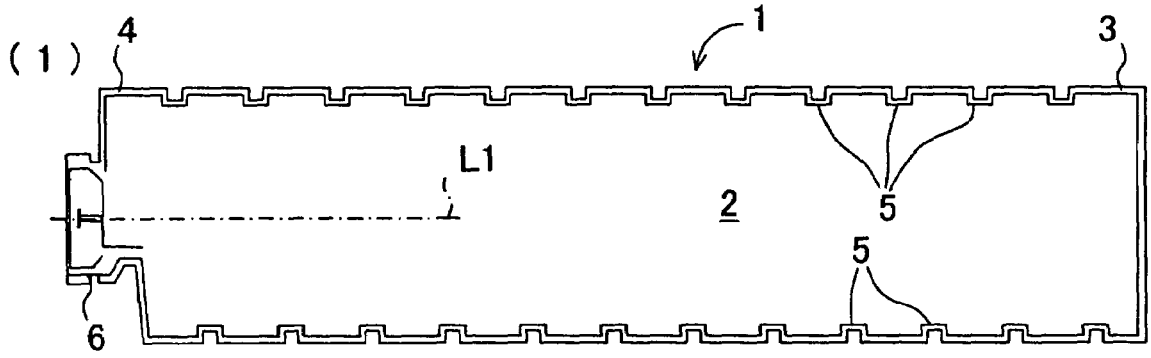
FIG. 30(1) is a sectional view showing a toner bottle 1 according to a first conventional art, and FIG. 30(2) is a perspective view showing the toner bottle 1.
Figure 30:
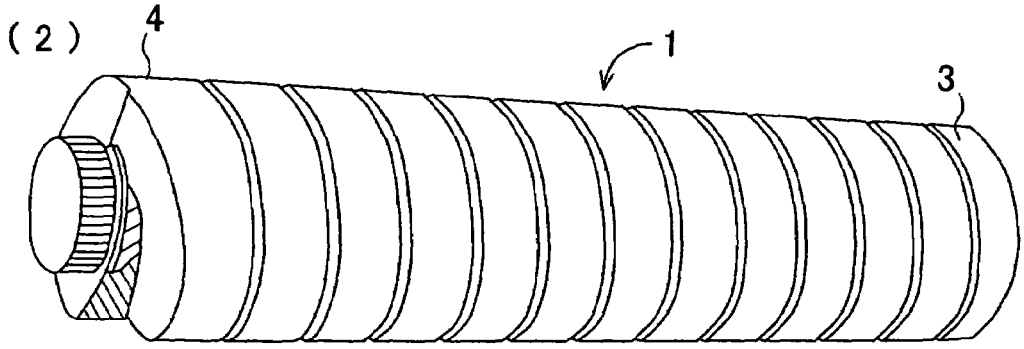
Figure 31:
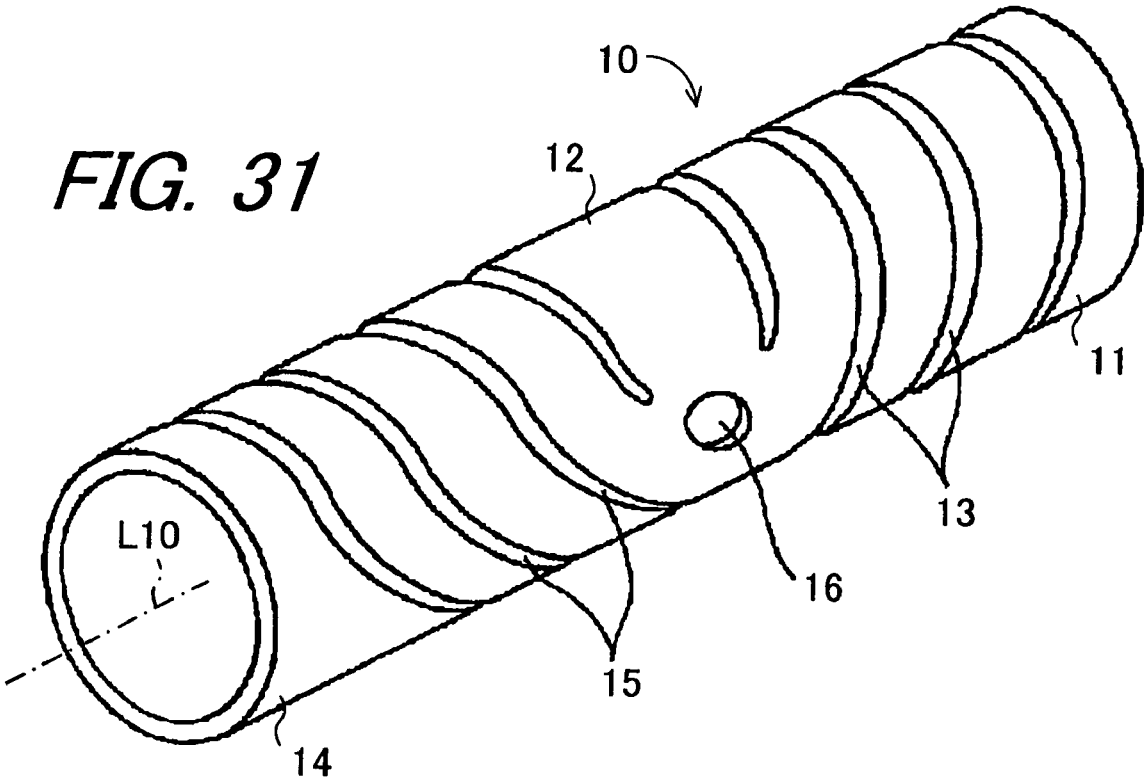
FIG. 31 is a perspective view showing a developer supplying container 10 according to a second conventional art.
Figure 32:
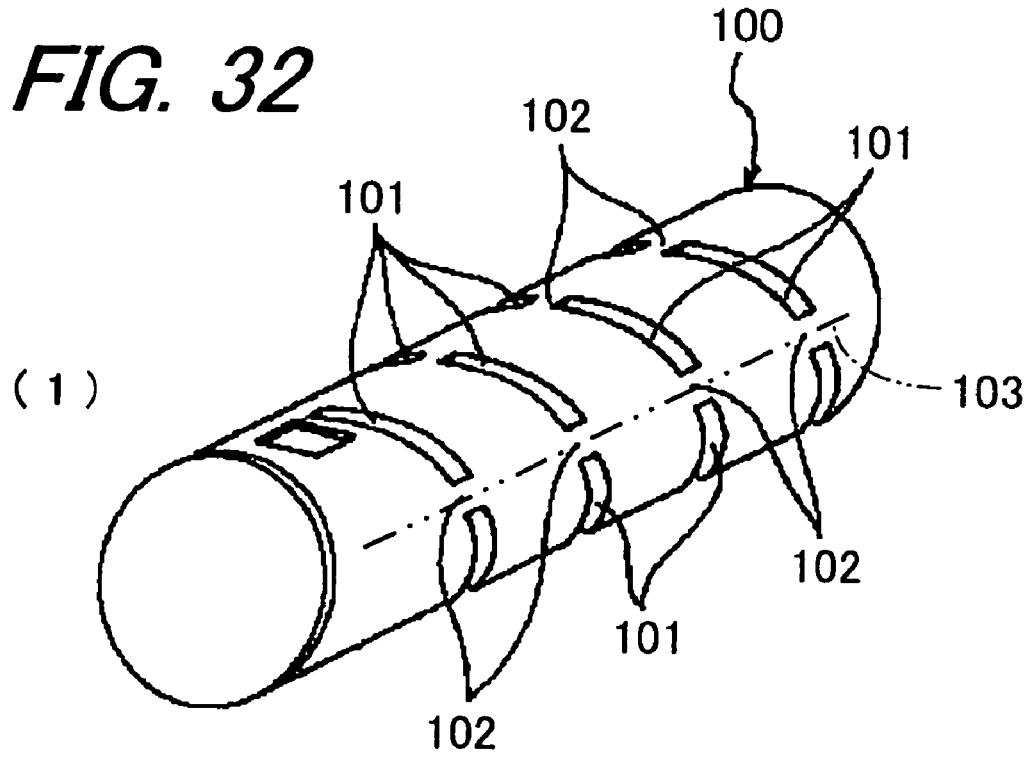
FIG. 32 is a perspective view showing developer supplying containers 100 and 100A according to a third conventional art.
Figure 32:
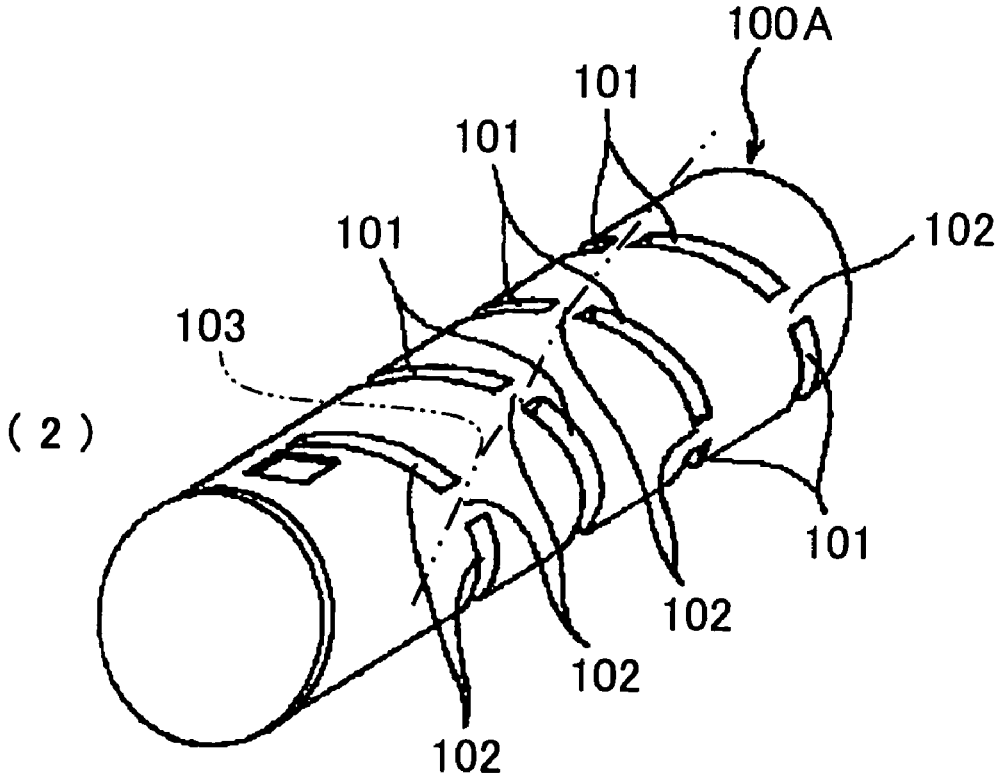

FIG. 29 is an enlarged perspective view showing a main body-side coupling section 83. A drive force generated by the driving source 84 such as an electric motor of the apparatus main body 71 for rotating the container main body 31 of the developer container 30 is transmitted to the main body-side coupling section 83 via the speed reduction device 85 such as gears. The drive means includes the main body-side coupling section 83, a driving source 84, and a speed reduction device 85. The main body-side coupling section 83 includes a rotation shaft 86, a coupling support 87, and a spring member 88. The rotation shaft 86 is arranged in such a manner that an axis L86 thereof is parallel with the front to rear direction E of the apparatus main body 71, and the rotation shaft 86 is pivotally inserted into a bearing 89 which is provided so as to penetrate the cabinet back portion 94, which is the rear wall portion of the housing 73 on the back-side exterior portion 71*b* side of the apparatus main body 71, in the thickness direction. The free end portion of the rotation shaft 86 is arranged in the container housing space 77.

The coupling support 87 is formed into a substantial disk shape and faces the container housing space 77. The coupling support 87 is integrated with the rotation shaft 86 into one body and freely rotated about the axis L86 and connected to a free end portion of the rotation shaft 86. At the center of the surface portion 87*a* opposite to the surface portion facing the cabinet back portion 94 of the coupling support 87 provided is an auxiliary concavity 96, the axis of which is the same as the axis L86 of the rotation shaft 86 and which sinks onto the cabinet back portion 94 side, into which the replenishment port 45 having the replenishment lid 46 of the developer container 30 attached thereto can be engaged. Moreover, outside in the radial direction with respect to the auxiliary concavity 96 of the surface portion 87*a* of the coupling support 87, a plurality of concave fits 90, in the embodiment, two concave fits 90 are formed, which are arranged at the symmetrical positions with respect to the axis L86 of the rotation shaft 86 and sink onto the cabinet back portion 94. The shape of each concave fit 90 corresponds to the shape of each convex fit 37 of the container main body 31. When each convex fit 37 of the container main body 31 is engaged into the concave fit 90, the convex fit 37 and the concave fit 90 are engaged with each other.

Further, the coupling support 87 can be freely displaced in the axial direction of the rotation shaft 86 without being disengaged from the free end portion of the rotation shaft 86. Moreover, the spring member 88 composed of a compression spring or the like is arranged between the cabinet back portion 94 and the coupling support 87 and gives a spring force in such a direction that the coupling support 87 can be separated from the cabinet back portion 94 without blocking the rotation of the rotation shaft 86 and the coupling support 87. The one end portion 33*a* in the axial direction including the convex fit 37 of the container main body 31 of the developer container 30 and the coupling support 87 of the main body-side coupling section 83 compose a coupling structure. Accordingly, the convex fit 37 of the container main body 31 can be detachably connected to the coupling support 87 of the main body-side coupling section 83.

When the developer container 30 is attached to the apparatus main body 71, the developer container 30 is set so that the rotation axis L31 can be parallel with the attaching direction E1, and the front-side exterior portion 71*a* of the apparatus main body 71 is inserted into the container housing space 77 of the toner hopper 72. At this time, the first guide piece 53 of the supporting member 32 of the developer container 30 is engaged in the first guide concavity 79 of the housing 73, and the second guide piece 54 of the supporting member 32 is engaged in the second guide concavity 80 of the housing 73, so that the supporting member 32 can not be displaced in directions except for the attaching direction E1 and the detaching direction E2 of the supporting member 32. Under the above condition, the developer container 30 is displaced in the attaching direction E1 and arranged at the attaching position where the leading through hole 51 of the discharge portion 50 of the supporting member 32 and the communication hole 81 of the developer supply section 74 are communicated with each other. At this time, the coupling support 87 of the main body-side coupling section 83 is pushed in the attaching direction E1 by the convex fit 37 of the container main body 31, so that the coupling support 87 can be contracted and the spring portion 88 can be compressed.

The toner hopper 72 includes a regulating member (not shown) for regulating and releasing a displacement of the supporting member 32 in the attaching direction E1 and the detaching direction E2 under the condition that the developer container 30 is arranged at the attaching position. After all developer contained in the developer container 30 has been discharged, the user releases the regulation against the supporting member 32 made by the regulation member, and the developer container 30 is displaced in the detaching direction E2, so that the developer container 30 can be detached from the apparatus main body 71.

In the periphery of the communication hole 81, which faces the container housing space 77 of the developer supply section 74 of the toner hopper 72, shutter displacement means (not shown) for sliding the shutter 65*a* of the shutter portion 65 of the developer container 30 is provided. When the developer container 30 is inserted from the front-side exterior portion 71*a* of the apparatus main body 71 into the container housing space 77 of the toner hopper 72 while the rotation axis L31 and the attaching direction E1 are being made to be parallel with each other, the shutter 65*a* arranged at the closing position P1 is slid in the one second horizontal direction B1 by the shutter displacement means. When the developer container 30 is arranged at the attaching position, the shutter 65*a* is arranged at the opening position P2. Further, when the developer container 30, which is attached to the apparatus main body 71 and arranged at the attaching position, is displaced in the detaching direction E2 so as to detach the developer container 30 from the apparatus main body 71, the shutter 65*a* arranged at the opening position P2 is slid in the other second horizontal direction B2 by the shutter displacement means and arranged at the closing position P1.

Further, at least in the periphery of the leading through hole 51 of the discharge portion 50 of the supporting member 32 of the developer container 30 or in the periphery of the communication hole 81 which faces the container housing space 77 of the developer supply section 74 of the toner hopper 72, a sealing material (not shown) is provided which prevents the developer, which flows down from the leading through hole 51 to the communication hole 81, from leaking out to portions except for the agitation space 78.

As shown in FIG. 28, in the apparatus main body 71, the developing portion 200 is arranged at the middle portion in the front to rear direction E. This is because the photoreceptor drum 202 of the apparatus main body 71 is arranged in the middle portion in the front to rear direction E of the apparatus main body 71. Moreover, the driving source 84 and the drive portion such as a speed reduction gear 85 for rotating the main body-side coupling section 83, the agitation member 75 and the supply roller 76 are arranged between the cabinet back portion 94 and the back-side exterior portion 71*b* in the apparatus main body 21. Accordingly, under the condition that the developer container 30 is arranged at the attaching position, the supporting member 32 of the developer container 30 is arranged in the middle portion in the front to rear direction E of the apparatus main body 71. In the developer container 30, as described before, the length from the supporting member 32 of the container main body 31 to the end face of one end portion 33*a* in the axial direction, in which the convex fit 37 is formed, is shorter than the length from the supporting member 32 to the end face of the other end portion 34*a* in the axial direction.

In the developer container 30 of the image forming apparatus 70 of the embodiment, the supporting member 32 is arranged in the middle portion in the axial direction of the container main body 31 and therefore, under the condition that the developer container 30 is attached to the attaching position in the image forming apparatus main body 71, the supporting member 32 is arranged in the middle portion in the front to rear direction E of the apparatus main body 71. Accordingly, the container main body 31 can be extended from the middle portion in the front to rear direction E to the front portion of the apparatus main body 71. Further, the container main body 31 can be extended from the middle portion in the front to rear direction E to the rear face, that is, the capacity of the container main body 31 can be greatly increased. In the embodiment, as shown in FIG. 28, the other end portion 34*a* in the axial direction of the developer container 30 protrudes to the front-side exterior portion 71*a* side compared with the cabinet front portion 93.

Further, when the length from the supporting member 32 of the container main body 31 to the end face of one end portion 33*a* in the axial direction is made to be shorter than the length from the supporting member 32 to the end face of the other end portion 34*a* in the axial direction, it is possible to ensure a region on the rear face portion in the apparatus main body 71, the region being for providing the driving source 84 connected to the convex fit 37 of one end portion 33*a* in the axial direction of the container main body 31 and the drive portion including the speed reduction gear 85. In this way, the developer container 30 can provide matchless effects in which the space in the apparatus main body 71 is effectively utilized and a containing quantity of the developer is increased as large as possible.

When the driving source 84 is driven and the coupling support 87 is rotated under the condition that the developer container 30 is arranged at the attaching position, in the state where the concave fit 90 of the coupling support 87 and the convex fit 37 of the developer container 30 are engaged with each other, the container main body 31 is rotated about the rotation axis L31 as it is. Further, in the state where the concave fit 90 of the coupling support 87 and the convex fit 37 of the developer container 30 are not engaged with each other, until the concave fit 90 of the coupling support 87 and the convex fit 37 of the developer container 30 are engaged with each other, only the coupling support 87 is angularly displaced for a while. When the concave fit 90 of the coupling support 87 and the convex fit 37 of the developer container 30 are engaged with each other, a spring force generated by the spring member 88 is given, so that the concave fit 90 of the coupling support 87 and the convex fit 37 of the developer container 30 are closely engaged with each other. The container main body 31 is rotated about the rotation axis L31. When the container main body 31 of the developer container 30 is thus rotated about the rotation axis L31, the developer contained in the developer container 30 is supplied to and contained in the agitation space 78 via the leading through hole 51 of the discharge portion 50 of the supporting member 32 and via the communication hole 81 of the developer supply section 74 of the toner hopper 72.

The agitation member 75 and the supply roller 76 are arranged in the agitation space 78 at an interval so as to extend in the front to rear direction E of the apparatus main body 71. The agitation member 75 can be freely rotated about the agitation axis L75 which is parallel with the front to rear direction E. The agitation member 75 includes a flexible scraper member 91 extending in the direction of the agitation axis L75. Moreover, the agitation member 75 is rotated by a drive force, which is given by the driving source 84 arranged in the apparatus main body 71, about the agitation axis L75 in the clockwise direction J1 when viewed from the front of the apparatus main body 71. The supply roller 76 can be freely rotated about the supply axis L76 which is parallel with the front to rear direction E. The outer circumferential face of the supply roller 76 is, for example, made of porous resin such as sponge. Further, the supply roller 76 is rotated by a drive force, which is given by the driving source 84 arranged in the apparatus main body 71, about the agitation axis L76 in the counterclockwise direction J2 when viewed from the front of the apparatus main body 71.

An agitation wall portion 92 is provided so as to face the agitation space 78 of the toner hopper 72 and communicate with the developer supply section 74. The agitation wall portion 92 extends in the front to rear direction E of the apparatus main body 21, and is formed so as to have the cross section of a substantial U-shape, perpendicular to the agitation axis L75 of the agitation member 75 and a partially cylindrical inner circumferential shape which is open upward. Although the developer is supplied from one communication hole 81 into the agitation space 78, the developer discharged from the developer container 30 is, as described before, not only agitated but also mixed with gas and formed into fine powder, so that the fluidity of the developer is very high and therefore, only when the developer is supplied from the communication hole 81, the developer can be diffused in the direction of the agitation axis L75 in the agitation space 78. The developer contained in the agitation space 78 is further diffused in the direction of the agitation axis L75 in the agitation space 78 by the agitation of the agitation member 75.

When the agitation member 75 is rotated, the developer, which has been supplied from the communication hole 81 and is to be contained in the agitation space 78, is agitated. At the same time, while the free end portion of the scraper member 91 is coming into contact with the agitation wall portion 92, the scraper member 91 scrapes out the developer contained in the agitation space 78 and gives the developer to the supply roller 76. Accordingly, the supply roller 76 is given the fine-powder-like developer in an axial direction L76 thereof in a substantially uniform state. Further, even when a quantity of the remaining developer contained in the agitation space 78 has become small, the remaining developer is scraped off and given to the supply roller 76 and therefore, a quantity of the developer, which remains in the agitation space 78 without being given to the supply roller 76, can be decreased as small as possible. The developer given to the supply roller 76 can be supplied to the developing portion 200 in an excellent condition by the rotation of the supply roller 76.

The apparatus main body 71 further includes a development section 200, a recording sheet cassette 201, a photoconductive drum 202, a charging section 203, a laser exposure section 204, and a fixating section 205. The development section 200 generates, two-component developer by agitating the toner, which is developer supplied from the toner hopper 72, and the carrier, which is magnetic particles previously prepared.

The recording sheet cassette 201 holds recording sheets on which images are formed. The photoconductive drum 202 is a cylindrical drum, on the outer circumference of which the photoreceptor is provided, and rotated about the axis by a drive force given from the drive portion. The charging section 203 applies electric charge to the photoconductive element of the photoconductive drum 202 to achieve the photosensitization. In the laser exposure section 204, the photoconductive element of the photoconductive drum 202 bearing electrical charge is exposed to laser light to form an electrostatic latent image on the photoconductive element.

The developer section 200 agitates the two-component developer and conducts development by supplying the two-component developer to the photoconductive element of the photoconductive drum 202 on which an electrostatic latent image is formed and then, a toner image corresponding to the electrostatic latent image is formed. The photoconductive drum 202 transfers the toner image formed on the photoconductive drum 202 onto a recording sheet supplied from the recording sheet cassette 201. The fixating section 205 fixes the toner image on the recording sheet onto which the toner image has been transferred, onto the recording sheet. The recording sheet, on which the toner image has been formed and the image has been fixed, is discharged into a discharge tray 206. In order to maintain the concentration of toner in two-component developer in the development section 4 constant, the supply roller 76 has an outer circumferential portion thereof made of sponge, and further rotation thereof is controlled. Accordingly, the supply roller 76 can supply an appropriate quantity of fine-powder-like toner to the development section 200.

Brief descriptions will be made hereinbelow into such a container main body 31 of the developer container 30, and also the controlling of the agitation member 75 of the toner hopper 72 and the supply roller 76. When the toner remaining quantity detector 95 provided in the agitation wall portion 92 detects that a quantity of developer (which may be referred to as "toner" hereinafter) contained in the agitation space 78 of the toner hopper 72 has become small, the control portion (not shown) controls the driving source 84 and rotates the container main body 31 of the developer container 30, so that the toner can be supplied into the agitation space 78. When it is detected by the toner remaining quantity detector 95 that a quantity of the toner contained in the agitation space 78 is not full even when the container main body 31 is rotated for a predetermined period of time, the control portion stops the rotation of the container main body 31 and displays a message in a display portion (not shown) which means that the developer container 30 is to be replaced, thereby the user is informed. At this point of time, a suitable quantity of toner is contained in the agitation space 78 of the toner hopper 72. During the period of time in which the developer is still contained in the agitation space 78 of the toner hopper 72, the user detaches the empty developer container 30 from the apparatus main body 71 and attaches a new developer container 30, in which the developer is contained, to the apparatus main body 71. Accordingly, even in the middle of image formation on the recording paper conducted by the image forming apparatus 70, since the developer necessary for image formation is contained in the agitation space 78 of the toner hopper 72, the developer can be replenished to the apparatus main body 71 without interrupting the image forming operation.

In the embodiment, when the developer is replenished, it is sufficient that only the developer container 30 is replaced. For example, the user holds the supporting member 32 and the second container segment 34 of the developer container 30 and inserts from the first container segment 33, in which the convex fit 37 is formed, into the container housing space 77 of the toner hopper 72 from the cabinet front portion 93 of the apparatus main body 71 in the attaching direction E1, which process is very simple. In addition, when the developer container 30 is detached from the apparatus main body 71, the user only holds the second container segment 34 of the developer container 30 and draws in the detaching direction E2, which process is very simple.

Further, in order to prevent the occurrence of coagulation of the contained developer by agitation, the user conventionally oscillates a heavy and large toner cartridge in the vertical and horizontal directions, however, in the developer container 30 of the embodiment, it is sufficient that the user only rotates the container main body 31 about the rotation axis L31, which process is very simple. Further, according to the developer container 30 of the embodiment, the structure of agitating the contained developer is very simple. Furthermore, the developer container 30 has sealing accomplished between the container main body 31 and the supporting member 32, and in the case where the developer container 30 is attached to the apparatus main body 71 at the attaching position, sealing is accomplished at least in the periphery of the leading through hole 51 of the discharge portion 50 or in the periphery of the communication hole 81 of the developer supply section 74, the leading through hole 51 and the communication hole 81 being communicated with each other. Therefore, the developer can be prevented from leaking out from the container housing space 77 of the toner hopper 72 as much as possible. Accordingly, when the user replaces the developer container 30, it is possible for the user to prevent the hand from being stained with the developer. In addition, since the developer container 30 is substantially cylindrical, it is possible to contain the developer container 30 in a long and slender rectangular parallelepiped packing box, which makes the transportation and replenishment very easy.

Furthermore, according to the developer container 30, as described before, a necessary torque for rotating the container main body 31 is not made so high, and further a quantity of the developer discharged per one revolution of the container main body 31 is as constant as possible. Accordingly, it is unnecessary to increase the rotation speed of the container main body 31. Even at a low rotation speed of the container main body 31, the developer can be supplied into the agitation space 78 of the toner hopper 72, and the developer can be supplied into the agitation space 78 by making a discharging quantity of the developer per one revolution of the container main body 31 maintain as constant as possible. The torque of the driving source 84 can be reduced, and the driving source 84 can be made, for example, a small electric motor.

Although the image forming apparatus 70 of the embodiment has the developer container 30 of the first embodiment detachably mounted thereon, the image forming apparatus is not limited to this structure. For example, the developer containers 30A and 30B of the second and third embodiments may be detachably mounted.

In the developer container 30 and the image forming apparatus 70 of the embodiment described before, two-component developer is used. However, the invention can be applied to the developing system in which only toner is used.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

As described above, according to the invention, when the container main body is rotated about the axis, the developer contained in the container main body can be conveyed in the axial direction while being oscillated, by the conveying means provided in the inner circumferential portion of the container main body so that the developer can be discharged from the discharge port provided on the substantially middle portion in the axial direction of the container main body. In the case where the conveying means is formed into, for example, projection pieces extending inward in the radial direction, or a groove sinking outward in the radial direction, such as the case where the conveying means extends in the spiral direction about the axis, the developer located close to the conveying means is given a pushing force in the axial direction from the conveying means. Accordingly, there is a danger that the developer is coagulated in the neighborhood of the projection pieces and the developer is supplied to an image forming apparatus in such a coagulated state. Further, in this case, when the container main body is given a twisting force from the outside about the axis, a bending force from the outside and an impact, there is a danger that the container main body is easily damaged by the occurrence of cracks which extend substantially along the spiral direction in the conveying means of the container main body. Further, in the case where a plurality of conveying portions are formed at intervals in the circumferential direction and the axial direction, when portions between the conveying portions, which are adjacent to each other in the circumferential direction, are arranged on the same straight line or the same spiral orbit like the conventional art, when the container main body is given a pushing force inward in the radial direction, the conveying portions, which are arranged on the same straight line or the same spiral orbit, are compressed in the circumferential direction and easily deformed.

The conveying means includes a plurality of the conveying portions extending in the extending direction from the one end portion to the other end portion in the axial direction as it is directed to the downstream side in the rotation direction. Each of the conveying portions is formed at intervals in the circumferential direction and the axial direction, and the conveying portions which are adjacent to each other in the axial direction, are arranged in such a manner that the end portion on the downstream side in the rotation direction of one conveying portion and the end portion on the upstream side in the rotation direction of the other conveying portion adjoin each other in the axial direction. Therefore, the portion between the adjacent conveying portions in the circumferential direction will not be arranged on the same straight line or the same spiral orbit. Accordingly, even when the container main body is given a twisting force from the outside about the axis, a bending force from the outside and an impact and even when the container main body is given a pushing force inward in the radial direction, the occurrence of damage and deformation of the container main body can be prevented as much as possible. Furthermore, since each of the conveying portions is arranged at intervals in the circumferential direction, the developer conveyed in the axial direction by the conveying portions intermittently comes into contact with each of the conveying portions. Therefore, the developer can be prevented from coagulation at the conveying portions, and further the developer can be conveyed in the axial direction being oscillated. Moreover, on the substantially middle portion in the axial direction inside the container main body, where the discharge hole is provided, the developer can be positively agitated on the substantially middle portion in the axial direction by the mutual collision between the developer conveyed from the one end portion in the axial direction and the developer conveyed from the other end portion in the axial direction. In the case where the discharge hole is provided on the substantially middle portion in the axial direction of the container main body as in the invention, the developer must be softened quickly since a distance in which the developer is conveyed is shorter in comparison with a case where the discharge hole is provided on the one end portion in the axial direction of the container main body. In the invention, inside the rotating container main body, the developer is agitated on the substantially middle portion in the axial direction of the container main body, and the developer is oscillated when being conveyed in the axial direction toward the discharge hole, so that the coagulated developers on the one end portion in the axial direction and on the other end portion in the axial direction are rapidly softened while being conveyed in a shorter distance to the discharge hole than conventional distance, and it is possible to positively prevent the developer in a coagulated state from being conveyed to the discharge hole.

Further, according to the invention, since each of the conveying portions is formed so as to meander in the substantially S-shape, it is possible to regulate conveying amount of the developer in the axial direction by forming each of the conveying portions with a meandering degree thereof adjusted.

Further, according to the invention, since each of the conveying portions is formed so that the conveying amount of the developer by the conveying portion formed in a close portion to the discharge hole becomes larger than the conveying amount of the developer by the conveying portion formed in a distant portion from the discharge hole, it is possible to positively prevent the developer located on a close position to the discharge hole from being pushed into the discharge hole by the developer located on a distant position from the discharge hole. Accordingly, the developer located on the close position to the discharge hole is pushed into the discharge hole by the developer located on the distant position from the discharge hole and thereby, the developer can be positively prevented from being coagulated in the neighborhood of the discharge hole.

Further, according to the invention, each of the conveying portions is formed so that the conveying portion formed in the close portion to the discharge hole proceeds in the axial direction in the longer distance as proceeding in the circumferential direction in comparison with the conveying portion formed in the distant portion from the discharge hole. Consequently, it is possible to realize that the conveying amount in the axial direction of the developer close to the discharge hole at the time when the container main body is being rotated is made larger than the conveying amount in the axial direction of the developer far away from the discharge hole as described above.

Further, according to the invention, the conveying portion formed in the close portion to the discharge hole is formed so as to have larger size in the extending direction in comparison with the conveying portion formed in the distant portion from the discharge hole. Consequently, it is possible to realize that the conveying amount in the axial direction of the developer close to the discharge hole at the time when the container main body is rotated is made larger than the conveying amount in the axial direction of the developer far away from the discharge hole as described above.

Further, according to the invention, each of the conveying portions is formed so as to protrude inward in the radial direction, and the conveying portion formed in the close portion to the discharge hole is formed so as to have a larger protruding amount inward in the radial direction in comparison with the conveying portion formed in the distant portion from the discharge hole. Consequently, it is possible to realize that the conveying amount in the axial direction of the developer close to the discharge hole at the time when the container main body is rotated is made larger than the conveying amount in the axial direction of the developer far away from the discharge hole as described above.

Further, according to the invention, the image forming apparatus can mount the developer container which achieves the above-described effects.

The invention claimed is:

1. A developer container comprising:

a cylindrical container main body for containing a developer for use in image formation, the developer container being detachably mounted on an image forming apparatus, the container main body being rotated about an axis thereof by driving means provided in the image forming apparatus to supply the developer to the image forming apparatus, the container main body having:

a concavity sinking inward in a radial direction including a discharge hole for discharging the developer, the discharge hole being located on a downstream end wall portion in a rotation direction of the concavity, wherein an opening area of the discharge hole is formed to be smaller than an area of the end wall portion, conveying means in an inner circumferential portion of the container main body, for conveying the developer in the axial direction when the container main body is rotated about the axis, the conveying means having a plurality of conveying portions, each conveying portion being disconnected from the others, extending in an extending direction from one end portion to the other end portion in the axial direction as it is directed to a downstream side in a rotation direction, the conveying portions being formed at intervals in a circumferential direction thereof and the axial direction, of which adjacent two conveying portions in the axial direction being arranged in such a manner that an end portion on a downstream side in the rotation direction of one conveying portion and an end portion on an upstream side in the rotation direction of the other conveying portion adjoin each other in the axial direction, wherein a length in the extending direction of each conveying portion is not less than 1/16 and not more than 3/8 of an inner circumferential length of the container main body.

2. The developer container of claim 1, and the conveying means conveys the developer in the axial direction of the container main body toward the discharge hole while oscillating the developer by rotating the container main body.

3. The developer container of claim 1, wherein the conveying portions are formed so as to meander in a substantially S-shape.

4. The developer container of claim 1, wherein the container main body is provided with a discharge hole for discharging the developer, and the conveying portions are formed so that the conveying amount of the developer by a conveying portion formed in a close portion to the discharge hole becomes larger than the conveying amount of the developer by a conveying portion formed in a distant portion from the discharge hole.

5. The developer container of claim 4, wherein the conveying portions are formed so that the conveying portions formed in a close portion to the discharge hole proceed in the axial direction in the longer distance as proceeding in the circumferential direction in comparison with the conveying portion formed in the distant portion from the discharge hole.

6. The developer container of claim 4, wherein the conveying portions are formed so that the conveying portion formed in the close portion to the discharge hole have a larger size in an extending direction in comparison with the conveying portion formed in the distant portion from the discharge hole.

7. The developer container of claim 4, wherein the conveying portions are formed so as to protrude inward in a radial direction, and the conveying portion formed in the close portion to the discharge hole is formed so as to have a larger protruding amount inward in the radial direction in comparison with the conveying portion formed in the distant portion from the discharge hole.

8. The developer container of claim 4, wherein the discharge hole is provided on a substantially middle portion in the axial portion of the container main body.

9. An image forming apparatus in which the developer container of claim 1 is detachably mounted.

* * * * *